US009475295B2

(12) United States Patent
Yamasaki et al.

(10) Patent No.: US 9,475,295 B2
(45) Date of Patent: Oct. 25, 2016

(54) LIQUID EJECTING APPARATUS AND LIQUID SUPPLY UNIT

(71) Applicant: Seiko Epson Corporation, Tokyo (JP)

(72) Inventors: Keigo Yamasaki, Matsumoto (JP); Manabu Yamaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/800,531

(22) Filed: Jul. 15, 2015

(65) Prior Publication Data

US 2016/0016410 A1 Jan. 21, 2016

(30) Foreign Application Priority Data

Jul. 18, 2014 (JP) ..... 2014-147469

(51) Int. Cl.
*B41J 2/175* (2006.01)
*B05B 1/14* (2006.01)
*B05B 12/14* (2006.01)

(52) U.S. Cl.
CPC ..... *B41J 2/17513* (2013.01); *B05B 1/14* (2013.01); *B05B 12/1409* (2013.01); *B41J 2/175* (2013.01); *B41J 2/17523* (2013.01); *B41J 2/17553* (2013.01)

(58) Field of Classification Search
CPC .. B41J 2/175; B41J 2/17503; B41J 2/17513; B41J 2/17523
See application file for complete search history.

(56) References Cited

U.S. PATENT DOCUMENTS

2001/0026306 A1 10/2001 Yamazaki et al.
2005/0068369 A1* 3/2005 Katayama ..... B41J 2/1755 347/49

FOREIGN PATENT DOCUMENTS

| | | | |
|---|---|---|---|
| JP | 2001-260377 | A | 9/2001 |
| JP | 2001-260378 | A | 9/2001 |
| JP | 2001-260379 | A | 9/2001 |
| JP | 2001-270131 | A | 10/2001 |
| JP | 2001-293880 | A | 10/2001 |
| JP | 2010-184424 | A | 8/2010 |

* cited by examiner

*Primary Examiner* — Geoffrey Mruk

(57) ABSTRACT

A liquid ejecting apparatus includes: a printing head; and a liquid supply unit. The printing head has a reservoir, a plurality of liquid supply ports connected to the reservoir, and a liquid introduction inlet. A first liquid supply port and a second liquid supply port are positioned at ends of the plurality of liquid supply ports in a first direction. Outer periphery of the liquid introduction inlet includes one end section and another end section in the first direction. The one end section is closer to the first liquid supply port than the second liquid supply port. The liquid includes a first liquid with a high content of pigment, and a second liquid with a lower content of pigment. The liquid supply unit supplies the second liquid to the one end section of the liquid introduction inlet.

11 Claims, 37 Drawing Sheets

LIQUID EJECTING APPARATUS AND LIQUID SUPPLY UNIT

CROSS-REFERENCE TO RELATED APPLICATIONS

This application claims priority to Japanese Patent Application No. 2014-147469 filed on Jul. 18 2014. The entire disclosure of Japanese Patent Application No. 2014-147469 is incorporated herein by reference.

BACKGROUND

1. Technical Field

The present invention relates to a liquid ejecting apparatus, a liquid supply unit, and the like.

2. Related Art

In an ink jet printer which is an aspect of a liquid ejecting apparatus, printing is performed on a printing medium such as printing paper by discharging ink, which is an aspect of liquid, from a printing head onto the printing medium. An ink jet printer is known which receives an ink from an ink cartridge which is an aspect of a liquid container. In addition, ink which contains pigment (hereinafter referred to as pigment ink) is known as an aspect of ink. In pigment inks there are cases where color concentration difference between inks is generated due to precipitating of pigment components within ink. In the related art, in an ink cartridge which contains pigment ink, a configuration is known in which a hollow ink supply tube is inserted toward the inside of a porous body that is impregnated with pigment ink (for example, refer to JP-A-2001-270131). In the ink cartridge, the inside of the ink supply tube communicates with an ink supply opening. Then, multiple through holes are formed on the periphery of the ink supply tube. According to this configuration, it is possible to lead ink from multiple locations in the up and down direction of the porous body to the ink supply opening. For this reason, even if there is a pigment ink concentration difference in the up and down direction of the porous body, inks with different concentrations converge inside the ink supply pipe. It is easy to suppress generation of color concentration difference on a printing material at initial use and later use of the cartridge by mixing pigment inks with different concentrations that converge inside the ink supply pipe.

In the ink cartridge which is described in JP-A-2001-270131, pigment inks with different concentrations converge with one another then reach a printing head. At this time, even if the pigment inks with different concentrations converge with one another before reaching the printing head, it is found that there are cases where concentration differences are not eliminated. In an ink flow path from the ink cartridge to the printing head, there are cases where there are flows of a plurality of pigment inks with different concentrations. That is, there are cases in which a flow of high-concentration pigment ink and a flow of low-concentration pigment ink coexist within one flow path. As a result, in a configuration in which ink is delivered from one flow path to a plurality of nozzles, high-concentration pigment ink concentrates on a specific nozzle out of the plurality of nozzles. For this reason, liquid ejecting apparatuses and liquid supply units in the related art have a problem in that it is difficult to improve printing quality.

SUMMARY

The invention can be realized as the following embodiments and aspects.

[Aspect 1]

According to this aspect, there is provided a liquid ejecting apparatus comprising:

a head unit; and a liquid supply unit which is configured to supply liquid that contains pigment to the head unit, the head unit comprising:

a mounting section including a liquid introduction pipe, and a head section including a liquid introduction flow path which is linked to the liquid introduction pipe, the head section including a first layer, a second layer, and a third layer which is positioned between the first layer and the second layer, the first layer including at least one nozzle row, and the at least one nozzle row including a plurality of nozzles, the third layer including a reservoir which retains the liquid, a plurality of pressure generating chambers which communicate with the reservoir, and a plurality of liquid supply ports, each of the plurality of liquid supply ports being a portion that is connected to the reservoir and that is included in a flow path that reaches from the reservoir to the plurality of nozzles, one out of the plurality of pressure generating chambers being corresponding to one of the plurality of nozzles, and one out of the plurality of liquid supply ports being corresponding to one of the plurality of pressure generating chambers, the second layer including a liquid introduction flow path and a liquid introduction inlet, the liquid introduction flow path being configured to supply the liquid to the reservoir, and the liquid introduction inlet being a portion that is connected to the reservoir and that is included in the liquid introduction flow path, in a state where the head section is in planar view in a direction from the second layer toward the first layer, a first one of the plurality of liquid supply ports being defined as a first liquid supply port, and a second one of the plurality of liquid supply ports being defined as a second liquid supply port, the first liquid supply port being positioned at one end of the plurality of liquid supply ports in a first direction in which the plurality of nozzles are arranged, and the second liquid supply port being positioned at another end of the plurality of liquid supply ports in the first direction, in a state where the head section is in planar view in a direction from the second layer toward the first layer, an outer periphery of the liquid introduction inlet including one end section and another end section in the first direction, the one end section being closer to the first liquid supply port than the second liquid supply port, the liquid including a first liquid with a high content of pigment, and a second liquid with a lower content of pigment than the first liquid, and the liquid supply unit being configured to supply the second liquid to the one end section of the liquid introduction inlet.

In this aspect, the liquid supply unit is able to supply a first liquid with a high content of pigment and a second liquid with a lower content of pigment than the first liquid to one end section of a liquid introduction inlet. The one end section of the liquid introduction inlet is nearer to a first liquid supply port than the second liquid supply port. For this reason, out of the first liquid and the second liquid which are supplied to the one end section of the liquid introduction inlet, it is easy for at least the second liquid to be supplied to the first liquid supply port. Thereby, it is easy to avoid only the first liquid being supplied to the nozzle which corresponds to the first liquid supply port. As a result, since it is easy to avoid a state in which only liquid with a high content of pigment is supplied to the nozzle which is positioned at the one end of the nozzle row, it is possible to reduce the risk that remarkable uneven printing occurs in which only liquid with high content of pigment is ejected from the nozzle which is positioned on the one end of the nozzle row.

[Aspect 2]

According to this aspect, there is provided a liquid ejecting apparatus comprising:

a head unit; and a liquid supply unit which is configured to supply liquid that contains pigment to the head unit, the head unit comprising:

a mounting section including a liquid introduction pipe, and a head section including a liquid introduction flow path which is linked to the liquid introduction pipe, the head section including a first layer, a second layer, and a third layer which is positioned between the first layer and the second layer, the first layer including at least one nozzle row, and the at least one nozzle row including a plurality of nozzles, the third layer including a reservoir which retains the liquid, a plurality of pressure generating chambers which communicate with the reservoir, and a plurality of liquid supply ports, each of the plurality of liquid supply ports being a portion that is connected to the reservoir and that is included in a flow path that reaches from the reservoir to the plurality of nozzles, one out of the plurality of pressure generating chambers being corresponding to one of the plurality of nozzles, and one out of the plurality of liquid supply ports being corresponding to one of the plurality of pressure generating chambers, the second layer including a liquid introduction flow path and a liquid introduction inlet, the liquid introduction flow path being configured to supply the liquid to the reservoir, and the liquid introduction inlet being a portion that is connected to the reservoir and that is included in the liquid introduction flow path, in a state where the head section is in planar view in a direction from the second layer toward the first layer, a first one of the plurality of liquid supply ports being defined as a first liquid supply port, and a second one of the plurality of liquid supply ports being defined as a second liquid supply port, the first liquid supply port being positioned at one end of the plurality of liquid supply ports in a first direction in which the plurality of nozzles are arranged, and the second liquid supply port being positioned at another end of the plurality of liquid supply ports in the first direction, in a state where the head section is in planar view in a direction from the second layer toward the first layer, an outer periphery of the liquid introduction inlet including one end section and another end section in a second direction which is orthogonal to the first direction, the one end section being closer to the first liquid supply port than the second liquid supply port, the first liquid supply port being closer to the one end section than the other end section, the liquid including a first liquid with a high content of pigment and a second liquid with a lower content of pigment than the first liquid, and the liquid supply unit being configured to supply the second liquid to the one end section of the liquid introduction inlet.

In this aspect, out of the liquids, the liquid supply unit is able to supply the first liquid with a high content of pigment and the second liquid with a lower content of pigment than the first liquid to the one end section of the liquid introduction inlet. The one end section of the liquid introduction inlet is nearer to a first liquid supply port than the second liquid supply port. In addition, the first liquid introduction inlet is nearer to the one end section of the liquid introduction inlet than another end section of the liquid introduction inlet. For this reason, out of the first liquid and the second liquid which are supplied to the one end section of the liquid introduction inlet, it is easy for at least the second liquid to be supplied to the first liquid supply port. Thereby, it is easy to avoid only the first liquid being supplied to the nozzle which corresponds to the first liquid supply port. As a result, since it is easy to avoid a state in which only liquid with a high content of pigment is supplied to the nozzle which is positioned at the one end of the nozzle row, it is possible to reduce the risk that remarkable uneven printing occurs in which only liquid with high content of pigment is ejected from the nozzle which is positioned on the one end of the nozzle row.

[Aspect 3]

In the liquid ejecting apparatus according to the above aspect, the liquid supply unit comprising:

a flow path regulating mechanism configured to supply the second liquid, from one of the first liquid and the second liquid, to the one end section and the other end section of the liquid introduction inlet.

In this aspect, it is easy to avoid only the first liquid being supplied to the nozzle which corresponds to the first liquid supply port. As a result, since it is easy to avoid a state in which only liquid with a high content of pigment is supplied to the nozzle which is positioned at the one end of the nozzle row, it is possible to reduce the risk that remarkable uneven printing occurs in which only liquid with high content of pigment is ejected from the nozzle which is positioned on the one end of the nozzle row.

[Aspect 4]

According to this aspect, there is provided a liquid ejecting apparatus comprising:

a head unit; and a liquid supply unit which is configured to supply liquid that contains pigment to the head unit, the liquid supply unit comprising:

a casing configured to hold the liquid, a liquid supply section configured to supply the liquid to the head unit, and a flow path regulating mechanism configured to regulate a flow path in which the liquid reaches the liquid supply section, the head unit comprising:

a plurality of nozzles configured to eject the liquid, a reservoir configured to supply the liquid to the plurality of nozzles, a liquid introduction flow path configured to supply the liquid to the reservoir, and a liquid introduction pipe configured to be connected to the to the liquid supply section and to introduce the liquid to the liquid introduction flow path, in a state where the liquid supply unit is in planar view and in a state where the liquid supply unit is mounted in the head unit, the liquid introduction flow path including a first flow path section which extends in a first direction from the liquid introduction pipe, and a second flow path section which extends in a second direction from the reservoir, and an outer periphery of the liquid supply section including a first portion in which the flow path regulating mechanism is positioned between an outer periphery of the casing and the outer periphery of the liquid supply section, and a second portion in which the flow path regulating mechanism is not positioned between an outer periphery of the casing and the outer periphery of the liquid supply section, and in a state where a linking direction between the center of the liquid supply section and the center of the second portion is defined as a third direction, and a direction which is orthogonal to an arrangement direction of the plurality of nozzles is defined as a fourth direction, the flow path regulating mechanism being positioned between the center of the liquid supply section and the outer periphery of the casing in a direction which intersects with the third direction, and an angle between the first direction and the third direction and an angle between the second direction and the fourth direction being equal to one another.

In this aspect, it is easy for pigment which is precipitated inside the casing to flow from the second portion to the liquid introduction flow path. Meanwhile, it is difficult for pigment which is precipitated inside the casing to flow from the first portion to the liquid introduction flow path due the flow path regulating mechanism being positioned between the outer periphery of the casing and the liquid supply section. In the liquid ejecting apparatus, when the liquid supply unit is in planar view, the flow path regulating mechanism is positioned between the center of the liquid supply section and the outer periphery of the casing in a direction which intersects with the third direction. In addition, the angle between the first direction and the third direction and the angle between the second direction and the fourth direction are equal to one another. It is easy to avoid a state in which only liquid with a high content of pigment is supplied to the nozzle which is positioned at the one end of a nozzle row on which a plurality of nozzles are arranged by positioning the flow path regulating mechanism with such a relationship. As a result, it is possible to reduce the risk that remarkable uneven printing occurs in which only liquid with high content of pigment is ejected from the nozzle which is positioned on the one end of the nozzle row on which the plurality of nozzles are arranged.

[Aspect 5]

According to this aspect, there is provided a liquid supply unit configured to be mounted in the head unit according to claim 3, the liquid supply unit comprising:

a casing including a concave section, a first liquid holding member arranged in the concave section, a second liquid holding member arranged in the concave section, and a lid joined to the concave section, the first liquid holding member being arranged between the second liquid holding member and the lid, the casing including a first surface, a second surface which intersects with the first surface, and a third surface which intersects with the first surface and opposes the second surface, the casing including an opening formed on the first surface of the casing, the opening being through which the second liquid holding member is exposed outward and is configured to be contacted with the liquid introduction pipe, and in a state where the casing is in planar view in a direction from the lid toward the casing, the flow path regulating mechanism including a first partition wall section which is positioned between the opening and the second surface.

In this aspect, it is easy to avoid the state in which only liquid with a high content of pigment is supplied to the nozzle which is positioned at the one end of a nozzle row on which the plurality of nozzles are arranged. As a result, it is possible to reduce the risk that remarkable uneven printing occurs in which only liquid with high content of pigment is ejected from the nozzle which is positioned on the one end of the nozzle row on which the plurality of nozzles are arranged.

[Aspect 6]

In the liquid supply unit according to the above aspect, in a state where the casing is in planar view in a direction from the lid toward the casing, the flow path regulating mechanism including a second partition wall section positioned between the opening and the third surface.

In this aspect, using the flow path regulating mechanism, it is easy to avoid the state in which only liquid with a high content of pigment is supplied to the nozzle which is positioned at the other end of the nozzle row on which the plurality of nozzles are arranged. As a result, it is possible to reduce the risk that remarkable uneven printing occurs in which only liquid with high content of pigment is ejected from the nozzle which is positioned on the other end of the nozzle row on which the plurality of nozzles are arranged.

[Aspect 7]

In the liquid supply unit according to the above aspect, the casing including the first surface, a fourth surface which intersects with the first surface, the second surface, and the third surface, and a fifth surface which intersects with the first surface, the second surface, and the third surface, and opposes the fourth surface, in a state where the casing is in planar view in a direction from the lid toward the casing, the flow path regulating mechanism including a third partition wall section positioned between a contact region of the liquid introduction pipe and the second liquid holding member, and the fourth surface, and the first partition wall section and the second partition wall section being linked by the third partition wall section.

In the aspect, using the flow path regulating mechanism, it is easy to avoid the state in which only liquid with a high content of pigment is supplied to the nozzle which is positioned at the one end and the other end of the nozzle row on which the plurality of nozzles are arranged. As a result, it is possible to reduce the risk that remarkable uneven printing occurs in which only liquid with high content of pigment is ejected from the nozzles which are positioned on the one end and the other end of the nozzle row on which the plurality of nozzles are arranged.

[Aspect 8]

In the liquid supply unit according to the above aspect, the first partition wall section is a first plate-like member which is inserted into the first liquid holding member, and the first plate-like member is inserted into the first liquid holding member from a surface which comes into contact with the second liquid holding member of the first liquid holding member toward the lid.

In this aspect, using the first plate-like member, it is easy to avoid the state in which only liquid with a high content of pigment is supplied to the nozzle which is positioned at the one end of the nozzle row on which the plurality of nozzles are arranged. As a result, it is possible to reduce the risk that remarkable uneven printing occurs in which only liquid with high content of pigment is ejected from the nozzle which is positioned on the one end of the nozzle row on which the plurality of nozzles are arranged.

[Aspect 9]

In the liquid supply unit according to the above aspect, the first partition wall section is a first plate-like protruding section which is inserted into the first liquid holding member, and the first plate-like protruding section is inserted into the first liquid holding member from a surface which is opposite to the first liquid holding member of the concave section toward the lid.

In this aspect, using the first plate-like protruding section, it is easy to avoid the state in which only liquid with a high content of pigment is supplied to the nozzle which is positioned at the one end of the nozzle row on which the plurality of nozzles are arranged. As a result, it is possible to reduce the risk that remarkable uneven printing occurs in which only liquid with high content of pigment is ejected from the nozzle which is positioned on the one end of the nozzle row on which the plurality of nozzles are arranged.

[Aspect 10]

The liquid supply unit according to the above aspect further includes: a liquid container which is able to store the liquid; and a liquid supply pipe which links the liquid container and the concave section, and is able to supply the liquid from the liquid container to the concave section.

In this aspect, liquid is supplied from the liquid container to the concave section via the liquid supply pipe. Then, in the liquid supply unit, using the flow path regulating mechanism, it is easy to avoid the state in which only liquid with a high content of pigment is supplied to the nozzle which is positioned at the one end of the nozzle row on which the plurality of nozzles are arranged. As a result, it is possible to reduce the risk that remarkable uneven printing occurs in which only liquid with high content of pigment is ejected from the nozzle which is positioned on the one end of the nozzle row on which the plurality of nozzles are arranged.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment will be described below with reference to the drawings in an aspect of a liquid ejecting system. Here, there are times when the scale of the configuration and members in each of the drawings are different in order for the sizes to be to the extent such that it is possible for the respective configurations to be recognized.

Figure 1:
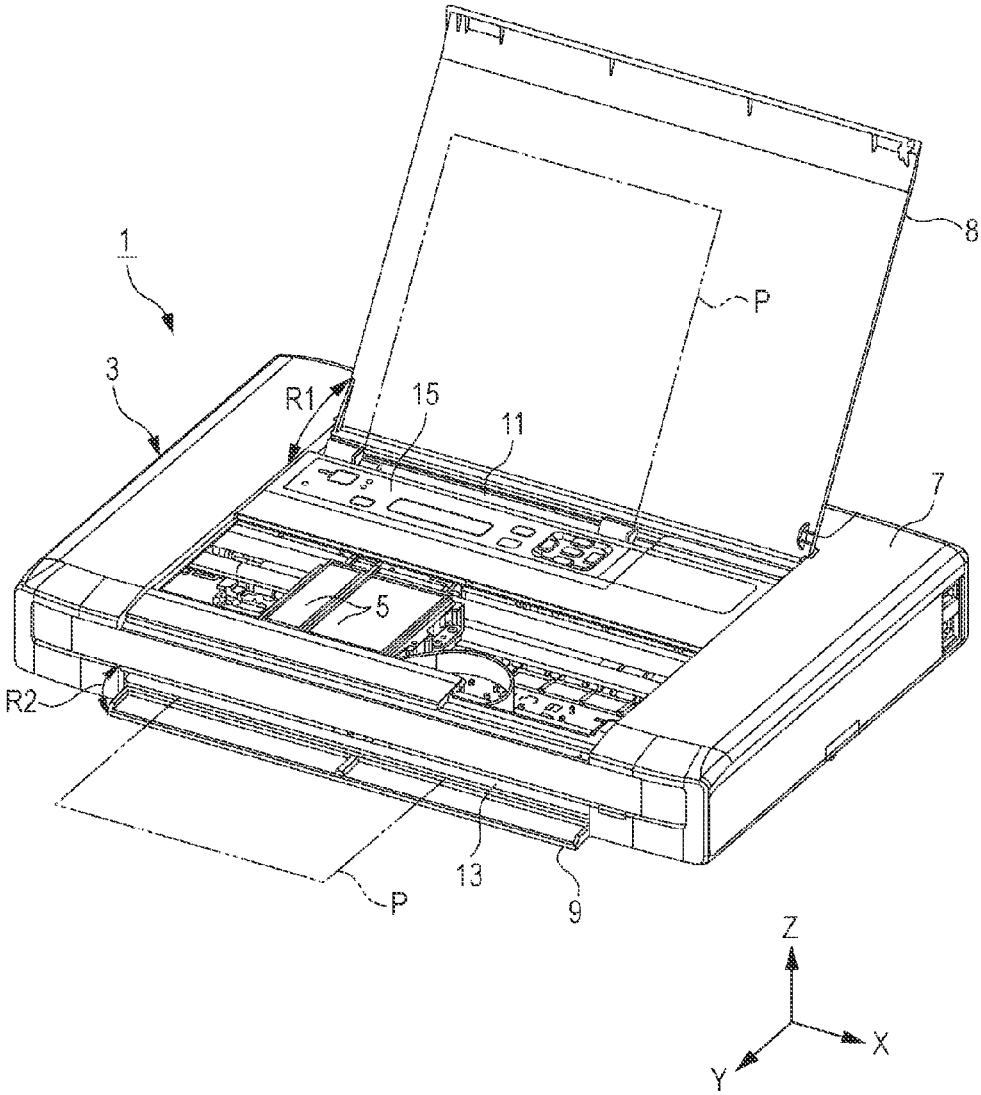
FIG. 1 is a perspective diagram illustrating a printer in the present embodiment.

As shown in FIG. 1, a liquid ejecting system 1 in the present embodiment has a printer 3 which is an aspect of a liquid ejecting apparatus and a cartridge 5 which is an aspect of a liquid container. The cartridge 5 is able to include ink which is an aspect of liquid. Here, X, Y, and Z axes, which are coordinate axes which are orthogonal to one other, are used in FIG. 1. The X, Y, and Z axes are also applied as required in the drawings shown hereafter. In the present embodiment, a state in which the printer 3 is arranged on a horizontal plane (XY horizontal plane) which is specified using the X axis and the Y axis is a usage state of the printer 3. The Z axis is an axis which is orthogonal to the horizontal plane. The Z axis direction is a vertically upward direction in the usage state of the printer 3. Then, in FIG. 1, the −Z axis direction is a vertically downward direction in the usage state of the printer 3. Here, in the respective X, Y and Z axes, the orientation of directional arrows show + (positive) directions and the orientation of directional arrows show − (negative) directions which are opposite to the orientations of the directional arrows.

As shown in FIG. 1, the printer 3 in the present embodiment has a case 7, a paper feed cover 8, and a paper discharge cover 9. The case 7, the paper feed cover 8, and the paper discharge cover 9 configure the outer shell of the printer 3. A mechanism unit which will be described later is accommodated inside the case 7.

The paper feed cover 8 is configured so as to be able to rotate in the R1 direction in the drawings with respect to the case 7. Thereby, the paper feed cover 8 is configured so as to be able to open with respect to the case 7. In a state in which the paper feed cover 8 is open with respect to the case 7 (hereinafter referred to as an open state), a recording medium P such as recording paper is in a state in which it is possible to be introduced from a paper feed section 11 into the printer 3. In addition, the paper discharge cover 9 is configured so as to be able to rotate in the R2 direction in the drawings with respect to the case 7. Thereby, the paper discharge cover 9 is configured so as to be able to open with respect to the case 7. When the paper discharge cover 9 is in the open state with respect to the case 7, the recording medium P is in a state in which it is possible to be discharged out of the printer 3 from a paper discharge section 13. Here, in FIG. 1, the open state of the paper feed cover 8 and the paper discharge cover 9 is shown.

In addition, the printer 3 has an operation panel 15. A power source button, other operation buttons, and the like are included on the operation panel 15. It is possible for an operator who operates the printer 3 to operate the printer 3 via the power source button and the other power source buttons in a state in which the paper feed cover 8 is open with respect to the case 7.

Figure 2:
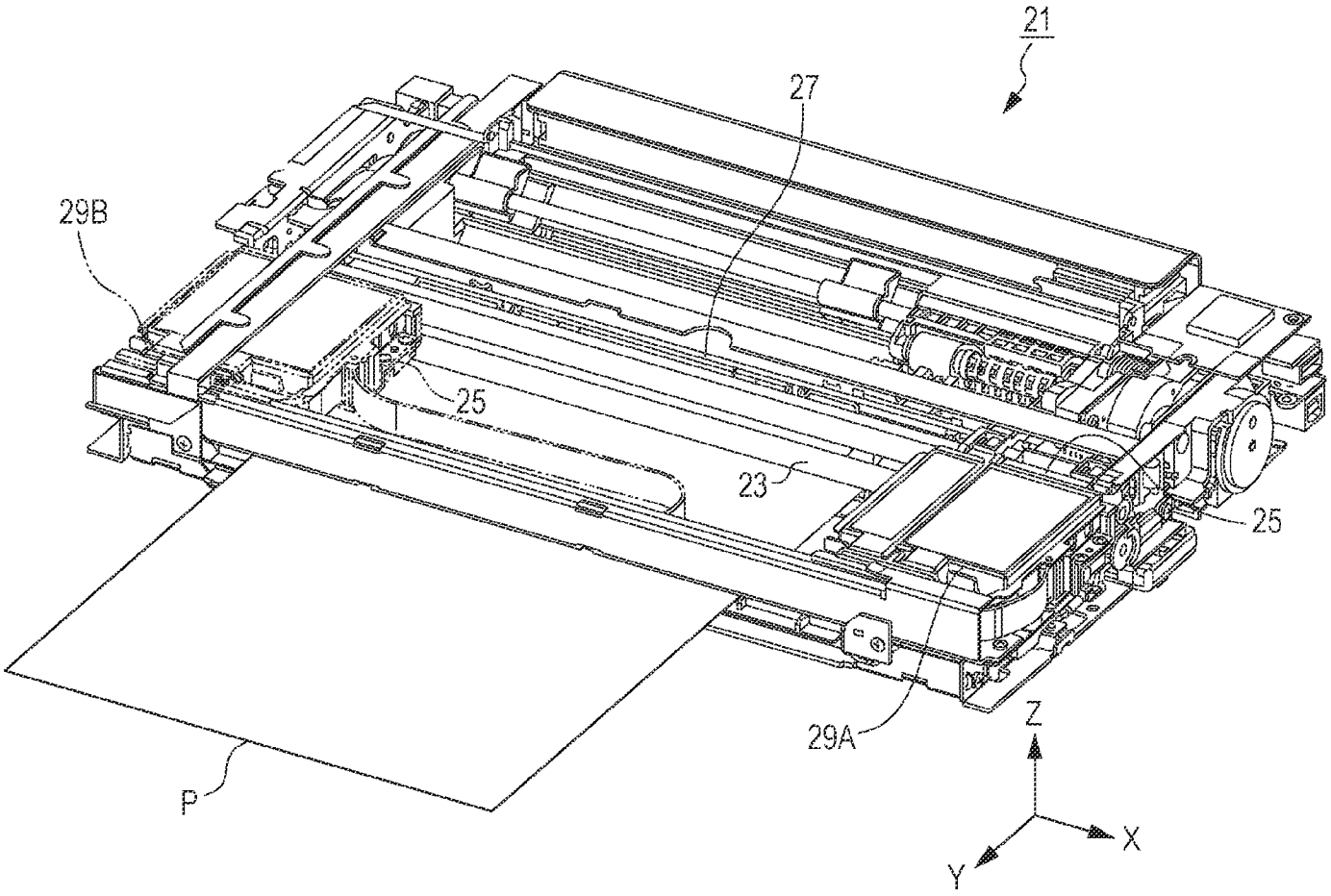
FIG. 2 is a perspective diagram illustrating an apparatus body of the printer in the present embodiment.

As shown in FIG. 2, the mechanism unit 21 has a transport roller 23 and a carriage unit 25. In addition, the mechanism unit 21 has a medium transport mechanism (which is not shown in the drawings) and a carriage transport mechanism (which is not shown in the drawings). The medium transport mechanism transports the recording medium P along the Y axis direction using the motive force of a motor (which is not shown in the drawings). The carriage mechanism transports the carriage unit 25 along the X axis direction using the motive force of the motor (which is not shown in the drawings). It is possible for the carriage unit 25 to move reciprocally between a first standby position 29A and a second standby position 29B along the X axis using the carriage transport mechanism. In the present embodiment, the movable region for the carriage unit 25 is between the first standby position 29A and the second standby position 29B.

Figure 3:
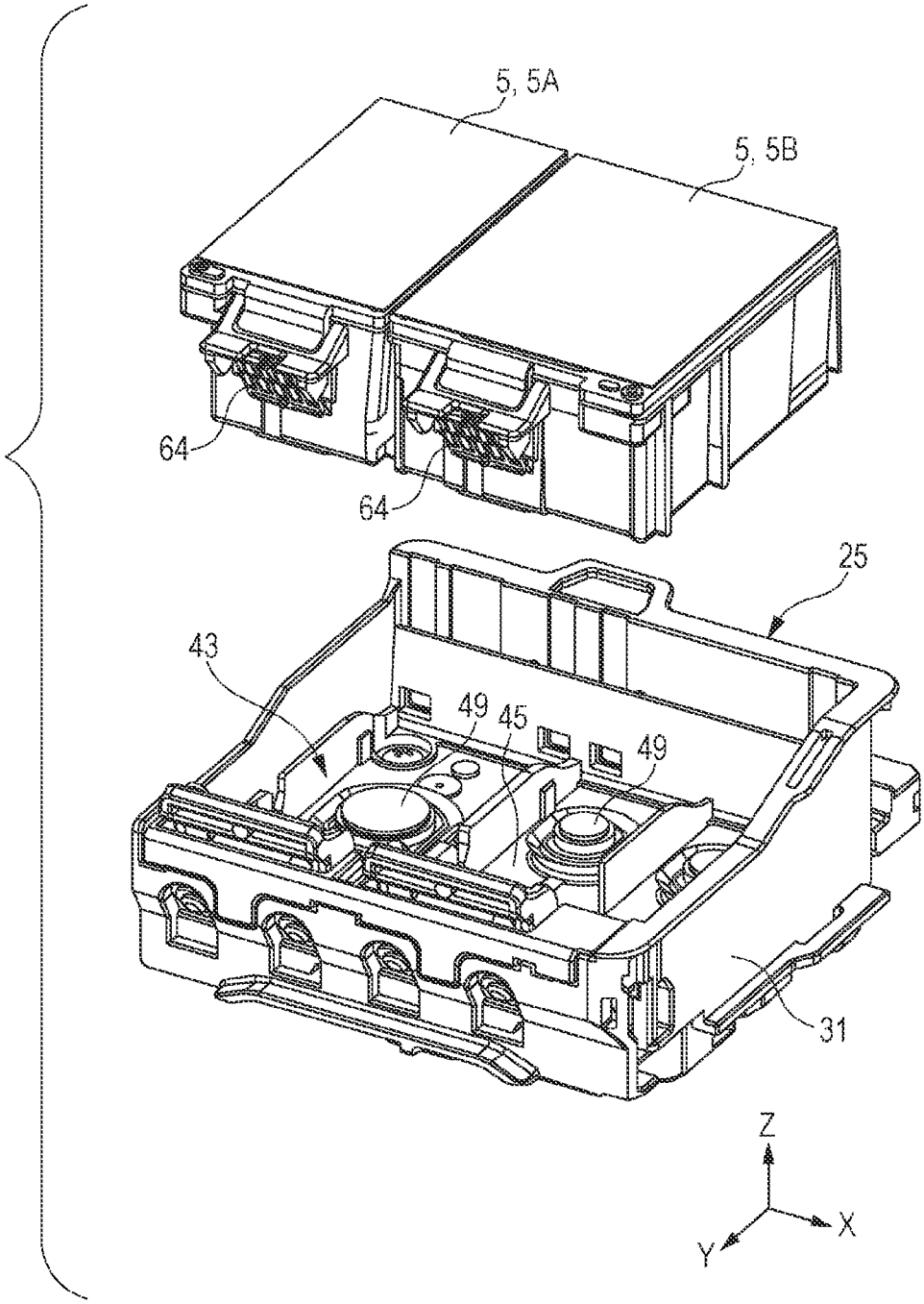
FIG. 3 is a perspective diagram illustrating a carriage unit and a cartridge in the present embodiment.

As shown in FIG. 3, the carriage unit 25 has a holder 31. The cartridge 5 is mounted in the holder 31. A concave section 43 is formed in the holder 31. The concave section 43 is formed at an orientation which is concave in the −Z axis direction. The cartridge 5 is mounted inside the concave section 43 of the holder 31. In the present embodiment, the cartridge 5 is configured so as to attachable and detachable with respect to the holder 31. The cartridge 5 contains pigment ink which is an aspect of liquid. In the present embodiment, it is possible to mount a plurality of (two) cartridges 5 in the holder 31. However, the number of cartridges 5 is not limited to a plurality (two), and may be one, or may be three or more. Below, the two cartridges 5 are respectively represented by a cartridge 5A and a cartridge 5B in a case where the two cartridges 5 are individually identified.

A plurality of inks which are different types from one another are contained in the two cartridges 5. In the present embodiment, the plurality of inks which are different colors from one another are included in the two cartridges 5. In the present embodiment, four types of black, yellow, magenta, and cyan are adopted as the colors of the ink which is contained in the two cartridges 5. Out of the four types of ink, black ink is contained in the cartridge 5A. Out of the types of ink, yellow, magenta, and cyan ink are contained in the cartridge 5B.

Figure 4:
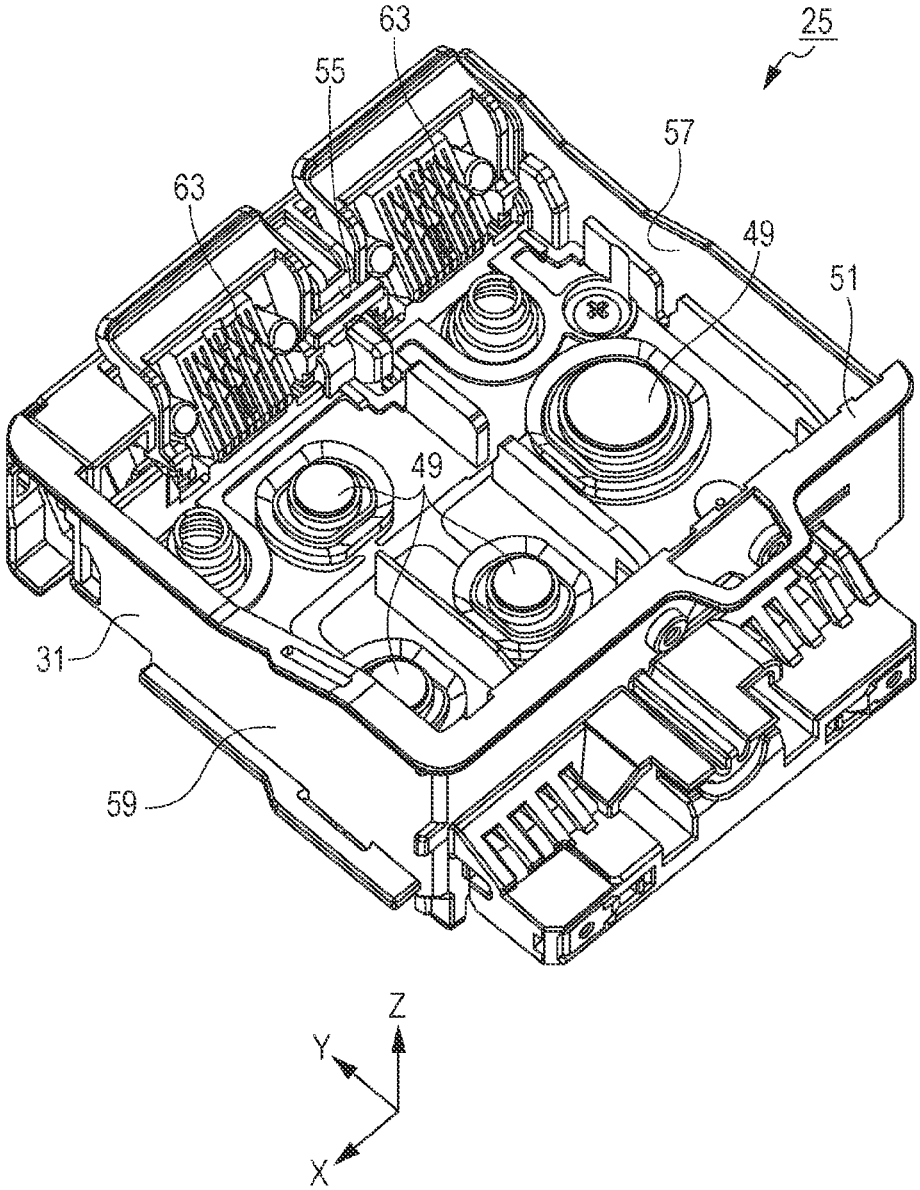
FIG. 4 is a perspective diagram illustrating the carriage unit in the present embodiment.

Four introducing sections 49 are included in a bottom section 45 inside the concave section 43. As shown in FIG. 4, the holder 31 has a side wall 55 which interposes the four introducing sections 49 along the Y axis direction, and is on the opposite side (the Y axis direction) of a side wall 51. In addition, a side wall 57 and a side wall 59 interpose the four introducing sections 49 and are included at respective branching positions along the X axis. The side wall 57 is positioned further in the −X axis direction side than the four introducing sections 49. The side wall 59 is positioned further in the X axis direction side than the four introducing sections 49. The side wall 51, the side wall 55, the side wall 57, and the side wall 59 respectively protrude from the bottom section 45 in the Z axis direction. Here, the side wall 51 to the side wall 59 need not be orthogonal with respect to the bottom section 45, and may intersect with respect to the bottom section 45. In addition, the bottom section 45 is enclosed by the side wall 51, the side wall 55, the side wall 57, and the side wall 59. Thereby, the concave section 43 is formed. Two contact mechanisms 63 are included on the side wall 55. The two contact mechanisms 63 are lined up along the X axis.

Here, as shown in FIG. 3, a circuit board 64 is included in each of the two cartridges 5. A storage device (which is not shown in the drawings) such as a non-volatile memory is included on the circuit board 64. The contact mechanisms 63 are configured so as to be able to be electrically connected to the storage device which is included on the circuit board 64 of the cartridge 5. Then, the storage device which is included on the circuit board 64 of the cartridge 5 and a control circuit (which is not shown in the drawings) of the printer 3 are electrically connected to one another via the contact mechanism 63 in a state in which the cartridge 5 is mounted in the holder 31. Thereby, various information is exchanged between the storage device which is included on the circuit board 64 of the cartridge 5 and the control circuit of the printer 3.

Figure 5:
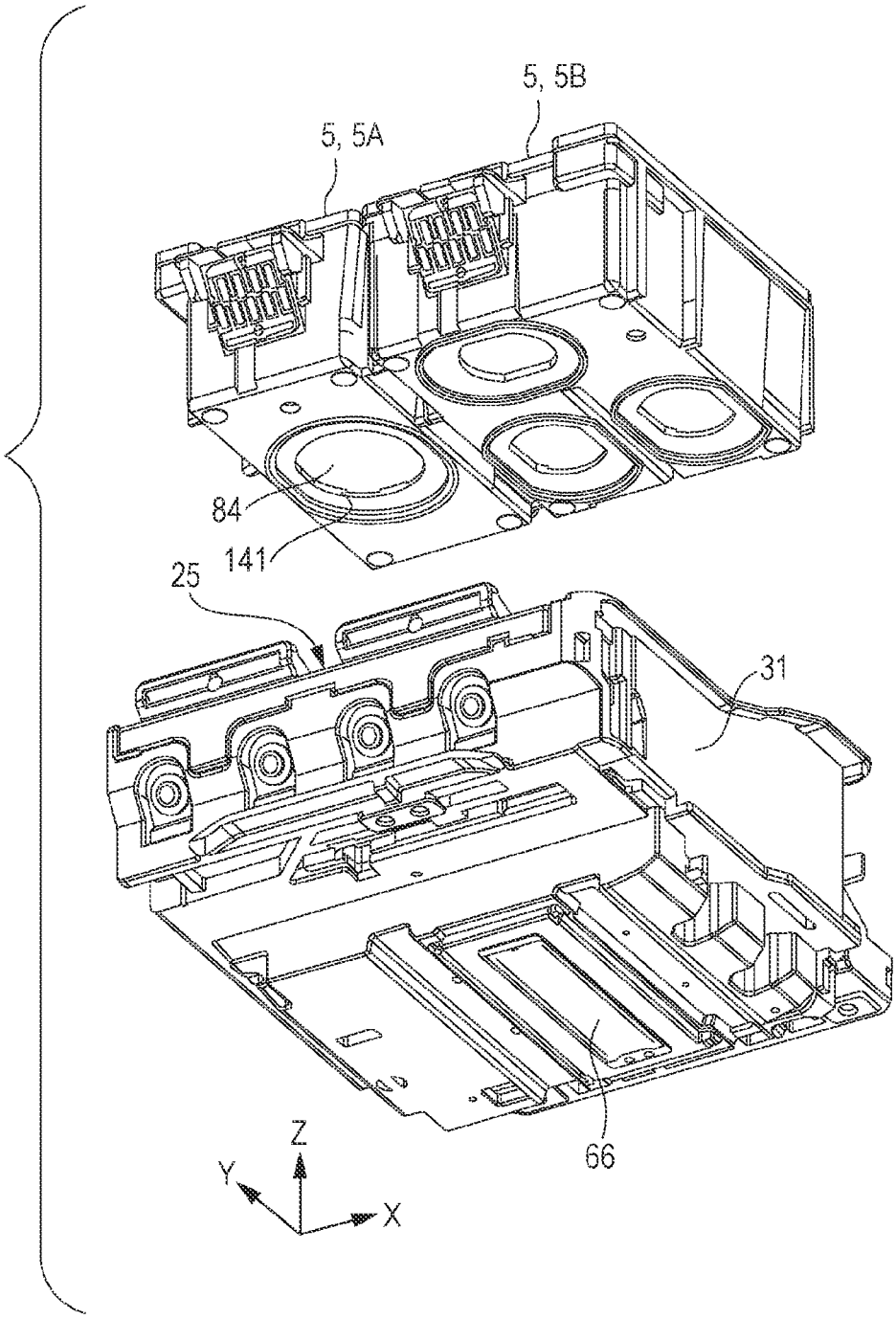
FIG. 5 is a perspective diagram illustrating the carriage unit and the cartridge in the present embodiment.

As shown in FIG. 5, the carriage unit 25 has a printing head 66. The printing head 66 is included in the −Z axis direction of the holder 31 in the carriage unit 25. Ink is supplied to the printing head 66 from the two cartridges 5 via the introducing section 49 (FIG. 3). The printing head 66 discharges ink, which is supplied from the two cartridges 5, as ink droplets from a nozzle (which is not shown in the drawings). As described above, the printing head 66 is mounted in the carriage unit 25. For this reason, it is possible to transport the printing head 66 along the X axis direction via the carriage unit 25 using the carriage transport mechanism. Printing is executed on the printing medium P by discharging ink droplets from the printing head 66 while changing the relative position of the printing head 66 with regard to the printing medium P using the medium transport mechanism and the carriage transport mechanism.

Here, in the printer 3, directions in which the printing head 66 is transported via the carriage unit 25 is defined as the X axis direction and the −X axis direction, and a direction in which the recording medium P is transported is defined as the Y axis direction. Then, a direction which is orthogonal to both the X axis direction and the Y axis direction is the Z axis direction. In the usage state of the printer 3, the X axis direction and the Y axis direction are each horizontal directions and the Z axis direction is a vertically upward direction. However, in the explanation below, there are cases where a direction is explained in which the Z axis direction is different (intersects with) the vertically upward direction.

Figure 6:
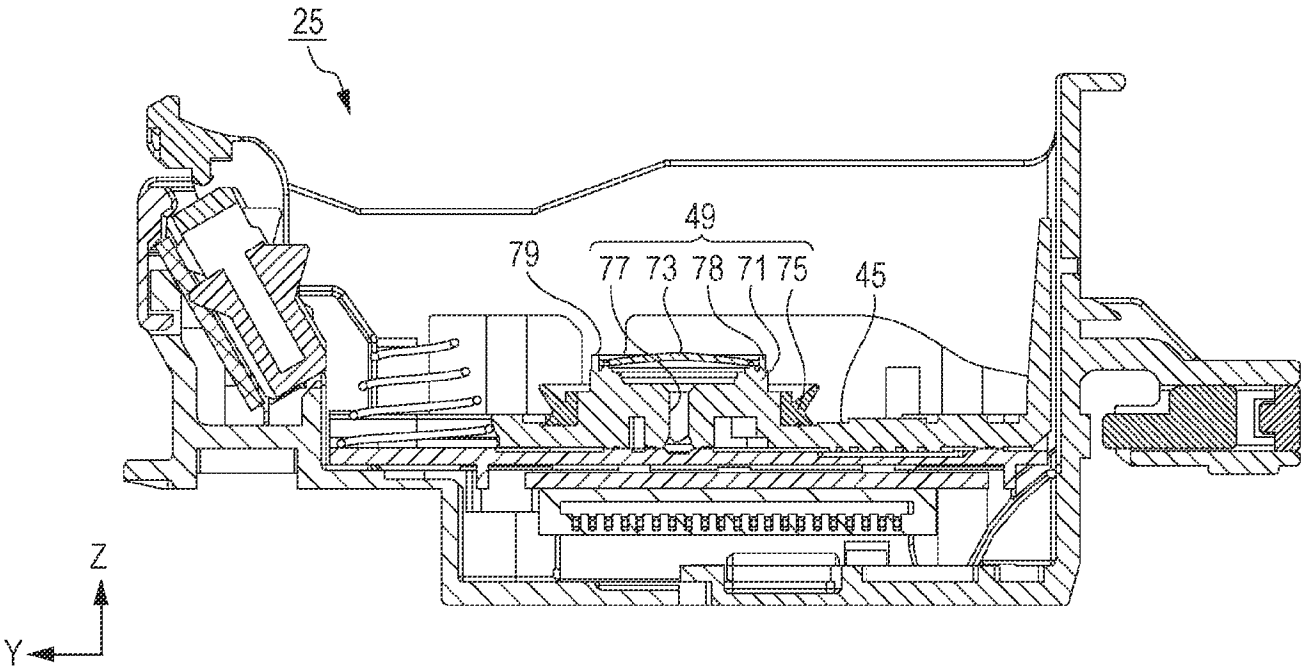
FIG. 6 is a sectional diagram illustrating the carriage unit in the present embodiment.

As shown in FIG. 6 which is a sectional diagram of the carriage unit 25, the introducing section 49 is included in the bottom section 45 of the holder 31. Here, in FIG. 6, a sectional surface is shown where the carriage unit 25 is cut away in the YZ horizontal plane which passes through the introducing section 49. The introducing section 49 includes an introduction pipe 71, a filter 73, and a packing 75. The introduction pipe 71 is included on the bottom section 45, and protrudes from the bottom section 45 in an orientation which is convex in the Z axis direction. A flow path 77 and a bank section 78 are formed in the introduction pipe 71. The flow path 77 is a path for ink which is supplied from the cartridge 5, and is included as an opening which passes through the bottom section 45. The bank section 78 is included on an end section in the Z axis direction of the introduction pipe 71, and protrudes in an orientation which is convex in the Z axis direction. When the bottom section 45 is in planar view, the bank section 78 encloses the flow path 77 in annular form inside the concave section 43. For this reason, the bank section 78 has the annular form. An opening section 79 of the bank section 78 with annular form is a receiving opening for ink from the cartridge 5 to the introducing section 49.

In the present embodiment, the direction in which the bank section 78 with annular form protrudes, that is, the direction in which the flow path 77 extends is the Z axis direction. That is, the central axis of the flow path 77 extends in the Z axis. The filter 73 is included inside the bank section 78, and covers the opening at the concave section 43 side of the flow path 77 from the concave section 43 side. The packing 75 is included on the bottom section 45, and encloses the bank section 78 inside the concave section 43. For example, the packing 75 is configured by a material which has elasticity such as rubber or an elastomer. Aspect 1

Figure 7:
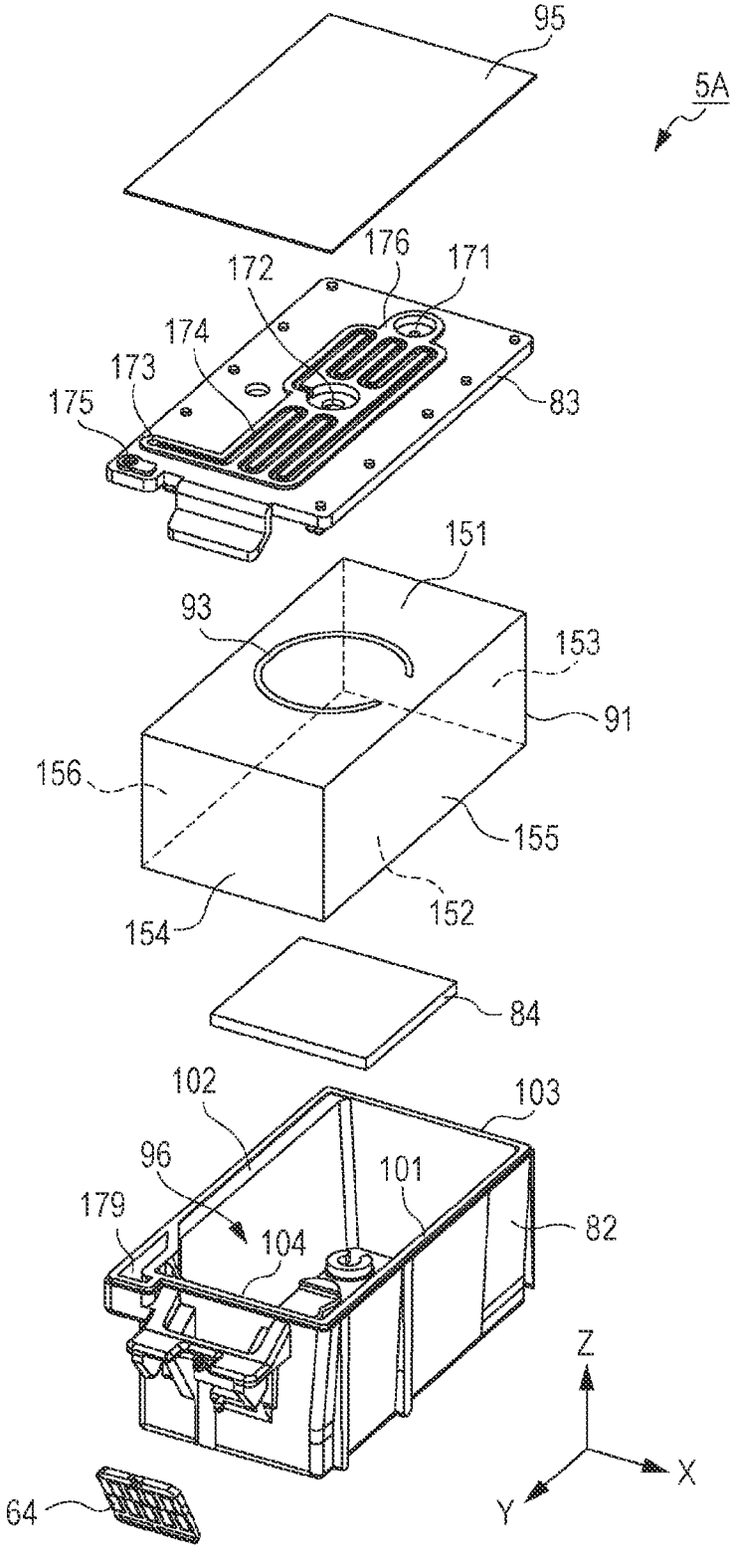
FIG. 7 is an exploded perspective diagram illustrating the cartridge in the present embodiment.

The cartridge 5A and the cartridge 5B of Aspect 1 will be described. As shown in FIG. 7, the cartridge 5A has a first case 82 which is an aspect of a casing and a second case 83 which is an aspect of a lid. The first case 82 and the second case 83 configure the outer shell of the cartridge 5A. In addition, the cartridge 5A has a holding member 84, a holding member 91, a regulating member 93, and a sheet member 95. The first case 82 has a concave section 96 which has a container form. The holding member 84, the holding member 91, and the regulating member 93 are accommodated inside the concave section 96 of the first case 82.

Figure 8:
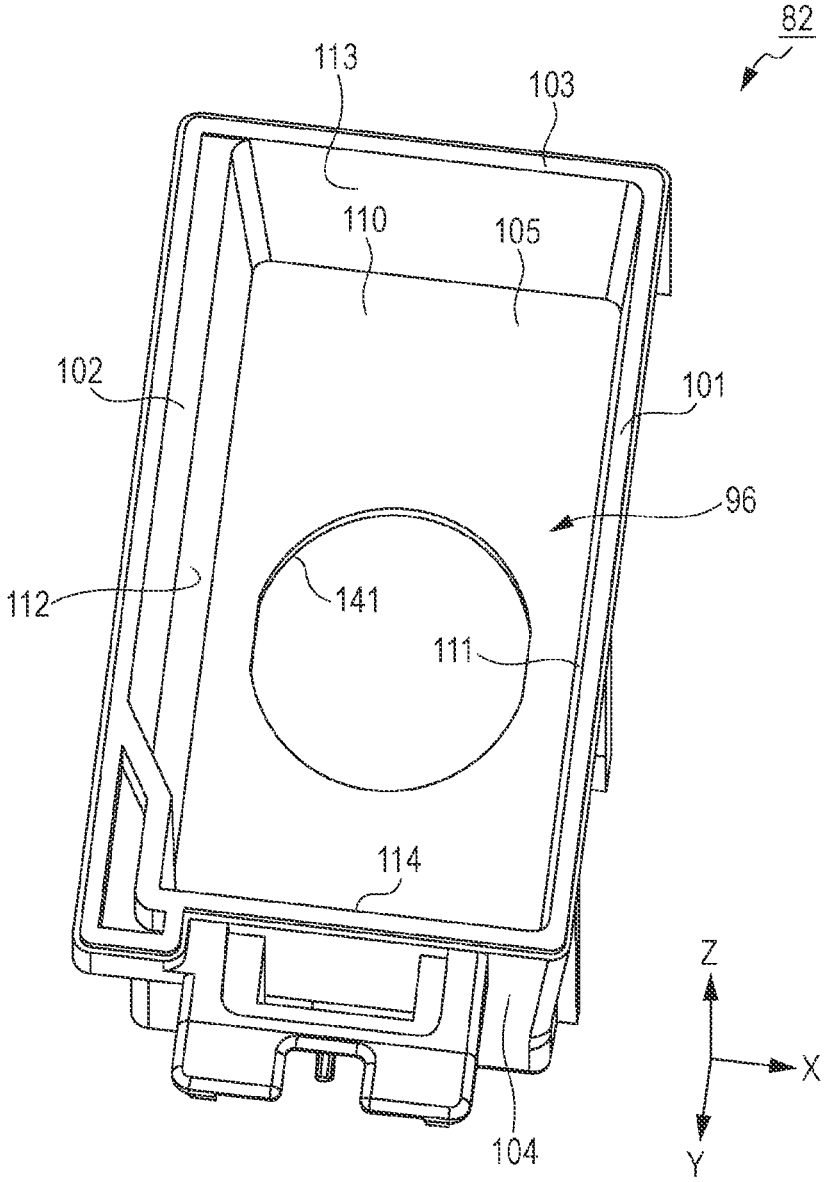
FIG. 8 is a perspective diagram illustrating a first case in the present embodiment.

As shown in FIG. 8, the first case 82 has a partition wall 101, a partition wall 102, a partition wall 103, a partition wall 104, and a partition wall 105. The partition wall 105 spreads out along the XY horizontal plane. The partition walls 101 to 104 each protrude from the partition wall 105 in the Z axis direction. Here, the partition walls 101 to 104 need not be orthogonal with respect to the partition wall 105, and may intersect with respect to the partition wall 105. In addition, when the partition wall 105 is in planar view in the −Z axis direction, the partition walls 101 to 104 surround the partition wall 105. When the partition wall 105 is in planar view in the −Z axis direction, the partition wall 101 and the partition wall 102 each extend along the Y axis. When the partition wall 105 is in planar view in the −Z axis direction, the partition wall 103 and the partition wall 104 each extend along the X axis direction.

The partition wall 101 and the partition wall 102 interpose the partition wall 105 and oppose one another along the X axis. The partition wall 101 is positioned further in the X axis direction than the partition wall 102. The partition wall 103 and the partition wall 104 interpose the partition wall 105 and oppose one another along the Y axis. The partition wall 104 is positioned further in the Y axis direction than the partition wall 103. The partition wall 103 intersects with the partition wall 101 and the partition wall 102. The partition wall 104 also intersects with the partition wall 101 and the partition wall 102. As described above, the concave section 96 is formed in the first case 82.

In the first case 82, the concave section 96 is formed by a bottom wall 110, a first side wall 111, a second side wall 112, a third side wall 113, and a fourth side wall 114. The first side wall 111 to the fourth side wall 114 each configure an inside wall of the concave section 96, and protrude from the bottom wall 110 in the Z axis direction. Here, the first side wall 111 to the fourth side wall 114 need not be orthogonal with respect to the bottom wall 110, and may intersect with respect to the bottom wall 110. In addition, when the bottom wall 110 is in planar view in the −Z axis direction, the first side wall 111 to the fourth side wall 114 surround the bottom wall 110. Thereby, the concave section 96 is formed. When the bottom wall 110 is in planar view, the first side wall 111 and the second side wall 112 each extend along the Y axis. In the same manner, the third side wall 113 and the fourth side wall 114 each extend along the X axis.

The bottom wall 110 is a wall surface which is a portion of the partition wall 105 and is inside the concave section 96. The first side wall 111 is a wall surface which is a portion of the partition wall 101 and is inside the concave section 96. The second side wall 112 is a wall surface which is a portion of the partition wall 102 and is inside the concave section 96. The third side wall 113 is a wall surface which is a portion of the partition wall 103 and is inside the concave section 96. The fourth side wall 114 is a wall surface which is a portion of the partition wall 104 and is inside the concave section 96. Here, the bottom wall 110 and the first side wall 111 to the fourth side wall 114 are each not limited to being a flat surface, and may include concavities and convexities, or include a curved surface. In addition, in each of the partition walls 101 to 105, the surface outside of the concave section 96 is also not limited to being a flat surface, and may include concavities and convexities, or include a curved surface.

A supply hole 141 is formed in the partition wall 105. The supply hole 141 passes through the partition wall 105. The supply hole 141 which is formed in the concave section 96 passes through between the inside of the concave section 96 and the outside of the first case 82. Ink which is included in the concave section 96 is discharged to the outside of the cartridge 5A from the supply hole 141.

Figure 9:
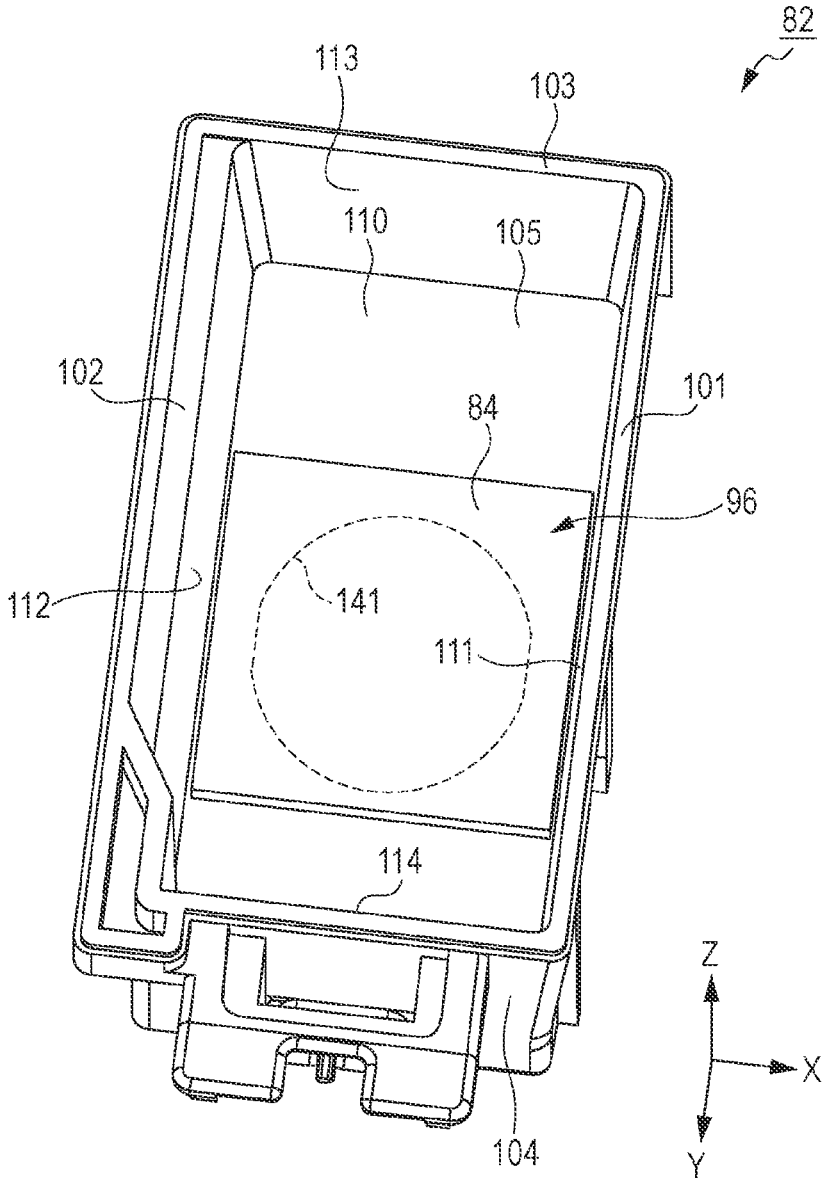
FIG. 9 is a perspective diagram illustrating the first case and a holding member in the present embodiment.

As shown in FIG. 9, the holding member 84 is accommodated inside the concave section 96 of the first case 82. The holding member 84 has a plate form, and has a size so as to cover the supply hole 141. The holding member 84 is included at a position which overlaps with the supply hole 141, and covers the supply hole 141 from the inside of the concave section 96. The holding member 84 is located on the bottom wall 110 of the concave section 96. The holding member 84 absorbs ink, and has a property in which the absorbed ink is held. It is possible to adopt various materials, for example, foam, felt, non-woven fabric, or the like as the material of the holding section 84. In the present embodiment, non-woven fabric is adopted as the material of the holding member 84.

As shown in FIG. 7, the holding member 91 is included more on the second case 83 side than the holding member 84. That is, the holding member 91 is interposed between the holding member 84 and the second case 83. Inside the concave section 96, the holding member 91 and the holding member 84 abut one another. Here, the concave section 96 is configured so as to narrow from the second case 83 side in the −Z axis direction. In addition, the holding member 91 is formed to be larger than the concave section 96. For this reason, when the holding member 91 is accommodated inside the concave section 96, the holding member 91 is compressed along the partition wall 105 (FIG. 9). As a result, inside the concave section 96, capillary force of the holding member 91 increases from the second case 83 side toward the partition wall 105 side.

For example, it is possible to adopt a fiber member in which a synthetic resin that is processed in a fiber form is bundled, a foamable resin material such as polyurethane, or the like as the material of the holding member 91. In the present embodiment, the fiber member in which a synthetic resin that is processed in a fiber form is bundled is adopted as the material of the holding member 91. Furthermore, a synthetic resin which includes polypropylene that is included in the material of the first case 82 is preferable as the synthetic resin which configures the fiber member.

Here, as shown in FIG. 7, in the holding member 91, the surface which opposes the second case 83 is defined as a first surface 151. Then, the surface which opposes the first surface 151 is defined as a second surface 152. In addition, a surface which intersects with the first surface 151 and the second surface 152 is defined as a third surface 153. In addition, a surface which intersects with the first surface 151 and the second surface 152, and which opposes the third surface 153 is defined as a fourth surface 154. In addition, a surface which intersects with the first surface 151, the second surface 152, the third surface 153, and the fourth surface 154 is defined as a fifth surface 155. In addition, a surface which intersects with the first surface 151, the second surface 152, the third surface 153, and the fourth surface 154, and which opposes the fifth surface 155 is defined as a sixth surface 156. Here, the first surface 151 to the sixth surface 156 are each not limited to being a flat surface, and may include concavities and convexities, or include a curved surface.

In the holding member 91, the second surface 152 opposes the bottom wall 110 (FIG. 8), the third surface 153 opposes the third side wall 113, the fourth surface 154 opposes the fourth side wall 114, the fifth surface 155 opposes the first side wall 111, and the sixth surface 156 opposes the second side wall 112.

Figure 10:
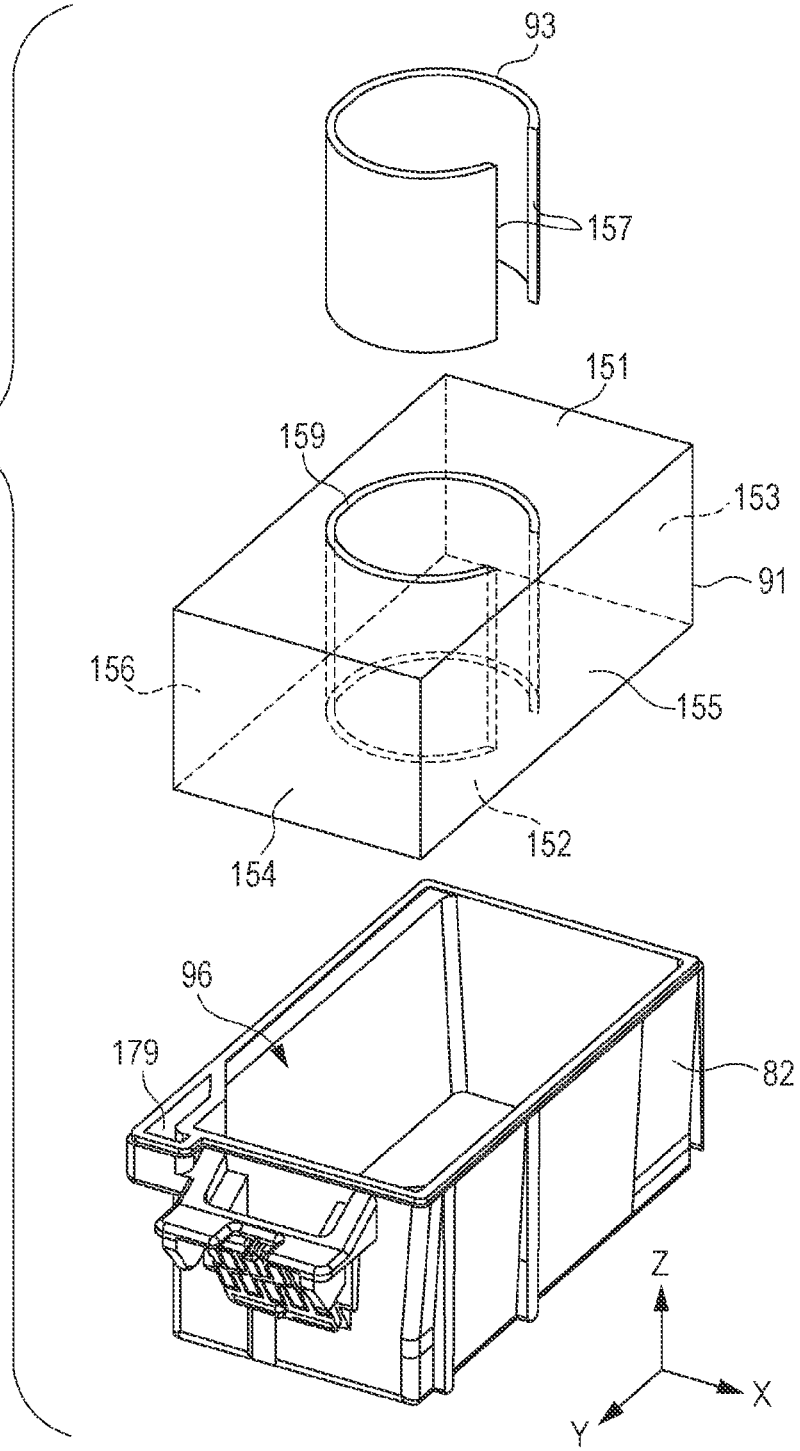
FIG. 10 is an exploded perspective diagram illustrating the first case, the holding member, and a regulating member in the present embodiment.

As shown in FIG. 7, the regulating member 93 is inserted in the holding member 91. As shown in FIG. 10, the regulating member 93 has a pipe form which extends along the Z axis. In the regulating member 93, a portion of the pipe form has a cutout section 157 which is cutout along the Z axis. For this reason, when the regulating member 93 is in planar view in the −Z axis direction, the regulating member 93 has a form in which a portion of an annular form is missing (cut out). Thereby, when the regulating member 93 is in planar view in the −Z axis direction, the regulating member 93 has a C shape. From another viewpoint, the regulating member 93 has an outer appearance with a plate form. The regulating member 93 has a configuration in which the member of a flat form is formed with a curved-surface form.

When the cartridge 5A is in planar view in the −Z axis direction, the regulating member 93 is positioned within a region which overlaps with the holding member 84. In the present embodiment, when the cartridge 5A is in planar view in the −Z axis direction, the regulating member 93 is positioned further outside than the supply hole 141 (FIG. 9) of the first case 82. Thereby, the supply hole 141 is positioned inside the annular form of the regulating member 93. However, the position of the regulating member 93 is not limited thereto, and, as long as being further outside than a region which is enclosed by the bank section 78 of the introducing section 49 (FIG. 6), may be positioned further inside than the supply hole 141 (FIG. 9) of the first case 82.

As shown in FIG. 10, a through hole 159 is formed in the holding member 91. The through hole 159 passes through the holding member 91 along the Z axis. The through hole 159 reaches from the first surface 151 of the holding member 91 to the second surface 152. The through hole 159 is formed to correspond to the regulating member 93. For this reason, the through hole 159 has a form in which a portion of an annular form is cut out to correspond to the regulating member 93. Thereby, when the holding member 91 is in planar view in the −Z axis direction, the through hole 159 has a C shape.

When the cartridge 5A is in planar view in the −Z axis direction, the through hole 159 of the holding member 91 is formed within a region which overlaps with the holding member 84. In the present embodiment, when the cartridge 5A is in planar view in the −Z axis direction, the through hole 159 of the holding member 91 is formed further outside than the supply hole 141 (FIG. 9) of the first case 82. However, the position of the through hole 159 is not limited thereto, and, as long as being further outside than a region which is enclosed by the bank section 78 of the introducing section (FIG. 6), may be positioned further inside than the supply hole 141 (FIG. 9) of the first case 82.

The regulating member 93 is inserted into the through hole 159 of the holding member 91. The regulating member 93 is formed to be bigger than the dimension of the through hole 159. For this reason, when the regulating member 93 is inserted into the through hole 159, the regulating member 93 and the through hole 159 are in a state of being interference fitted (press-fitted) to one another. Thereby, the outer circumference surface of the regulating member 93 and the holding member 91 abut one another, and the inner circumference surface of the regulating member 93 and the holding member 91 abut one another. Then, the regulating member 93 abuts the holding member 84 in a state in which the holding member 84 (FIG. 7) and the holding member 91 are accommodated inside the concave section 96 of the first case 82. Here, the through hole 159 which is formed in the holding member 91 may be a slit into which it is possible to insert the regulating member 93.

Figure 11:
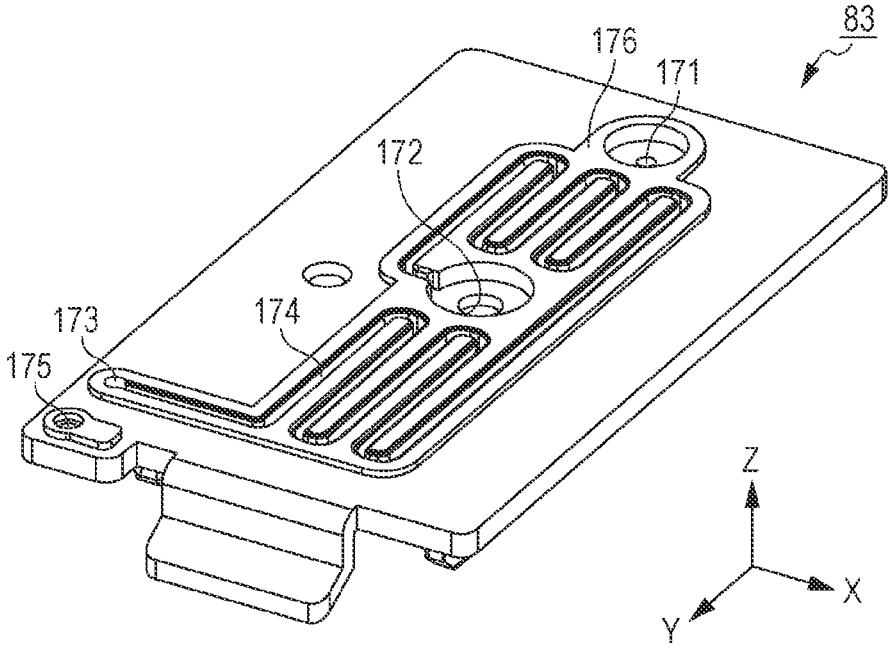
FIG. 11 is a perspective diagram illustrating a second case in the present embodiment.

As shown in FIG. 11, the second case 83 has a plate form. An injection hole 171, a linking hole 172, a relay hole 173, an introduction groove 174, an introduction hole 175, and a bank section 176 are formed in the second case 83. The injection hole 171, the linking hole 172, the relay hole 173, and the introduction hole 175 each pass through the second case 83 along the Z axis. The bank section 176 is formed at the Z axis direction side of the second case 83, and protrudes from the second case 83 in the Z axis direction.

The injection hole 171, the linking hole 172, the relay hole 173, and the introduction groove 174 are respectively surrounded by the bank section 176. The injection hole 171 is surrounded by a single bank section 176. The linking hole 172, the introduction groove 174, and the relay hole 173 are surrounded collectively by the bank section 176.

When the cartridge 5A is in planar view in the −Z axis direction, the injection hole 171 and the linking hole 172 are each formed within a region which overlaps with the concave section 96 (FIG. 7) of the first case 82. The injection hole 171 is used as an injection port when ink is injected inside the cartridge 5A. Black ink from the injection hole 171 is injected inside the concave section 96. After ink is in injected into the cartridge 5A, the injection hole 171 is blocked by the sheet member 95 (FIG. 7).

Figure 12:
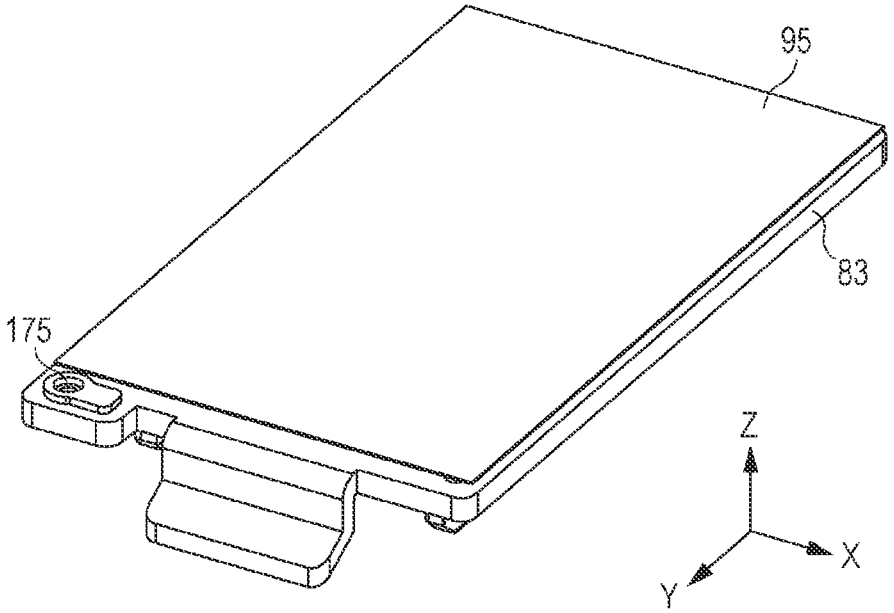
FIG. 12 is a perspective diagram illustrating the second case and a sheet member in the present embodiment.

As shown in FIG. 12, the sheet member 95 is joined to the second case 83 from the Z axis direction side of the second case 83. At this time, the sheet member 95 is joined to the bank section 176 of the second case 83 (FIG. 11). The sheet member 95 has a size so as to cover the injection hole 171 (FIG. 11), the linking hole 172, the relay hole 173, and the introduction groove 174. For this reason, the injection hole 171, the linking hole 172, the relay hole 173, and the introduction groove 174 are blocked from the Z axis direction side of the second case 83 by the sheet member 95. At this time, the introduction hole 175 is positioned further outside than the sheet member 95, and is not blocked by the sheet member 95.

Here, the introduction hole 175 and the relay hole 173 are formed at positions which overlap with a concave section 179 (FIG. 7) of the first case 82. When the first case 82 and the second case 83 are joined to one another, the introduction hole 175 and relay hole 173 are covered from the −Z axis direction side by the concave section 179. Thereby, the introduction hole 175 and relay hole 173 communicate with the concave section 179 of the first case 82. Thereby, a flow path is formed which communicates with the inside of the concave section 96 from the linking hole 172 in order of the introduction hole 175, the concave section 179, the relay hole 173, and the introduction groove 174. Since the introduction hole 175 is open to the atmosphere, an inner section of the concave section 96 communicates with the atmosphere via the linking hole 172, the introduction groove 174, the relay hole 173, the concave section 179, and the introduction hole 175.

Figure 13:
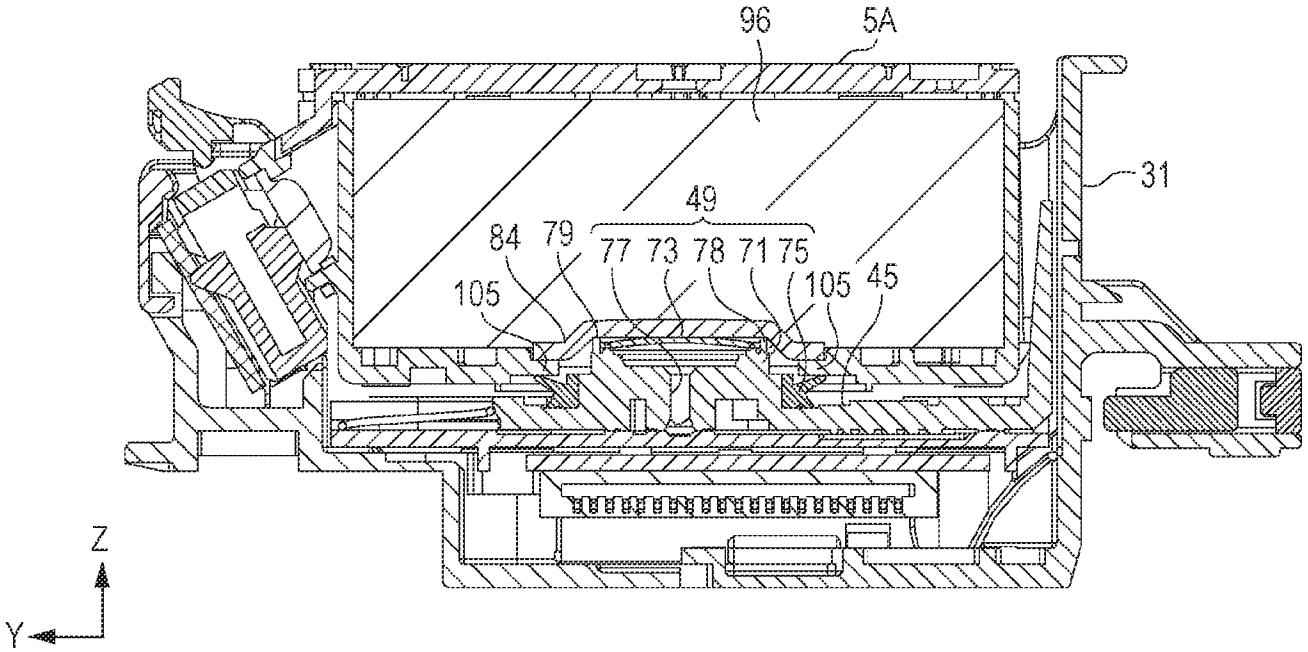
FIG. 13 is a sectional diagram illustrating the cartridge and the carriage unit in the present embodiment.

As shown in FIG. 13, when the cartridge 5A is mounted in the holder 31, the packing 75 abuts with the partition wall 105 of the cartridge 5A. At this time, the packing 75 abuts with the partition wall 105 in a sagged state. The packing 75 abuts with the partition wall 105 in a state in which the periphery of the supply hole 141 is surrounded from the outside of the supply hole 141. Thereby, when ink is supplied from the cartridge 5A to the flow path 77, ink which overflows outside a region that surrounds the bank section 78 is dammed by the packing 75. Thereby, in a state in which the cartridge 5A is mounted in the holder 31, it is easy to avoid ink inside the cartridge 5A leaking in the holder 31. When the cartridge 5A is mounted in the holder 31, the bank section 78 abuts with the holding member 84. In the present embodiment, when the cartridge 5A is mounted in the holder 31, the bank section 78 is set so as to press the holding member 84 to the inside of the concave section 96 of the cartridge 5A. Thereby, it is easy for the abutting state between the holding member 84 and the filter 73 to be maintained.

Here, a region which is exposed to the outside of the cartridge 5A via the supply hole 141 (FIG. 5) on the holding member 84 is defined as an ink supply opening. Then, a region of the ink supply opening in which the opening section 79 of the introduction pipe 71 (FIG. 13) and the holding member 84 overlap is defined as an ink supply section. Ink inside the cartridge 5A is supplied to the flow path 77 (FIG. 13) of the holder 31 via the ink supply section. The ink supply section has a structure which includes a portion that contacts the introduction pipe 71 (FIG. 13), and is collectively referred to as a structure in which it is possible for ink to be supplied from the cartridge 5A to the printing head 66. For this reason, the ink supply section is also defined as a structure which includes a portion that contacts the introduction pipe 71 into which the supply hole 141 (FIG. 5) is inserted. In addition, the ink supply section is also defined as a structure which includes the portion that contacts the introduction pipe 71 (FIG. 13) in the region of the holding member 84 in which the outside of the cartridge 5A is exposed via the supply hole 141 (FIG. 5). Here, these definitions also conform with respect to the cartridge 5B.

Figure 14:
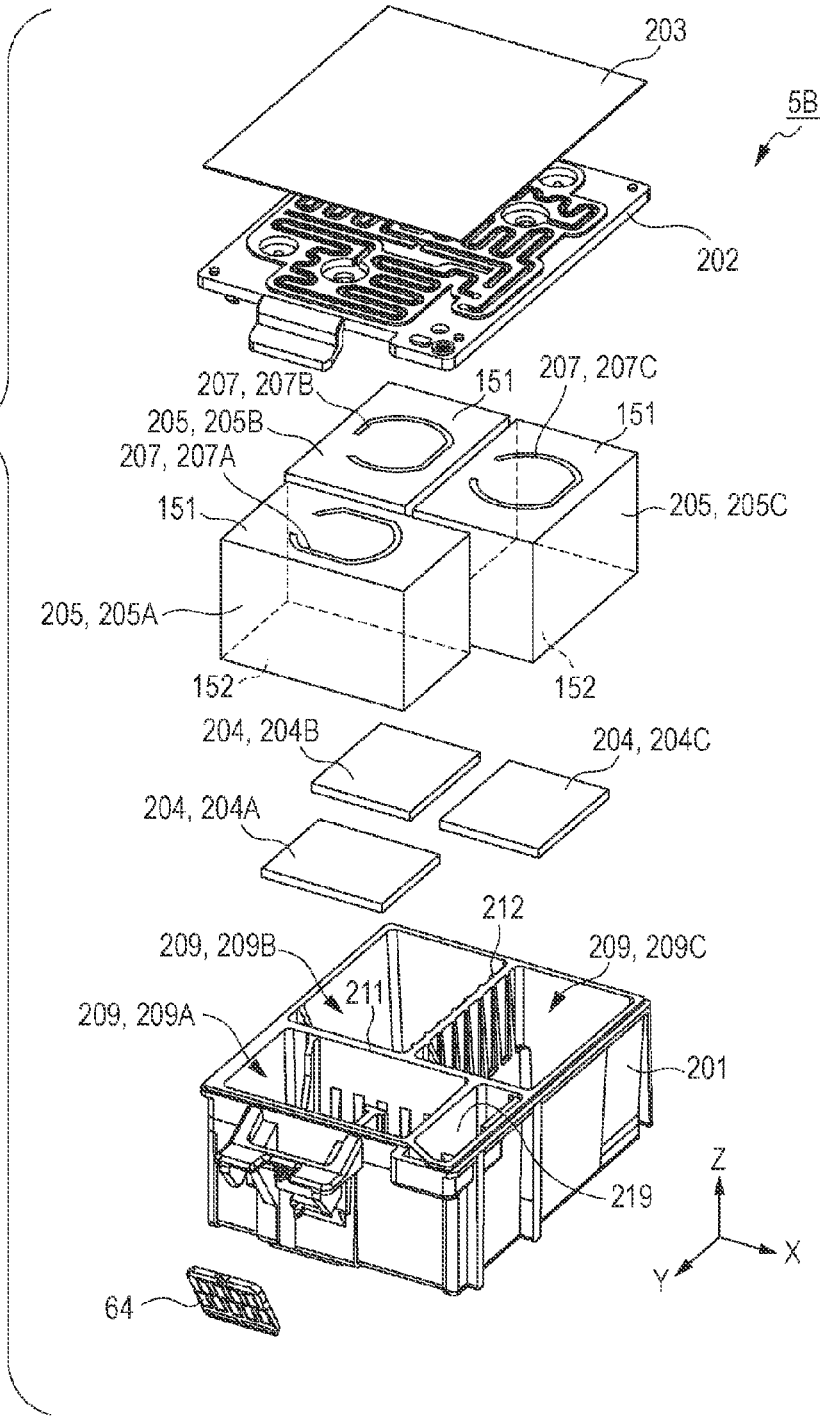
FIG. 14 is an exploded perspective diagram illustrating the cartridge in the present embodiment.

As shown in FIG. 14, the cartridge 5B has a third case 201, a fourth case 202, a sheet member 203, three holding members 204, three holding members 205, three regulating members 207, and the circuit board 64. The third case 201 has three concave sections 209 which have a container form. Below, in a case where the three holding members 205 are each identified, the three holding members 205 are respectively represented by a holding member 205A, a holding member 205B, and a holding member 205C. In addition, in a case where each of the three regulating members 207 are identified, the three regulating members 207 are respectively represented by a regulating member 207A, a regulating member 207B, and a regulating member 207C. In addition, in a case where each of the three concave sections 209 are identified, the three concave sections 209 are respectively represented by a concave section 209A, a concave section 209B, and a concave section 209C.

The three concave sections 209 are partitioned from one another by a partition wall 211 and a partition wall 212. The partition wall 211 extends along the X axis. The partition wall 212 extends along the Y axis. The concave section 209A and the concave section 209B interpose the partition wall 211, and are adjacent along the Y axis. In the same manner, the concave section 209A and the concave section 209C interpose the partition wall 211, and are adjacent along the Y axis. The concave section 209A is positioned further in the Y axis direction than the concave section 209B and the concave section 209C. The concave section 209B and the concave section 209C interpose the partition wall 212, and are adjacent along the X axis. The concave section 209C is positioned further in the X axis direction than the concave section 209B. The three concave sections 209 are formed to be the same dimension (size) to one another. In addition, the three holding members 205 are formed of the same material as one another and the same size as one another. Here, it is not necessary for the dimensions and sizes to entirely match one another, and some error may be included. The holding member 205 is formed using a fiber member in the same manner as the holding member 91.

Figure 15:
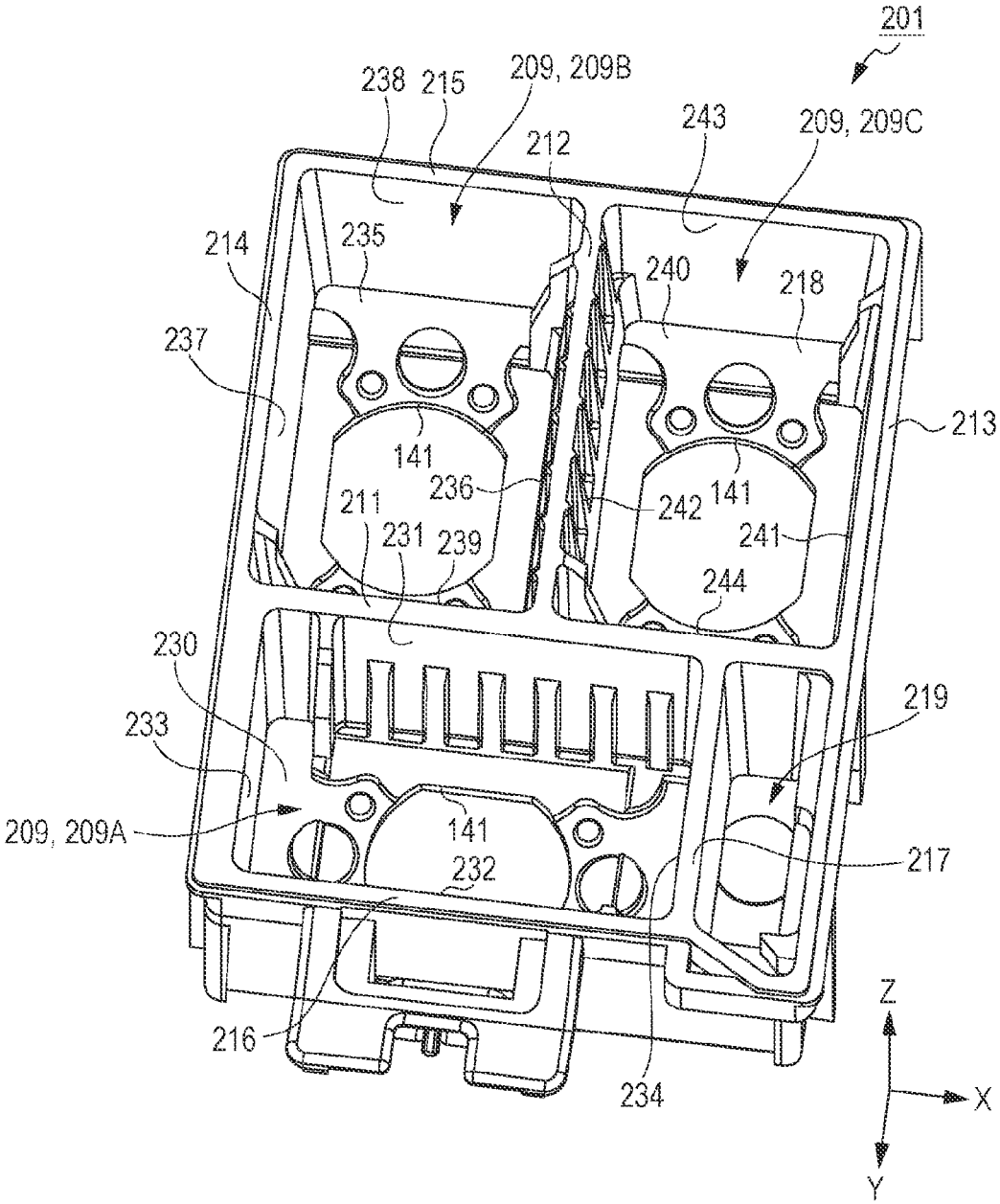
FIG. 15 is a perspective diagram illustrating a third case in the present embodiment.

As shown in FIG. 15, the third case 201 has a partition wall 213, a partition wall 214, a partition wall 215, a partition wall 216, a partition wall 217, and a partition wall 218. The partition wall 218 spreads out along the XY horizontal plane. The partition walls 211 to 217 each protrude from the partition wall 218 in the Z axis direction. Here, the partition walls 211 to 217 need not be orthogonal with respect to the partition wall 218, and may intersect with respect to the partition wall 218. In addition, when the partition wall 218 is in planar view in the −Z axis direction, the partition wall 213, the partition wall 214, and the partition wall 217 each extend along the Y axis. The partition wall 215 and the partition wall 216 extend along the X axis. The partition wall 213 and the partition wall 214 interpose the partition wall 211 and the partition wall 212 and oppose one another along the X axis. The partition wall 213 is positioned further in the X axis direction than the partition wall 214. The partition wall 217 and the partition wall 214 oppose one another along the X axis. The partition wall 217 is positioned further in the X axis direction than the partition wall 214. The partition wall 213 and the partition wall 217 oppose one another along the X axis. The partition wall 213 is positioned further in the X axis direction than the partition wall 217. Here, a plurality of supply holes 141 are formed in the partition wall 218. The supply hole 141 is formed in each concave section 209. The supply hole 141 passes through the partition wall 218.

The partition wall 215 and the partition wall 216 interpose the partition wall 211, the partition wall 212, and the partition wall 217 and oppose one another along the Y axis. The partition wall 216 is positioned further in the Y axis direction than the partition wall 215. The partition wall 213 intersects with the partition wall 211, the partition wall 215, and the partition wall 216. The partition wall 214 intersects with the partition wall 211, the partition wall 215, and the partition wall 216. The partition wall 215 intersects with the partition wall 212, the partition wall 213, and the partition wall 214. The partition wall 217 intersects with the partition wall 211 and the partition wall 216. As described above, three concave sections 209 are formed in the third case 201.

Here, a concave section 219 is formed at the X axis direction side of the concave section 209A. The concave section 219 interposes the partition wall 217 and is positioned at the X axis direction side of the concave section 209A. In addition, the concave section 219 interposes the partition wall 211 and is positioned at the Y axis direction side of the concave section 209C. The concave section 219 is enclosed by the partition wall 211, the partition wall 213, the partition wall 216, and the partition wall 217.

In the third case 201, the concave section 209A is formed by a bottom wall 230, a first side wall 231, a second side wall 232, a third side wall 233, and a fourth side wall 234. The first side wall 231 to the fourth side wall 234 each configure an inside wall of the concave section 209A, and protrude from the bottom wall 230 in the Z axis direction. Here, the first side wall 231 to the fourth side wall 234 need not be orthogonal with respect to the bottom wall 230, and may intersect with respect to the bottom wall 230. In addition, when the bottom wall 230 is in planar view in the −Z axis direction, the first side wall 231 to the fourth side wall 234 surround the bottom wall 230. Thereby, the concave section 209A is formed. When the bottom wall 230 is in planar view, the first side wall 231 and the second side wall 232 each extend along the X axis. When the bottom wall 230 is in planar view, the third side wall 233 and the fourth side wall 234 each extend along the Y axis.

The bottom wall 230 is a wall surface which is a portion of the partition wall 218 and is inside the concave section 209A. The first side wall 231 is a wall surface which is a portion of the partition wall 211 and is inside the concave section 209A. The second side wall 232 is a wall surface which is a portion of the partition wall 216 and is inside the concave section 209A. The third side wall 233 is a wall surface which is a portion of the partition wall 214 and is inside the concave section 209A. The fourth side wall 234 is a wall surface which is a portion of the partition wall 217 and is inside the concave section 209A. Here, the bottom wall 230 and the first side wall 231 to the fourth side wall 234 are each not limited to being a flat surface, and may include concavities and convexities, or include a curved surface.

In the third case 201, the concave section 209B is formed by a bottom wall 235, a first side wall 236, a second side wall 237, a third side wall 238, and a fourth side wall 239. The first side wall 236 to the fourth side wall 239 each configure an inside wall of the concave section 209B, and protrude from the bottom wall 235 in the Z axis direction. Here, the first side wall 236 to the fourth side wall 239 need not be orthogonal with respect to the bottom wall 235, and may intersect with respect to the bottom wall 235. In addition, when the bottom wall 235 is in planar view in the −Z axis direction, the first side wall 236 to the fourth side wall 239 surround the bottom wall 235. Thereby, the concave section 209B is formed. When the bottom wall 235 is in planar view, the first side wall 236 and the second side wall 237 each extend along the Y axis. When the bottom wall 235 is in planar view, the third side wall 238 and the fourth side wall 239 each extend along the X axis.

The bottom wall 235 is a wall surface which is a portion of the partition wall 218, and is inside the concave section 209B. The first side wall 236 is a wall surface which is a portion of the partition wall 212, and is inside the concave section 209B. The second side wall 237 is a wall surface which is a portion of the partition wall 214, and is inside the concave section 209B. The third side wall 238 is a wall surface which is a portion of the partition wall 215, and is inside the concave section 209B. The fourth side wall 239 is a wall surface which is a portion of the partition wall 211, and is inside the concave section 209B. Here, the bottom wall 235 and the first side wall 236 to the fourth side wall 239 are each not limited to being a flat surface, and may include concavities and convexities, or include a curved surface.

In the third case 201, the concave section 209C is formed by a bottom wall 240, a first side wall 241, a second side wall 242, a third side wall 243, and a fourth side wall 244. The first side wall 241 to the fourth side wall 244 each configure an inside wall of the concave section 209C, and protrude from the bottom wall 240 in the Z axis direction. Here, the first side wall 241 to the fourth side wall 244 need not be orthogonal with respect to the bottom wall 240, and may intersect with respect to the bottom wall 240. In addition, when the bottom wall 240 is in planar view in the −Z axis direction, the first side wall 241 to the fourth side wall 244 surround the bottom wall 240. Thereby, the concave section 209C is formed. When the bottom wall 240 is in planar view, the first side wall 241 and the second side wall 242 each extend along the Y axis. When the bottom wall 240 is in planar view, the third side wall 243 and the fourth side wall 244 each extend along the X axis.

The bottom wall 240 is a wall surface which is a portion of the partition wall 218, and is inside the concave section 209C. The first side wall 241 is a wall surface which is a portion of the partition wall 213, and is inside the concave section 209C. The second side wall 242 is a wall surface which is a portion of the partition wall 212, and is inside the concave section 209C. The third side wall 243 is a wall surface which is a portion of the partition wall 215, and is inside the concave section 209C. The fourth side wall 244 is a wall surface which is a portion of the partition wall 211, and is inside the concave section 209C. Here, the bottom wall 240 and the first side wall 241 to the fourth side wall 244 are each not limited to being a flat surface, and may include concavities and convexities, or include a curved surface.

The plurality of supply holes 141 are formed in the partition wall 218. The plurality of supply holes 141 each pass through the partition wall 218. In the present embodiment, at least one supply hole 141 is formed in each of the concave section 209A to the concave section 209C. The supply hole 141 which is formed in each of the concave section 209A to the concave section 209C passes through between the inside of each of the concave section 209A to the concave section 209C and the outside of the third case 201. Ink which is accommodated in each of the concave section 209A to the concave section 209C is discharged to outside of the cartridge 5B from the supply hole 141.

As shown in FIG. 14, a holding member 204A to a holding member 204C are respectively accommodated within the concave section 209A to the concave section 209C of the third case 201. The holding member 204A is accommodated inside the concave section 209A, the holding member 204B is accommodated inside the concave section 209B, and the holding member 204C is accommodated inside the concave section 209C. Each of the holding member 204A to the holding member 204C has a plate form, and has a size so as to cover one supply hole 141. Each of the holding member 204A to the holding member 204C is included at a position which overlaps with the supply hole 141 (FIG. 15), and covers the supply hole 141 from the inside of the respective concave section 209A to the concave section 209C. The holding member 204A is located on the bottom wall 230 of the concave section 209A. In addition, the holding member 204B is located on the bottom wall 235 of the concave section 209B, and the holding member 204C is located on the bottom wall 240 of the concave section 209C. For the material of the holding member 204, it is possible to adopt the same material as the holding member 84.

As shown in FIG. 14, three holding members 205 are each included more on the fourth case 202 side than the holding member 204. That is, in the concave section 209A, the holding member 205A is interposed between the holding member 204 and the fourth case 202. In the concave section 209B, the holding member 205B is interposed between the holding member 204 and the fourth case 202. In the concave section 209C, the holding member 205C is interposed between the holding member 204 and the fourth case 202. The holding member 205 is formed using a fiber member in the same manner as the holding member 91. In the same manner as the holding member 91, also in the holding member 205, the surface which opposes the fourth case 202 is defined as the first surface 151. In addition, in the same manner as the holding member 91, also in the holding member 205, the surface which opposes the partition wall 218 (FIG. 15) is defined as the second surface 152.

Figure 16:
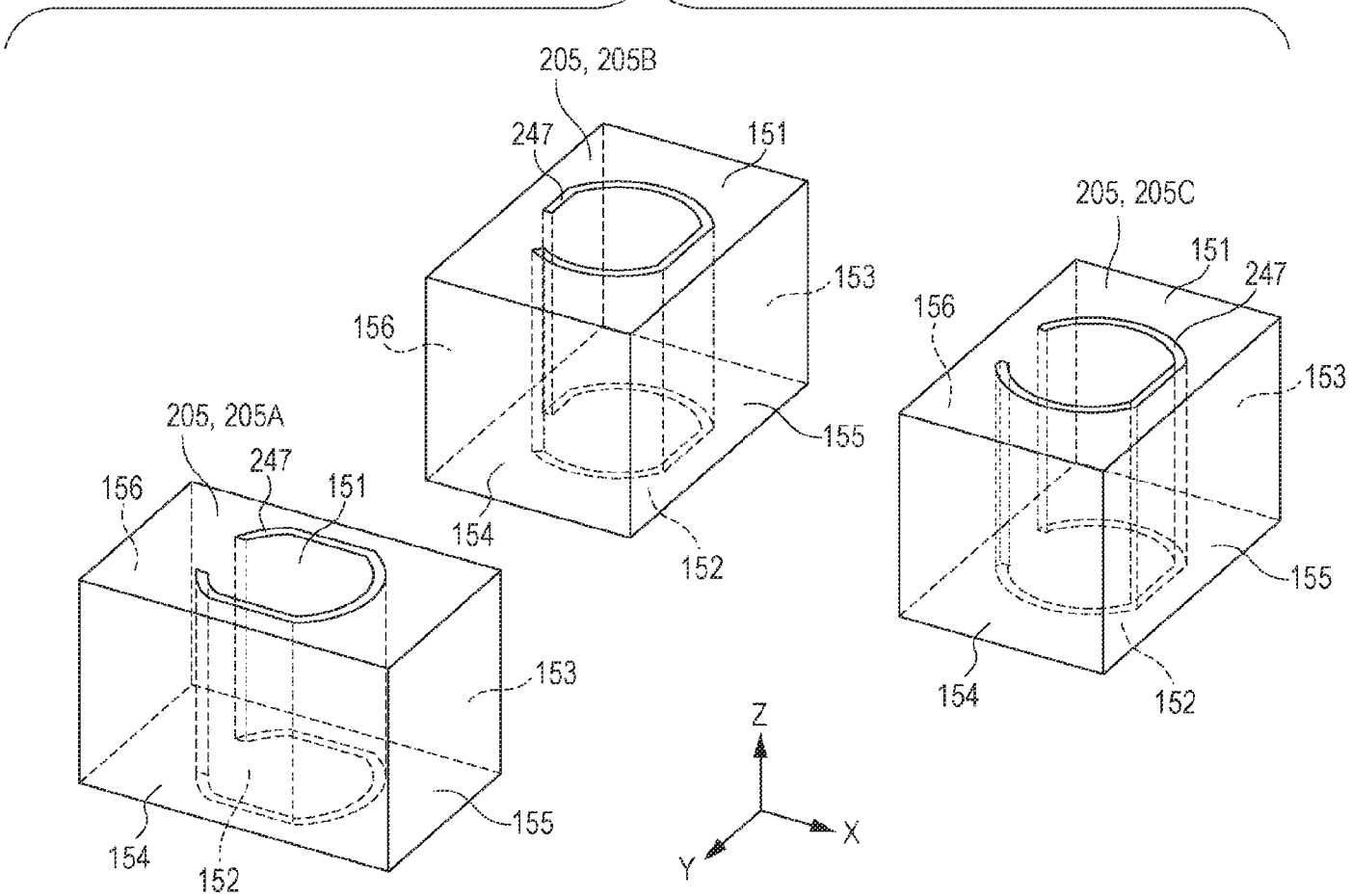
FIG. 16 is a perspective diagram illustrating the holding member and the regulating member in the present embodiment.

In addition, as shown in FIG. 16, in the holding member 205, the surface which intersects with the first surface 151 and the second surface 152 is defined as the third surface 153. In addition, the surface which intersects with the first surface 151 and the second surface 152, and which opposes the third surface 153 is defined as the fourth surface 154. In addition, a surface which intersects with the first surface 151, the second surface 152, the third surface 153, and the fourth surface 154 is defined as the fifth surface 155. In addition, a surface which intersects with the first surface 151, the second surface 152, the third surface 153, and the fourth surface 154, and which opposes the fifth surface 155 is defined as the sixth surface 156. Also in the holding member 205, the first surface 151 to the sixth surface 156 are each not limited to being a flat surface, and may include concavities and convexities, or include a curved surface.

In the holding member 205A, the third surface 153 is defined as a surface which opposes the first side wall 231 (FIG. 15), and the fourth surface 154 is defined as a surface which opposes the second side wall 232. In the same manner, in the holding member 205A, the fifth surface 155 is defined as a surface which opposes the fourth side wall 234, and the sixth surface 156 is defined as a surface which opposes the third side wall 233. In addition, in the holding member 205B, the third surface 153 is defined as a surface which opposes the third side wall 238 (FIG. 15), and the fourth surface 154 is defined as a surface which opposes the fourth side wall 239. In the same manner, in the holding member 205B, the fifth surface 155 is defined as a surface which opposes the first side wall 236, and the sixth surface 156 is defined as a surface which opposes the second side wall 237. In addition, in the holding member 205C, the third surface 153 is defined as a surface which opposes the third side wall 243 (FIG. 15), and the fourth surface 154 is defined as a surface which opposes the fourth side wall 244. In the same manner, in the holding member 205C, the fifth surface 155 is defined as a surface which opposes the first side wall 241, and the sixth surface 156 is defined as a surface which opposes the second side wall 242.

Here, three concave sections 209 of the third case 201 (FIG. 14) are each configured so as to narrow from the fourth case 202 side toward the −Z axis direction. Then, three holding members 205 are formed to be larger than the concave section 209. For this reason, when the holding member 205 is accommodated inside the concave section 209, the holding member 205 is compressed along the partition wall 218 (FIG. 15). As a result, inside the concave section 209, capillary force of the holding member 205 increases from the fourth case 202 side toward the partition wall 218 side.

Figure 17:
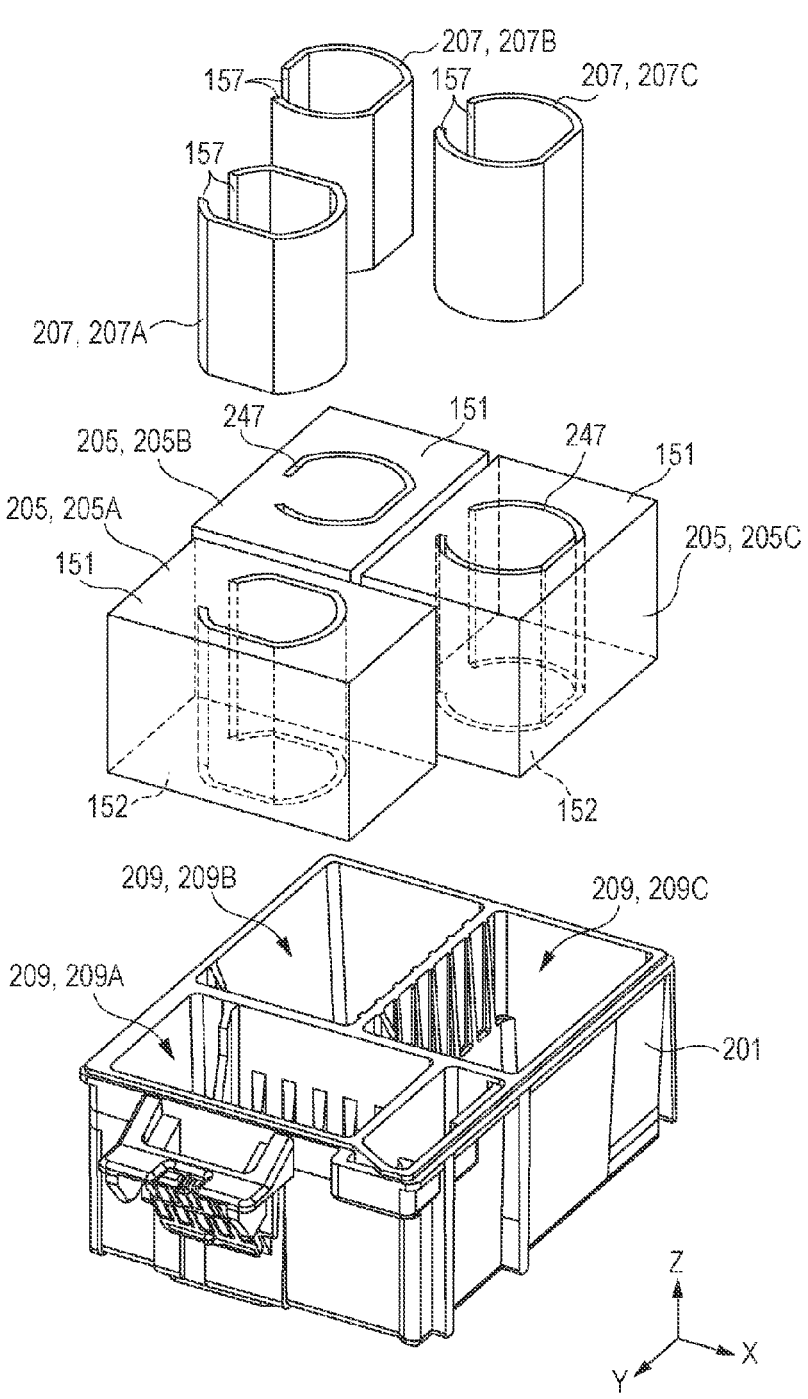
FIG. 17 is an exploded perspective diagram illustrating the third case, the holding member, and the regulating member in the present embodiment.

As shown in FIG. 14, the regulating member 207 is inserted into the holding member 205. As shown in FIG. 17, the regulating member 207 has a pipe form which extends along the Z axis. In the regulating member 207, a portion of a pipe form has a cutout section 157 which is cutout along the Z axis. For this reason, when the regulating member 207 is in planar view in the −Z axis direction, the regulating member 207 has a form in which a portion of an annular form is missing (cut out). Thereby, when the regulating member 207 is in planar view in the −Z axis direction, the regulating member 207 has a C shape. From another viewpoint, the regulating member 207 has an outer appearance of a plate form. The regulating member 207 has a configuration in which the member of a flat form is formed with a curved-surface form. Here, each of the regulating member 93 (FIG. 10) and the regulating member 207 correspond to a first plate-like member.

When the cartridge 5B is in planar view in the −Z axis direction, the regulating member 207 is positioned within a region which overlaps with the holding member 204 (FIG. 14). In the present embodiment, when the cartridge 5B is in planar view in the −Z axis direction, the regulating member 207 is positioned further outside than the supply hole 141 (FIG. 15) of the third case 201. Thereby, the supply hole 141 is positioned inside the annular form of the regulating member 207. However, the position of the regulating member 207 is not limited thereto, and, as long as being further outside than a region which is enclosed by the bank section 78 of the introducing section 49 (FIG. 6), may be positioned further inside than the supply hole 141 (FIG. 15) of the third case 201.

As shown in FIG. 17, a through hole 247 is formed in the holding member 205. The through hole 247 passes through the holding member 205 along the Z axis. The through hole 247 reaches from the first surface 151 of the holding member 205 to the second surface 152. The through hole 247 is formed to correspond to the regulating member 207. For this reason, the through hole 247 has a form in which a portion of an annular form is cut out to correspond to the regulating member 207. Thereby, when the holding member 205 is in planar view in the −Z axis direction, the through hole 247 has a C shape.

When the cartridge 5B is in planar view in the −Z axis direction, the through hole 247 of the holding member 205 is formed within a region which overlaps with the holding member 204 (FIG. 14). In the present embodiment, when the cartridge 5B is in planar view in the −Z axis direction, the through hole 247 of the holding member 205 is formed further outside than the supply hole 141 (FIG. 15) of the third case 201. However, the position of the through hole 247 is not limited thereto, and, as long as being further outside a region which is enclosed by the bank section 78 of the introducing section 49 (FIG. 6), may be positioned further inside than the supply hole 141 (FIG. 15) of the third case 201.

The regulating member 207 is inserted into the through hole 247 of the holding member 205. The regulating member 207 is formed to be bigger than the dimension of the through hole 247. For this reason, when the regulating member 207 is inserted into the through hole 247, the regulating member 207 and the through hole 247 are in a state of being interference fitted (press-fitted) to one another. Thereby, the outer circumference surface of the regulating member 207 and the holding member 205 abut one another, and the inner circumference surface of the regulating member 207 and the holding member 205 abut one another. Then, the regulating member 207 abuts the holding member 204 in a state in which the holding member 204 (FIG. 14) and the holding member 205 are accommodated inside the concave section 209 of the third case 201. Here, the through hole 247 which is formed in the holding member 205 may be a slit into which it is possible to insert the regulating member 207.

Figure 18:
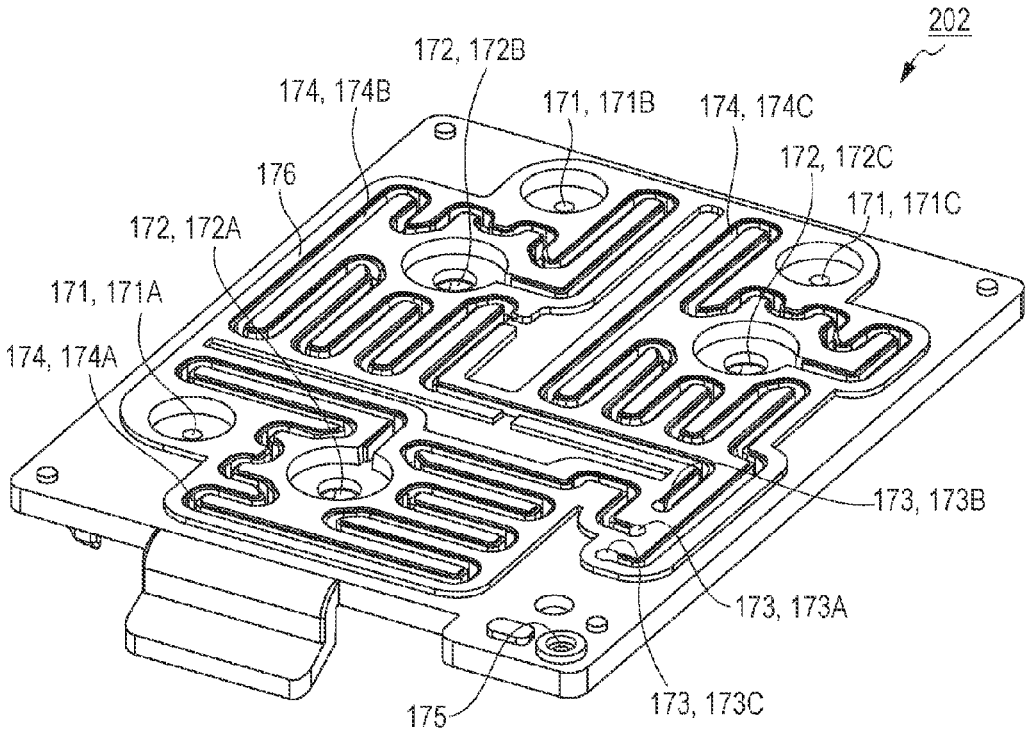
FIG. 18 is a perspective diagram illustrating a fourth case in the present embodiment.

As shown in FIG. 18, the fourth case 202 has a plate form, and has three injection holes 171, three linking holes 172, three relay holes 173, three introduction grooves 174, the introduction hole 175, and a bank section 176. Since the injection holes 171, the linking holes 172, the relay holes 173, the introduction grooves 174, the introduction hole 175, and the bank section 176 have similar functions to the second case 83 of the cartridge 5A, detailed explanation is omitted. The sheet member 203 is joined to the fourth case 202 from the Z axis direction side of the fourth case 202. Since the sheet member 203 also has a similar function to the sheet member 95 of the cartridge 5A, detailed explanation is omitted.

Below, in a case where the three injection holes 171 are each identified, the three injection holes 171 are respectively represented by an injection hole 171A, an injection hole 171B, and an injection hole 171C. In addition, in a case where the three linking holes 172 are each identified, the three linking holes 172 are respectively represented by a linking hole 172A, a linking hole 172B, and a linking hole 172C. In addition, in a case where the three relay holes 173 are each identified, the three relay holes 173 are respectively represented by a relay hole 173A, a relay hole 173B, and a relay hole 173C. In addition, in a case where the three introduction grooves 174 are each identified, the three introduction grooves 174 are respectively represented by an introduction groove 174A, an introduction groove 174B, and an introduction groove 174C.

Also in the cartridge 5B, the injection hole 171A, the linking hole 172A, the relay hole 173A, and the introduction groove 174A correspond to the concave section 209A. In addition, the injection hole 171B, the linking hole 172B, the relay hole 173B, and the introduction groove 174B correspond to the concave section 209B. The injection hole 171C, the linking hole 172C, the relay hole 173C, and the introduction groove 174C correspond to the concave section 209C. Here, one introduction hole 175 is included in the cartridge 5B. Here, the introduction hole 175 communicates with the three relay holes 173 via the concave section 219 (FIG. 15) of the third case 201. For this reason, the three concave sections 209 each communicate with the atmosphere via the one introduction hole 175.

Figure 19:
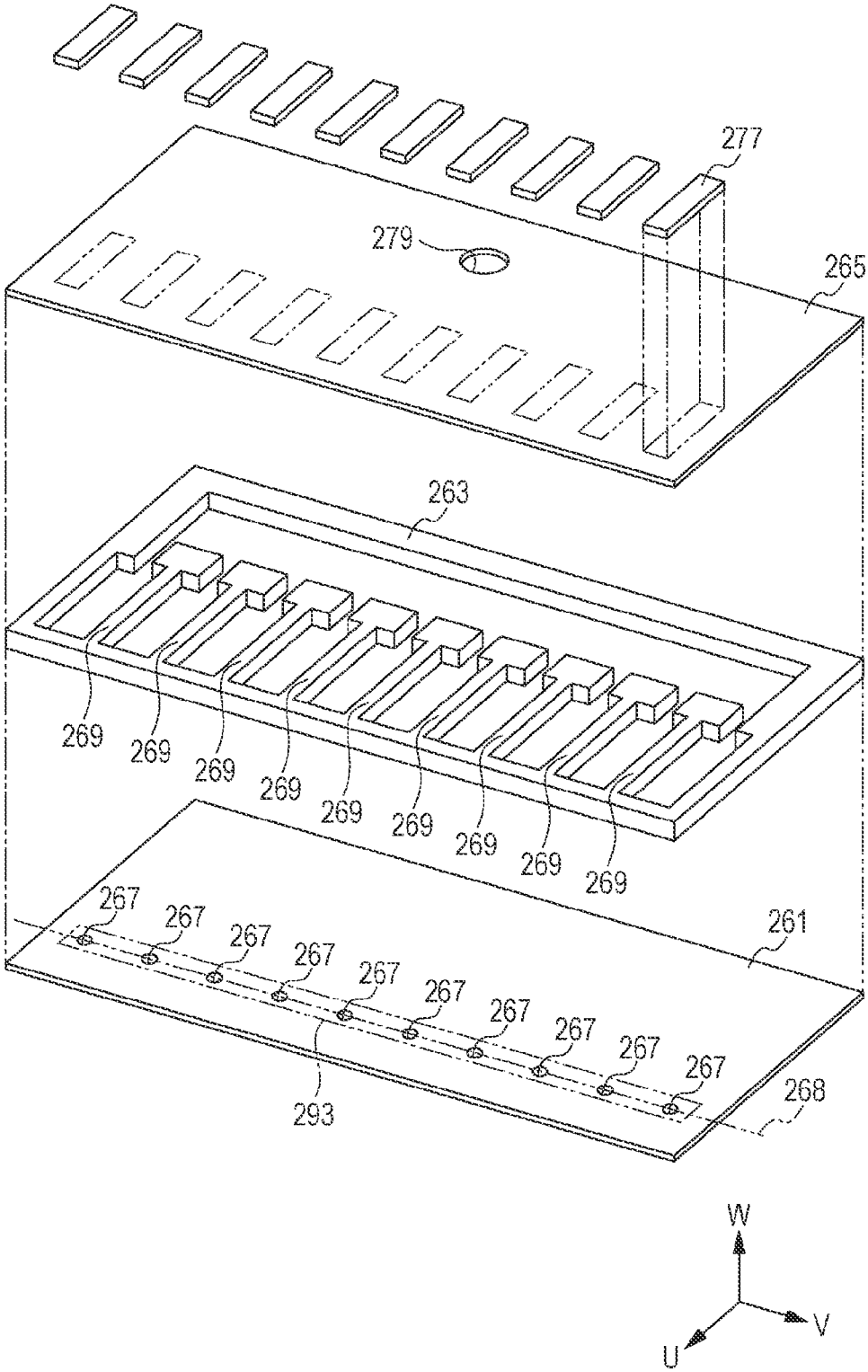
FIG. 19 is an exploded perspective diagram schematically illustrating main components of a printing head in the present embodiment.

Here, the printing head 66 will be described. As shown in FIG. 19, the printing head 66 has a nozzle plate 261, a flow path plate 263, and a vibration plate 265. In FIG. 19, in order to make the configuration easy to understand, the main configuration of the printing head 66 is schematically illustrated in an exploded perspective diagram. U, V, and W axes, which are coordinate axes which are orthogonal to one other, are used in FIG. 19. The U, V, and W axes are also applied as required in the drawings shown hereafter. The W axis direction is a vertically upward direction in the usage state of the printer 3. Then, in FIG. 19, the −W axis direction is a vertically downward direction in the usage state of the printer 3. In the respective U, V, and W axes, orientations of directional arrows show + (positive) directions, and orientations of directional arrows show − (negative) directions which are opposite to the positive directions.

A plurality of nozzles 267 are formed on the nozzle plate 261. The plurality of nozzles 267 are each formed as through holes which pass through the nozzle plate 261 along the W axis. In the printing head 66, ink from each of the nozzles 267 is discharged toward the opposite side to the flow path plate 263 side of the nozzle plate 261, that is, toward the −W axis of the nozzle plate 261. The plurality of nozzles 267 are lined up along the V axis. In the printing head 66, the plurality of nozzles 267 which are lined up along the V axis configure one nozzle row 268 which extends along the V axis. In FIG. 19, in order to make the configuration easy to understand, the number of nozzles 267 is reduced.

Figure 20:
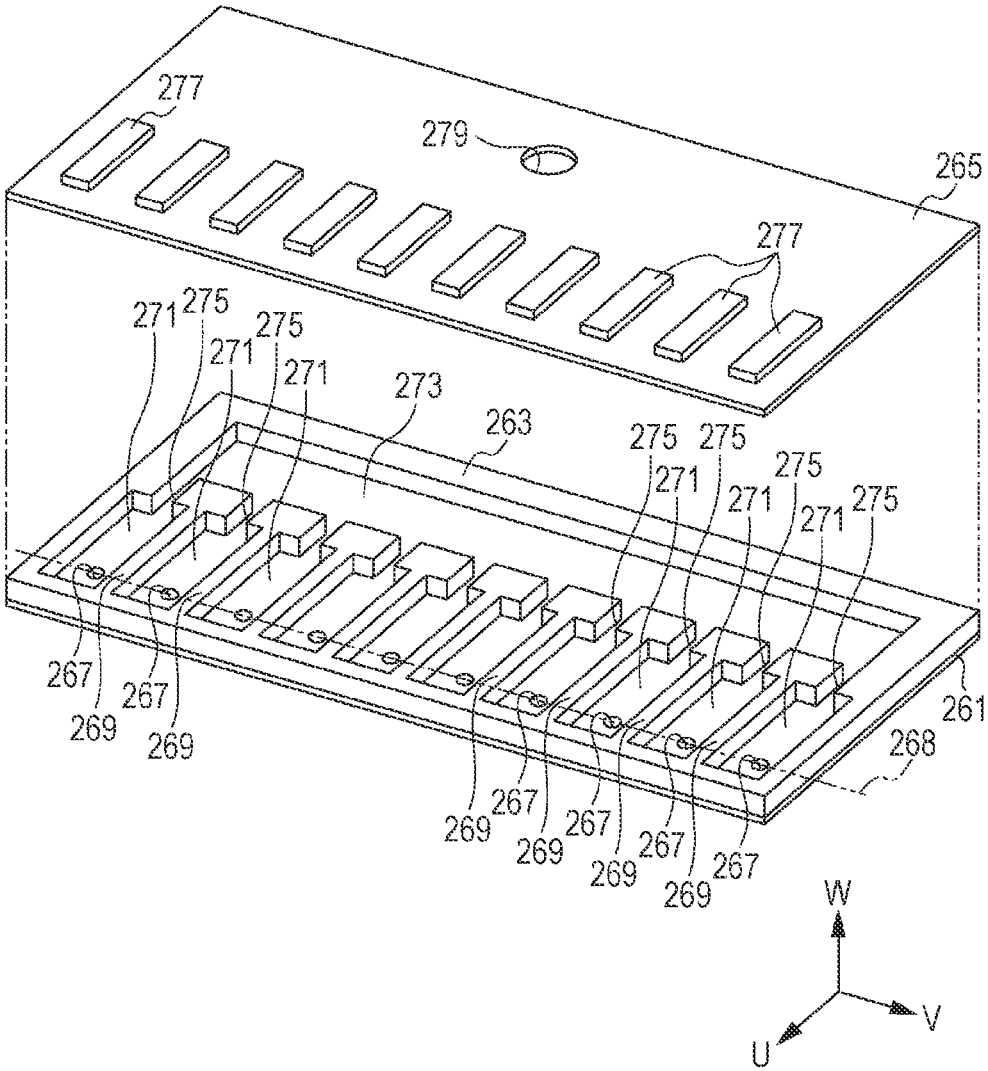
FIG. 20 is an exploded perspective diagram schematically illustrating main components of the printing head in the present embodiment.

The vibration plate 265 is included further in the W axis direction side than the nozzle plate 261. The flow path plate 263 is included between the nozzle plate 261 and the vibration plate 265. The flow path plate 263 is interposed by the nozzle plate 261 and the vibration plate 265. The flow path plate 263 is formed by a plurality of partition wall sections 269. As shown in FIG. 20, the partition wall section 269 is included between two adjacent nozzles 267 along the V axis. The partition wall section 269 partitions the two adjacent nozzles 267 from one another along the V axis. A space which is referred to as a cavity 271 is formed between two adjacent partition wall sections 269 along the V axis. A space which is referred to as a reservoir 273 is formed at the −U axis direction side of the cavity 271. Each cavity 271 passes through the reservoir 273 via a supply path 275.

A plurality of piezoelectric actuators 277 are included on the vibration plate 265. The plurality of piezoelectric actuators 277 are included at the opposite side to the flow path plate 263 of the vibration plate 265, that is, at the W axis direction side of the vibration plate 265. The piezoelectric actuator 277 is included in each cavity 271. When the vibration plate 265 is in planar view in the −W axis direction, the piezoelectric actuator 277 is included in a region which overlaps with the cavity 271.

In addition, a receiving port 279 is formed on the vibration plate 265. The receiving port 279 is formed as a through hole which passes through the vibration plate 265 along the W axis. The receiving port 279 is an opening which receives ink inside the printing head 66. Ink which is supplied from the cartridge 5 flows inside the printing head 66 from receiving port 279. The receiving port 279 communicates with the flow path 77 of the introducing section 49 (FIG. 13). Ink which is accommodated in the cartridge 5 is supplied from the flow path 77 of the introducing section 49 to the reservoir 273 via the receiving port 279 of the printing head 66. Ink which is supplied to the reservoir 273 is delivered to a plurality of cavities 271 due to a plurality of supply paths 275 which are branched.

The plurality of nozzles 267 which configure one nozzle row 268 each communicate with one reservoir 273 via the corresponding cavity 271. Ink which is supplied to one reservoir 273 is delivered to a plurality of cavities 271 which communicate with the reservoir 273. Consequently, ink which is supplied to one reservoir 273 is delivered to a plurality of nozzles 267 which communicate with the reservoir 273.

When the piezoelectric actuator 277 is driven, the area of the cavity 271 is varied via the vibration plate 265. Thereby, it is possible to apply pressure to ink inside the cavity 271. As a result, it is possible to discharge the ink inside the cavity 271 as ink droplets from the nozzle 267. Then, in the printing head 66, it is possible to individually discharge ink droplets from each of the plurality of nozzles 267 by individually driving the plurality of piezoelectric actuators 277.

Here, in the present embodiment, in a printing operation, ink droplets are discharged from at least a portion of the plurality of nozzles 267 out of the plurality of nozzles 267 which configure one nozzle row 268. Below, there are times when discharging ink droplets from the nozzle 267 is expressed using the nozzle 267. That is, in the present embodiment, in a printing operation, the nozzles 267 of at least a portion of the plurality of nozzles 267 which configure one nozzle row 268 are used. That is, in the printing operation, it is significant that there are nozzles 267 out of the plurality of nozzles 267 which configure the nozzle row 268 which are not used. That is, in the present embodiment, in the printing operation, there are times when all of the nozzles 267 out of the plurality of nozzles 267 which configure the nozzle row 268 are used, and there are also times when only nozzles 267 of a portion out of the plurality of nozzles 267 which configure the nozzle row 268 are used.

Figure 21:
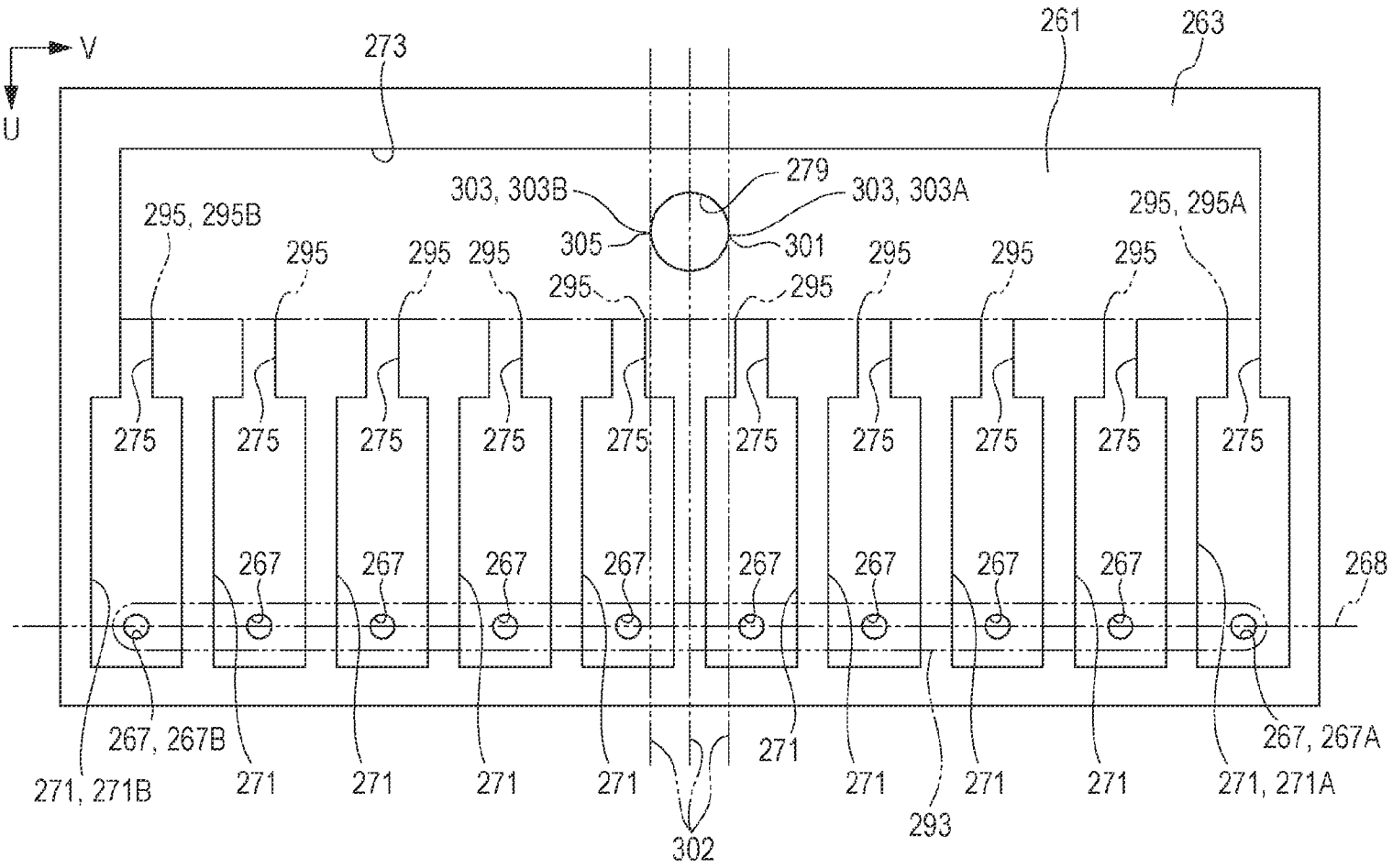
FIG. 21 is a planar diagram illustrating a nozzle plate and a flow path plate in the present embodiment.

Below, the plurality of nozzles 267 which are used in printing out of the plurality of nozzles 267 which configure one nozzle row 268 are expressed as a printing nozzle group 293. Here, for convenience of explanation, it is assumed that the plurality of nozzles 267 which configure the nozzle row 268 shown in FIG. 19 configure the printing nozzle group 293. In addition, in the present embodiment, as shown in FIG. 21, a boundary between the reservoir 273 and each supply path 275 is defined as a boundary section 295. Here, the boundary section 295 corresponds to a liquid supply port. It is also possible to express the boundary section 295 as an inlet from the reservoir 273 to the supply path 275. Here, in FIG. 21, the receiving port 279 is projected in a planar diagram when the nozzle plate 261 and the flow path plate 263 are in planar view in the −W axis direction.

Here, the nozzle 267 which is positioned at one end side out of the plurality of nozzles 267 which configure the nozzle row 268 is a first nozzle 267A. In addition, the nozzle 267 which is positioned at the other end side out of the plurality of nozzles 267 which configure the nozzle row 268 is a second nozzle 267B. Then, as shown in FIG. 21, a first portion 301 of the receiving port 279 has a contact point 303A which is close to the first nozzle 267A out of contact points 303 of an axis 302 which is orthogonal to the V axis along the extension direction of the nozzle row 268 and the receiving port 279. From another viewpoint, the first portion 301 is the contact point 303A which is close to a first boundary section 295A which is a boundary section 295 which corresponds to the first nozzle 267A out of contact points 303. Here, the axis 302 extends along the U axis. A contact point 303B which is far from the first nozzle 267A out of the contact points 303 is a second portion 305 of the receiving port 279. It is also possible to define the second portion 305 as the contact point 303B which is close to the second nozzle 267B out of the contact points 303 between the axis 302 which is orthogonal to the V axis along the extension direction of the nozzle row 268 and the receiving port 279. From another viewpoint, the second portion 305 is the contact point 303B which is close to a second boundary section 295B which is the boundary section 295 which corresponds to the second nozzle 267B out of contact points 303.

Figure 22:
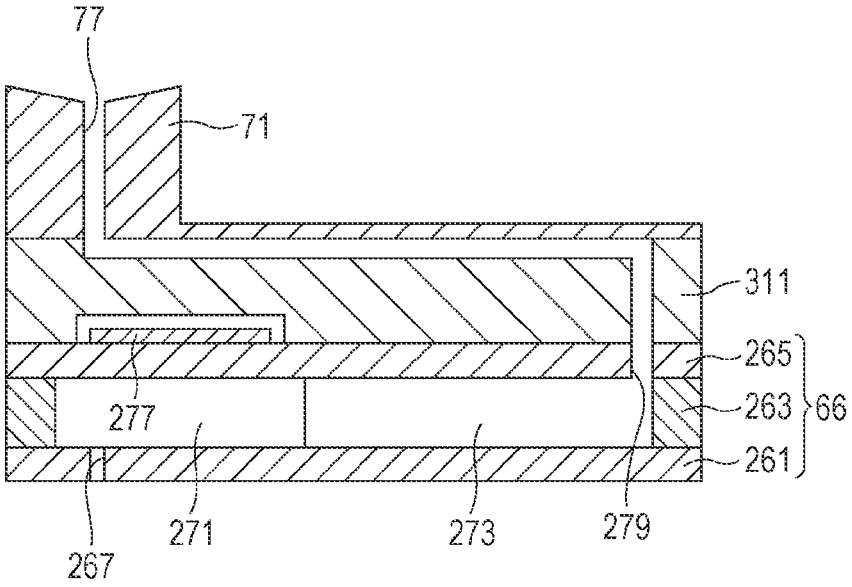
FIG. 22 is a diagram schematically illustrating a path of ink from an introduction pipe to a nozzle in the present embodiment.

Ink flow from the cartridge 5 to the nozzle 267 will be described with reference to FIG. 22. An ink flow path from the introduction pipe 71, which is included in the holder 31 of the carriage unit 25, to the nozzle 267 of the printing head 66 is schematically illustrated in FIG. 22. Ink inside the cartridge 5 is supplied to the flow path 77 of the introduction pipe 71 via the supply hole 141. Ink which is supplied to the flow path 77 is supplied to the introduction flow path 313 which is included on an introduction plate 311.

Here, the introduction plate 311 is included between the printing head 66 and the holder 31. The printing head 66, the introduction plate 311, and the holder 31 configure a head unit. In addition, the printing head 66 and the introduction plate 311 configure a head section. The nozzle plate 261 of the printing head 66 is equivalent to a first layer of the head section. In addition, the introduction plate 311 and the vibration plate 265 of the printing head 66 are equivalent to a second layer of the head section. Then, the flow path plate 263 of the printing head 66 is equivalent to a third layer of the head section. The third layer is positioned between the first layer and the second layer.

Ink which is supplied to the introduction flow path 313 on the introduction plate 311 is supplied to the reservoir 273 via the receiving port 279. Ink which is supplied to the reservoir 273 is supplied to the nozzle 267 via the cavity 271.

Figure 23:
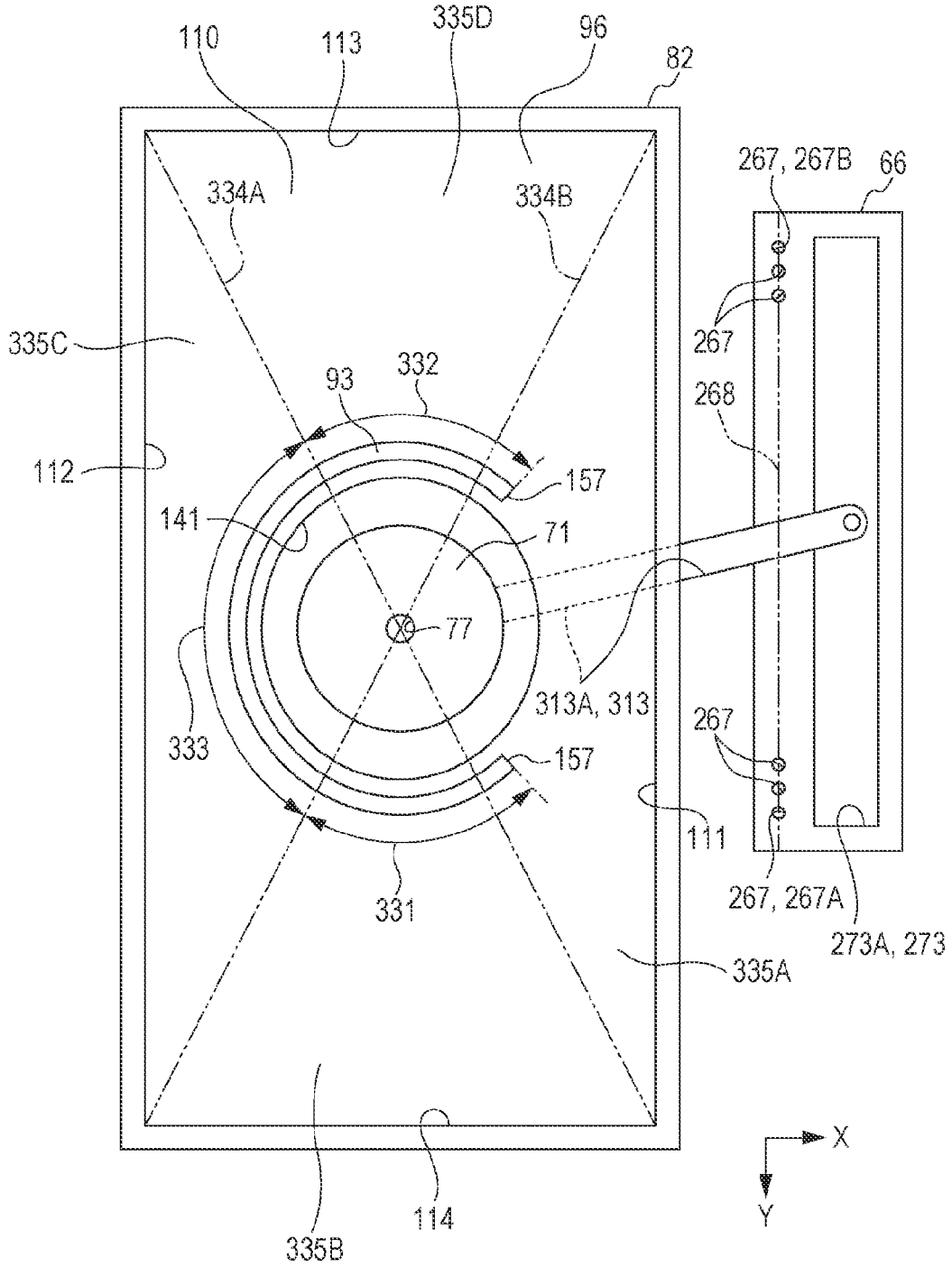
FIG. 23 is a planar diagram schematically illustrating the cartridge, the introduction flow path, and a reservoir in the present embodiment.

The orientation of the cutout section 157 of the regulating member 93 in the cartridge 5A will be described. FIG. 23 is a planar diagram schematically illustrating the cartridge 5A, the introduction flow path 313, and the reservoir 273. The cartridge 5A, the introduction flow path 313, and the reservoir 273 are indicated in FIG. 23 in a state in planar view in the −Z axis direction. Below, the introduction flow path 313 and the reservoir 273 which communicate with the cartridge 5A are respectively represented by an introduction flow path 313A and a reservoir 273A. In the cartridge 5A, the regulating member is divided into a first partition wall 331, a second partition wall 332, and a third partition wall 333. The first partition wall 331, the second partition wall 332, and the third partition wall 333 are respectively divided by a diagonal line 334A and a diagonal line 334B. The diagonal line 334A is a linking line for an intersection point between the second side wall 112 and the third side wall 113 and an intersection point between the first side wall 111 and the fourth side wall 114 which configure the side walls of the concave section 96. The diagonal line 334B is a linking line for an intersection point between the first side wall 111 and the third side wall 113 and an intersection point between the second side wall 112 and the fourth side wall 114 which configure the side walls of the concave section 96.

A region (bottom wall 110) which is surrounded by the first side wall 111, the second side wall 112, the third side wall 113, and the fourth side wall 114 is divided into four regions by the diagonal line 334A and the diagonal line 334B. Out of the four regions, a region which is surrounded by the first side wall 111, the diagonal line 334A, and the diagonal line 334B is set as a first region 335A. Out of the four regions, a region which is surrounded by the fourth side wall 114, the diagonal line 334A, and the diagonal line 334B is set as a second region 335B. Out of the four regions, a region which is surrounded by the second side wall 112, the diagonal line 334A, and the diagonal line 334B is set as a third region 335C. Out of the four regions, a region which is surrounded by the third side wall 113, the diagonal line 334A, and the diagonal line 334B is set as a fourth region 335D.

In the regulating member 93, the cutout section 157 is formed in a portion which overlaps with the first region 335A. The cutout section 157 is formed at a side which is opposite to the first side wall 111 of the regulating member 93. A region of the regulating member 93 which overlaps with the first region 335A and the second region 335B is the first partition wall 331. The first partition wall 331 is positioned between the supply hole 141 and the fourth side wall 114. In the cartridge 5A, the fourth side wall 114 corresponds to a second surface. A region of the regulating member 93 which overlaps with the first region 335A and the fourth region 335D is the second partition wall 332. The second partition wall 332 is positioned between the supply hole 141 and the third side wall 113. In the cartridge 5A, the third side wall 113 corresponds to a third surface. A region of the regulating member 93 which overlaps with the third region 335C is the third partition wall 333. The third partition wall 333 is positioned between the supply hole 141 and the second side wall 112. In the cartridge 5A, the second side wall 112 corresponds to a fourth surface.

The receiving port 279 of the reservoir 273A to which ink is supplied from the cartridge 5A is positioned further in the X axis direction side than the flow path 77 of the introduction pipe 71, and is positioned further in the −Y axis direction side than the flow path 77. In addition, the reservoir 273A has a long and narrow form along the Y axis. Then, the nozzle row 268 which communicates with the reservoir 273A extends along the Y axis. The introduction flow path 313A reaches from a position which overlaps with the flow path 77 to a position which overlaps with the receiving port 279 by communicating with a region which overlaps with the first region 335A. The introduction flow path 313A is inclined with respect to the X axis. The introduction flow path 313A comes close to the reservoir 273A in the X axis direction and is inclined with an orientation toward the −Y axis direction. The introduction flow path 313A which communicates with the cartridge 5A reaches the reservoir 273A by communicating with the region of the cutout section 157 which is formed in the regulating member 93. For this reason, the introduction flow path 313A does not intersect with the regulating member 93.

Here, ink flow of the cartridge 5 that does not include the regulating member 93 will be described. Below, the cartridge 5 that does not include the regulating member 93 is represented by a cartridge 5Z. In the cartridge 5Z, the through hole 159 is not formed in the holding member 91 (FIG. 10). Except for this, the cartridge 5Z has the same configuration as the cartridge 5A. When the cartridge 5 is left in a state of being stationary, pigment components are precipitated inside the cartridge 5. When pigment components are precipitated inside the cartridge 5, the concentration of the pigment of ink which is positioned at the bottom wall 110 side out of the ink which is inside the cartridge 5 is higher than the concentration of the pigment of ink which is positioned at the second case 83 side.

Figure 24:
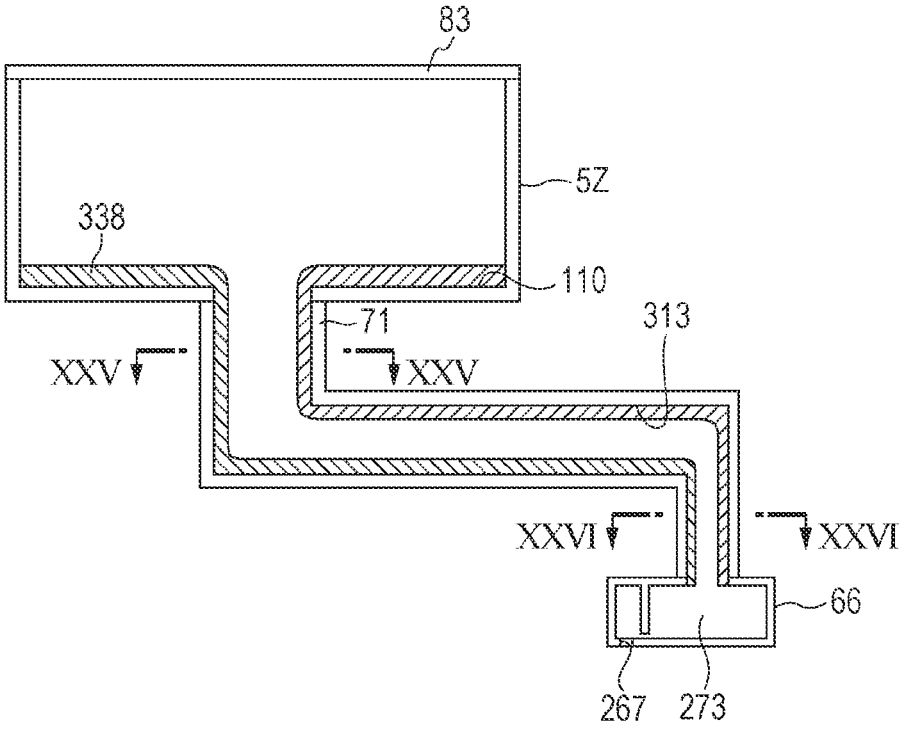
FIG. 24 is a diagram schematically illustrating a sectional surface where the cartridge and the introduction pipe are cut away along the Z axis in a related art technique.

When the concentration of the pigment of ink inside the cartridge 5Z is classified into two types, as shown in FIG. 24, ink with a high concentration of pigment is represented by a first ink 338, and ink with a low concentration of pigment is represented by a second ink 339. FIG. 24 schematically illustrates a sectional surface when the cartridge 5Z and the introduction pipe 71 are cut away along the Z axis. In the cartridge 5Z, the first ink 338 is positioned at the bottom wall 110 side, and the second ink 339 is positioned further in the second case 83 side than the first ink 338. When ink is supplied from the cartridge 5 to the introduction pipe 71, the first ink 338 which is positioned at the bottom wall 110 side flows inside the introduction pipe 71 along the inner wall of the introduction pipe 71. At this time, the second ink 339 flows further into the region inside the introduction pipe 71 than the first ink 338.

Figure 25:
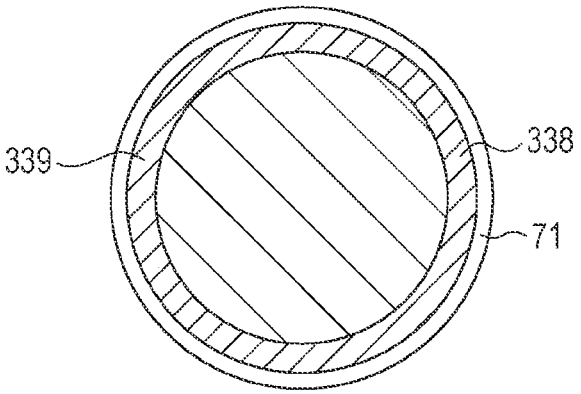
FIG. 25 is a sectional diagram along line XXV-XXV in FIG. 24.

That is, as shown in FIG. 25 which is a sectional diagram along line XXV-XXV in FIG. 24, in the introduction pipe 71 which is connected to the cartridge 5Z, a layer of a first ink 338 which flows in an annular form along an inner wall of the introduction pipe 71, and a layer of a second ink 339 which flows inside the first ink 338 that flows in an annular form coexist. The phenomenon is considered to be caused by ink flow becoming laminar flow from the cartridge 5 to the reservoir 273. Consequently, a state, in which the first ink 338 which flows in an annular form and the second ink 339 which flows inside the first ink 338 that flows is an annular form coexist, is maintained from the introduction pipe 71 to the receiving port 279 via the introduction flow path 313.

Figure 26:
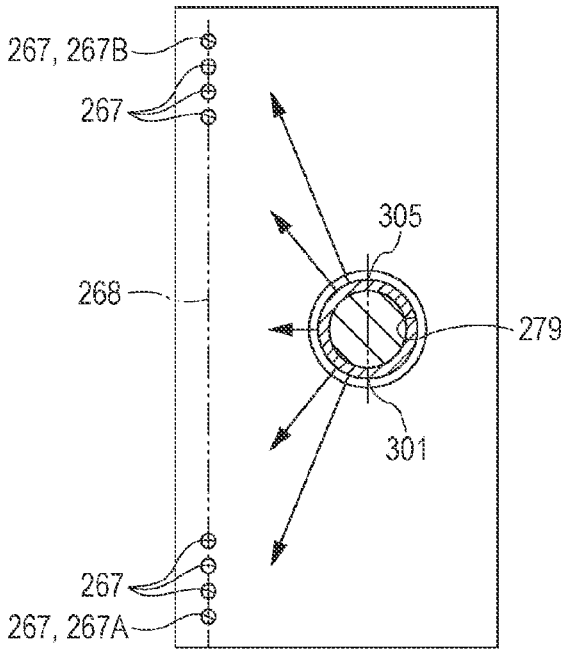
FIG. 26 is a sectional diagram along line XXVI-XXVI in FIG. 24.

Then, as shown in FIG. 26 which is a sectional diagram along line XXVI-XXVI in FIG. 24, ink which reaches the receiving port 279 spreads out from the receiving port 279 inside the reservoir 273. Also when ink spreads out inside the reservoir 273, it is difficult for the first ink 338 and the second ink 339 to be diffused since it is easy for ink flow to become laminar flow. For this reason, also inside the reservoir 273, the concentration difference between the first ink 338 and the second ink 339 is easy to maintain. In a case where ink which is supplied from the cartridge 5Z to the reservoir 273A, out of the first ink 338 and the second ink 339, it is easy to supply only the first ink 338 to the first portion 301 and the second portion 305 of the receiving port 279.

Ink which is supplied to the first portion 301 spreads out toward the first nozzle 267A side inside the reservoir 273. Meanwhile, ink which is supplied to the second portion 305 spreads out toward the second nozzle 267B side inside the reservoir 273. For this reason, in a case where ink which is supplied from the cartridge 5Z to the reservoir 273A, out of the first ink 338 and the second ink 339, it is easy to supply only the first ink 338 to the first nozzle 267A and the second nozzle 267B. Thereby, it is easy to eject only ink with a large content of pigment from the nozzle 267 which is positioned in the end section of the nozzle row 268. As a result, the effect of uneven printing becomes large since it becomes easy for the concentration of ink which is ejected from the plurality of nozzles 267 which configure the one nozzle row 268 to vary among the plurality of nozzles 267.

Therefore, in the present embodiment, a flow path regulating mechanism which is able to supply the second ink 339 is included in both the first nozzle 267A and the second nozzle 267B. It is possible to supply at least the second ink 339 to both the first nozzle 267A and the second nozzle 267B using the flow path regulating mechanism. In addition, it may be possible to supply not only the first ink 338, but also the second ink 339. That is, in the present embodiment, at least the second ink 339 is supplied to both the first nozzle 267A and the second nozzle 267B. Here, it may be possible to supply both the first ink 338 and the second ink 339. Here, in the present embodiment, the regulating member 93 is adopted in the cartridge 5A, and the regulating member 207 is adopted in the cartridge 5B as aspects of the flow path regulating mechanism.

Figure 27:
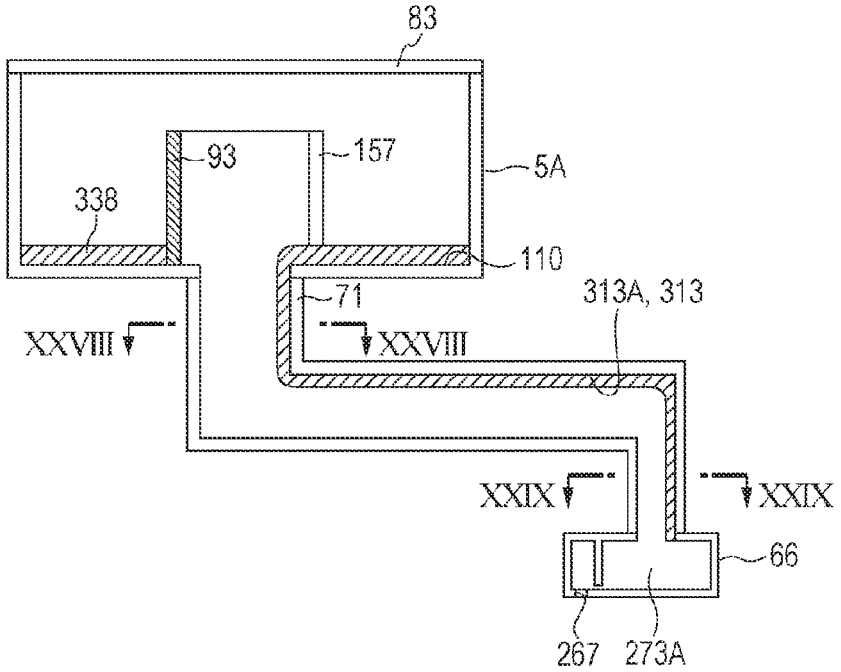
FIG. 27 is a diagram schematically illustrating a sectional surface where the cartridge and the introduction pipe are cut away along the Z axis in the present embodiment.
Figure 28:
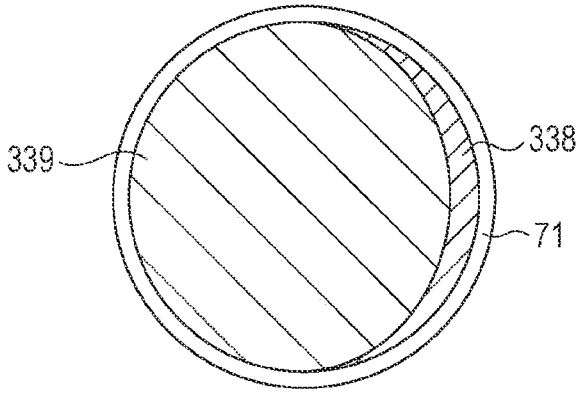
FIG. 28 is a sectional diagram along line XXVIII-XXVIII in FIG. 27.

As shown in FIG. 27, in the cartridge 5A, since the regulating member 93 is positioned further to the outside than the supply hole 141, the first ink 338 is obstructed from flowing inside the introduction pipe 71 from the supply hole 141 due to the first ink 338 being dammed by the regulating member 93. Since the cutout section 157 is formed in the regulating member 93, the first ink 338 flows inside the introduction pipe 71 via the cutout section 157. For this reason, as shown in FIG. 28 which is a sectional diagram along line XXVIII-XXVIII in FIG. 27, the first ink 338 flows in along a part which branches into the cutout section 157 of the regulating member 93 out of the inner wall of the introduction pipe 71. The second ink 339 flows in a part which branches into a contour section of the regulating member 93, and inflow of the first ink 338 is obstructed.

That is, in the cartridge 5A, a layer of the first ink 338 with an annular form is cut out in the cartridge 5Z by the regulating member 93. Below, a state in which an annular form layer is cut out is expressed is a non-annular state. Thereby, in the introduction pipe 71 which is connected to the cartridge 5A, a layer of a first ink 338 which flows in a non-annular form along a portion of an inner wall of the introduction pipe 71, and a layer of a second ink 339 which overlaps with the layer of the first ink 338 coexist. Then, the state is maintained from the introduction pipe 71 to the receiving port 279 via the introduction flow path 313A.

Figure 29:
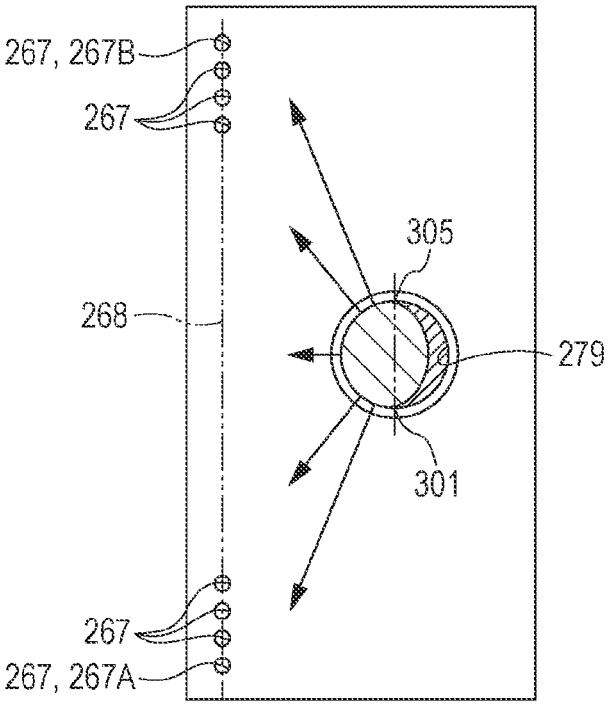
FIG. 29 is a sectional diagram along line XXIX-XXIX in FIG. 27.

As shown in FIG. 29 which is a sectional diagram along line XXIX-XXIX in FIG. 27, ink which reaches the receiving port 279 spreads out from the receiving port 279 inside the reservoir 273A. As described above, also inside the reservoir 273A, the concentration difference between the first ink 338 and the second ink 339 is easy to maintain. However, since the layer of the first ink 338 has a non-annular form, at least the second ink 339 is supplied to the first portion 301 and the second portion 305 of the receiving port 279. In addition, it is considered easy to supply both of the first ink 338 and the second ink 339 to the first portion 301 and the second portion 305. For this reason, in a case where ink is supplied from the cartridge 5A to the reservoir 273A, at least the second ink 339 is supplied to the first nozzle 267A and the second nozzle 267B. In addition, it is considered easy to supply both of the first ink 338 and the second ink 339 to the first nozzle 267A and the second nozzle 267B. Thereby, it is possible to suppress a state in which only ink with a large content of pigment is ejected from the nozzle 267 which is positioned in the end section of the nozzle row 268. As a result, the effect of uneven printing is suppressed to be low since the concentration of ink which is ejected from the plurality of nozzles 267 which configure the one nozzle row 268 becomes close among the plurality of nozzles 267. Here, the action of the regulating member 93 of the cartridge 5A is the same as the action of the regulating member 207 in the cartridge 5B.

Figure 30:
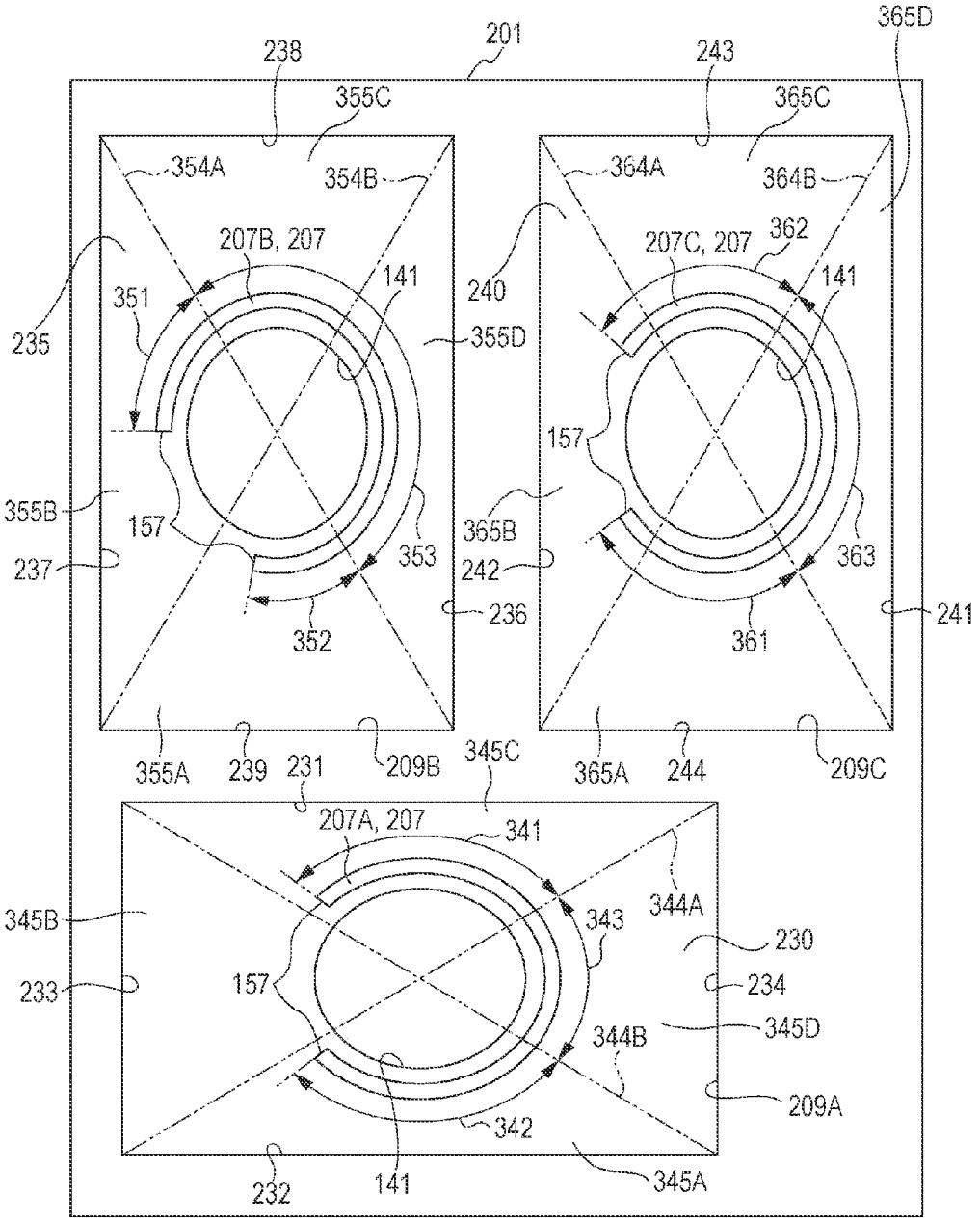
FIG. 30 is a planar diagram schematically illustrating the third case and the regulating member in the present embodiment.

The orientation of the cutout section 157 of the regulating member 207 in the cartridge 5B will be described. As described above, three concave sections 209 are included in the cartridge 5B. The orientation of the cutout section 157 of the regulating member 207 in the cartridge 5B will be described in each concave section 209. As shown in FIG. 30, the regulating member 207A in the concave section 209A is divided into a first partition wall 341, a second partition wall 342, and a third partition wall 343. The first partition wall 341, the second partition wall 342, and the third partition wall 343 are respectively divided by a diagonal line 344A and a diagonal line 344B.

The diagonal line 344A is a linking line for an intersection point between the first side wall 231 and the fourth side wall 234 and an intersection point between the second side wall 232 and the third side wall 233 which configure the side walls of the concave section 209A. The diagonal line 344B is a linking line for an intersection point between the first side wall 231 and the third side wall 233 and an intersection point between the second side wall 232 and the fourth side wall 234 which configure the side walls of the concave section 209A. A region (bottom wall 230) which is surrounded by the first side wall 231, the second side wall 232, the third side wall 233, and the fourth side wall 234 is divided into four regions by the diagonal line 344A and the diagonal line 344B.

Out of the four regions, a region which is surrounded by the second side wall 232, the diagonal line 344A, and the diagonal line 344B is set as a first region 345A. Out of the four regions, a region which is surrounded by the third side wall 233, the diagonal line 344A, and the diagonal line 344B is set as a second region 345B. Out of the four regions, a region which is surrounded by the first side wall 231, the diagonal line 344A, and the diagonal line 344B is set as a third region 345C. Out of the four regions, a region which is surrounded by the fourth side wall 234, the diagonal line 344A, and the diagonal line 344B is set as a fourth region 345D.

In the regulating member 207A, the cutout section 157 is formed in a portion which overlaps with the second region 335B. The cutout section 157 spans the first region 335A, the second region 335B, and the third region 335C. The cutout section 157 is formed at a side which is opposite to the third side wall 233 out of the regulating member 207A. A region of the regulating member 207A which overlaps with the third region 345C is the first partition wall 341. The first partition wall 341 is positioned between the supply hole 141 and the first side wall 231. In the concave section 209A, the first side wall 231 corresponds to a second surface. A region of the regulating member 207A which overlaps with the first region 345A is the second partition wall 342. The second partition wall 342 is positioned between the supply hole 141 and the second side wall 232. In the concave section 209A, the second side wall 232 corresponds to a third surface. A region of the regulating member 207A which overlaps with the fourth region 345D is the third partition wall 343. The third partition wall 343 is positioned between the supply hole 141 and the fourth side wall 234. In the concave section 209A, the fourth side wall 234 corresponds to a fourth surface.

The regulating member 207B in the concave section 209B is divided into a first partition wall 351, a second partition wall 352, and a third partition wall 353. The first partition wall 351, the second partition wall 352, and the third partition wall 353 are respectively divided by a diagonal line 354A and a diagonal line 354B. The diagonal line 354A is a linking line for an intersection point between the second side wall 237 and the third side wall 238 and an intersection point between the first side wall 236 and the fourth side wall 239 which configure the side walls of the concave section 209B. The diagonal line 354B is a linking line for an intersection point between the first side wall 236 and the third side wall 238 and an intersection point between the second side wall 237 and the fourth side wall 239 which configure the side walls of the concave section 209B. A region (bottom wall 235) which is surrounded by the first side wall 236, the second side wall 237, the third side wall 238, and the fourth side wall 239 is divided into four regions by the diagonal line 354A and the diagonal line 354B.

Out of the four regions, a region which is surrounded by the fourth side wall 239, the diagonal line 354A, and the diagonal line 354B is set as a first region 355A. Out of the four regions, a region which is surrounded by the second side wall 237, the diagonal line 354A, and the diagonal line 354B is set as a second region 355B. Out of the four regions, a region which is surrounded by the third side wall 238, the diagonal line 354A, and the diagonal line 354B is set as a third region 355C. Out of the four regions, a region which is surrounded by the first side wall 236, the diagonal line 354A, and the diagonal line 354B is set as a fourth region 355D.

In the regulating member 207B, the cutout section 157 is formed in a portion which overlaps with the first region 355A and the second region 355B. The cutout section 157 is formed at a side which is opposite to the second side wall 237 out of the regulating member 207B. A region of the regulating member 207B which overlaps with the second region 355B is the first partition wall 351. The first partition wall 351 is positioned between the supply hole 141 and the second side wall 237. In the concave section 209B, the second side wall 237 corresponds to a second surface. A region of the regulating member 207B which overlaps with the first region 355A is the second partition wall 352. The second partition wall 352 is positioned between the supply hole 141 and the fourth side wall 239. In the concave section 209B, the fourth side wall 239 corresponds to a third surface. A region of the regulating member 207B which overlaps with the third region 355C and the fourth region 355D is the third partition wall 353. The third partition wall 353 is a portion which aligns a part which is positioned between the supply hole 141 and the third side wall 238 and a part which is positioned between the supply hole 141 and the first side wall 236.

The regulating member 207C in the concave section 209C is divided into a first partition wall 361, a second partition wall 362, and a third partition wall 363. The first partition wall 361, the second partition wall 362, and the third partition wall 363 are respectively divided by a diagonal line 364A and a diagonal line 364B. The diagonal line 364A is a linking line for an intersection point between the second side wall 242 and the third side wall 243 and an intersection point between the first side wall 241 and the fourth side wall 244 which configure the side walls of the concave section 209C. The diagonal line 364B is a linking line for an intersection point between the first side wall 241 and the third side wall 243 and an intersection point between the second side wall 242 and the fourth side wall 244 which configure the side walls of the concave section 209C. A region (bottom wall 240) which is surrounded by the first side wall 241, the second side wall 242, the third side wall 243, and the fourth side wall 244 is divided into four regions by the diagonal line 364A and the diagonal line 364B.

Out of the four regions, a region which is surrounded by the fourth side wall 244, the diagonal line 364A, and the diagonal line 364B is set as a first region 365A. Out of the four regions, a region which is surrounded by the second side wall 242, the diagonal line 364A, and the diagonal line 364B is set as a second region 365B. Out of the four regions, a region which is surrounded by the third side wall 243, the diagonal line 364A, and the diagonal line 364B is set as a third region 365C. Out of the four regions, a region which is surrounded by the first side wall 241, the diagonal line 364A, and the diagonal line 364B is set as a fourth region 365D.

In the regulating member 207C, the cutout section 157 is formed in a portion which overlaps with the second region 365B. The cutout section 157 is formed at a side which is opposite to the second side wall 242 out of the regulating member 207C. A region of the regulating member 207C which overlaps with the first region 365A and the second region 365B is the first partition wall 361. The first partition wall 361 is positioned between the supply hole 141 and the fourth side wall 244. In the concave section 209C, the fourth side wall 244 corresponds to a second surface. A region of the regulating member 207C which overlaps with the second region 365B and the third region 365C is the second partition wall 362. The second partition wall 362 is positioned between the supply hole 141 and the third side wall 243. In the concave section 209C, the third side wall 243 corresponds to a third surface. A region of the regulating member 207C which overlaps with the fourth region 365D is the third partition wall 363. The third partition wall 363 is positioned between the supply hole 141 and the first side wall 241. In the concave section 209C, the first side wall 241 corresponds to a fourth surface.

Figure 31:
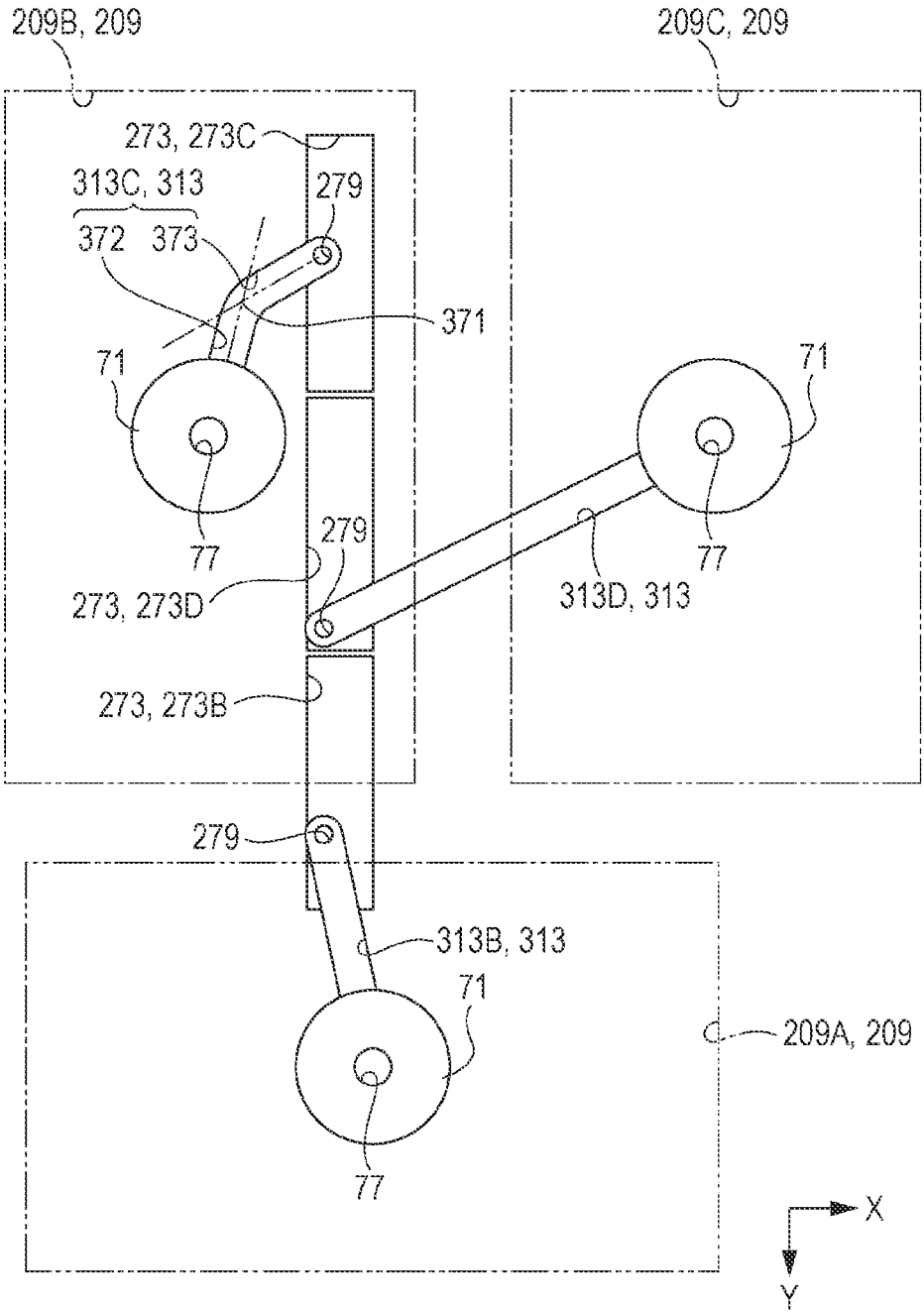
FIG. 31 is a planar diagram schematically illustrating the cartridge, the introduction flow path, and the reservoir in the present embodiment.

FIG. 31 is a planar diagram schematically illustrating the introduction flow path 313 which is connected to the concave section 209, and the reservoir 273. The introduction flow path 313 and the reservoir 273 are indicated in FIG. 31 in a state in planar view in the −Z axis direction. In addition, FIG. 31 indicates the positions of the three concave sections 209. The introduction flow path 313 and the reservoir 273 are respectively included in each concave section 209. Below, the introduction flow path 313 and the reservoir 273 which communicate with the concave section 209A are respectively represented by an introduction flow path 313B and a reservoir 273B. The introduction flow path 313 and the reservoir 273 which communicate with the concave section 209B are respectively represented by an introduction flow path 313C and a reservoir 273C. The introduction flow path 313 and the reservoir 273 which communicate with the concave section 209C are respectively represented by an introduction flow path 313D and a reservoir 273D.

A reservoir B, a reservoir C, and a reservoir D each have a long and narrow form along the Y axis. The reservoir B, the reservoir C, and the reservoir D are each lined up along the Y axis. The reservoir C is positioned further in the −Y axis direction than the reservoir B. The reservoir D is positioned further in the Y axis direction than the reservoir C. The reservoir B is positioned further in the Y axis direction than the reservoir D. That is, in the present embodiment, the reservoir C, the reservoir D, and the reservoir B are lined up in order in the Y axis direction. In addition, the nozzle row 268 extends along the Y axis in each of the reservoir B, the reservoir C, and the reservoir D. That is, the nozzle row 268 which communicates with the reservoir B extends along the Y axis, the nozzle row 268 which communicates with the reservoir C extends along the Y axis, and the nozzle row 268 which communicates with the reservoir D extends along the Y axis.

The receiving port 279 of the reservoir 273B to which ink is supplied from the concave section 209A is positioned further in the −X axis direction side than the flow path 77 of the introduction pipe 71, and is positioned further in the −Y axis direction side than the flow path 77 in planar view. The introduction flow path 313B is inclined with respect to the Y axis. The introduction flow path 313B comes close to the receiving port 279 of the reservoir 273B in the −Y axis direction, and is inclined with an orientation toward the −X axis direction.

The receiving port 279 of the reservoir 273C to which ink is supplied from the concave section 209B is positioned inside a region which overlaps with the concave section 209B in planar view. The receiving port 279 of the reservoir 273C is positioned further in the X axis direction side than the flow path 77 of the introduction pipe 71, and is positioned further in the −Y axis direction side than the flow path 77 in planar view.

The introduction flow path 313C has a bent section 371. The bent section 371 is positioned inside a region which overlaps with the third region 355C. The introduction flow path 313C is bent at the bent section 371. A portion of the introduction flow path 313C from a portion which overlaps with the flow path 77 of the introduction pipe 71 to the bent section 371 is represented as a first flow path section 372. In addition, a portion of the introduction flow path 313C between from the bent section 371 to a position which overlaps with the receiving port 279 of the reservoir 273C is represented as a second flow path section 373.

The first flow path section 372 is inclined with respect to the Y axis. The first flow path section 372 comes close to the receiving port 279 of the reservoir 273C in the −Y axis direction from a position which overlaps with the flow path 77 of the introduction pipe 71 and is inclined with an orientation toward the X axis direction. In addition, the second flow path section 373 is also inclined with respect to the Y axis. The second flow path section 373 comes close to the receiving port 279 of the reservoir 273C in the −Y axis direction from the bent section 371, and is inclined with an orientation toward the X axis direction.

The receiving port 279 of the reservoir 273D to which ink is supplied from the concave section 209C is positioned further in the −X axis direction side than the flow path 77 of the introduction pipe 71, and is positioned further in the Y axis direction side than the flow path 77 in planar view. The introduction flow path 313D is inclined with respect to the X axis. The introduction flow path 313D comes close to the receiving port 279 of the reservoir 273D in the −X axis direction, and is inclined with an orientation toward the Y axis direction.

Figure 32:
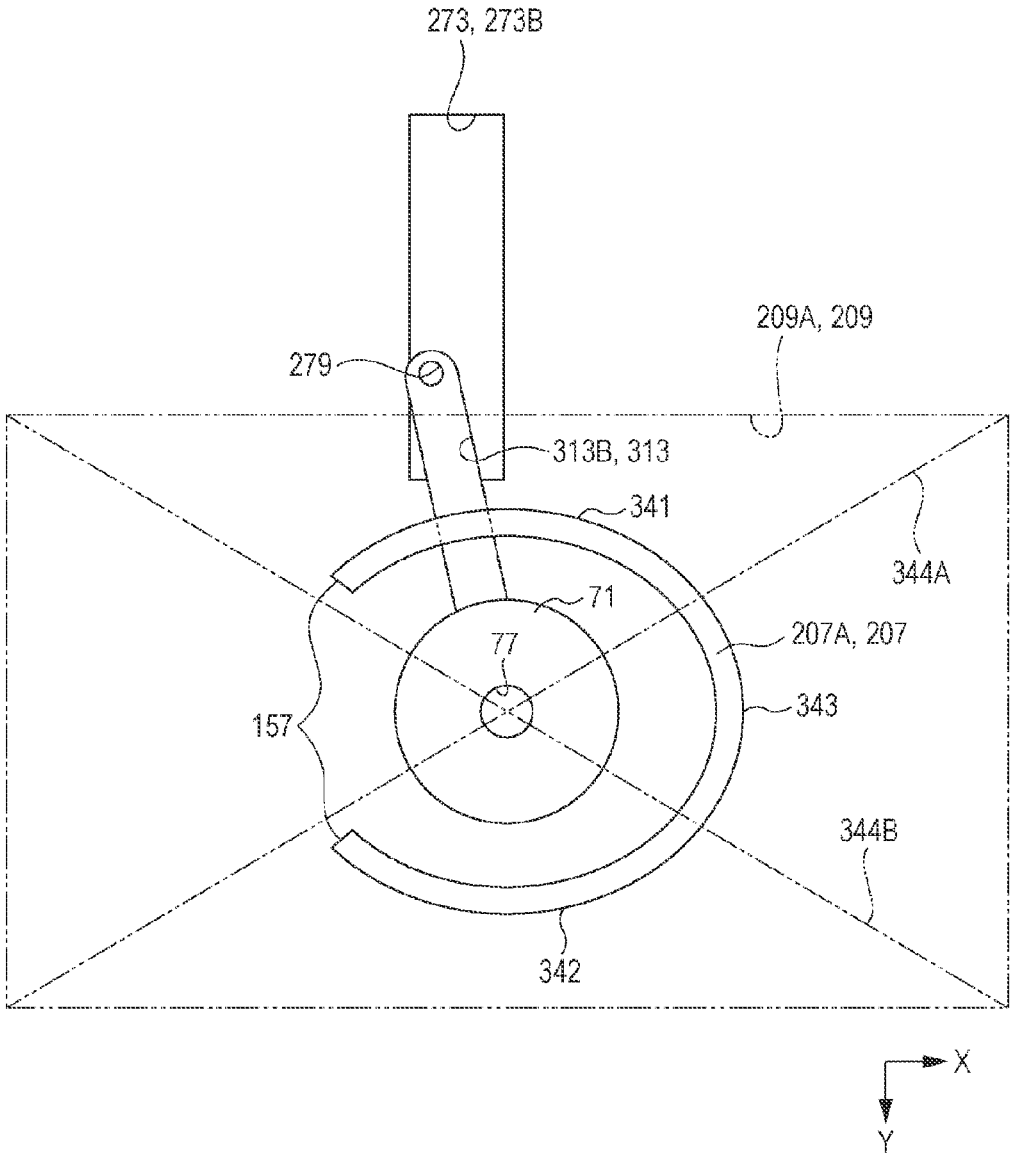
FIG. 32 is a planar diagram schematically illustrating a concave section and the reservoir in the present embodiment.
Figure 33:
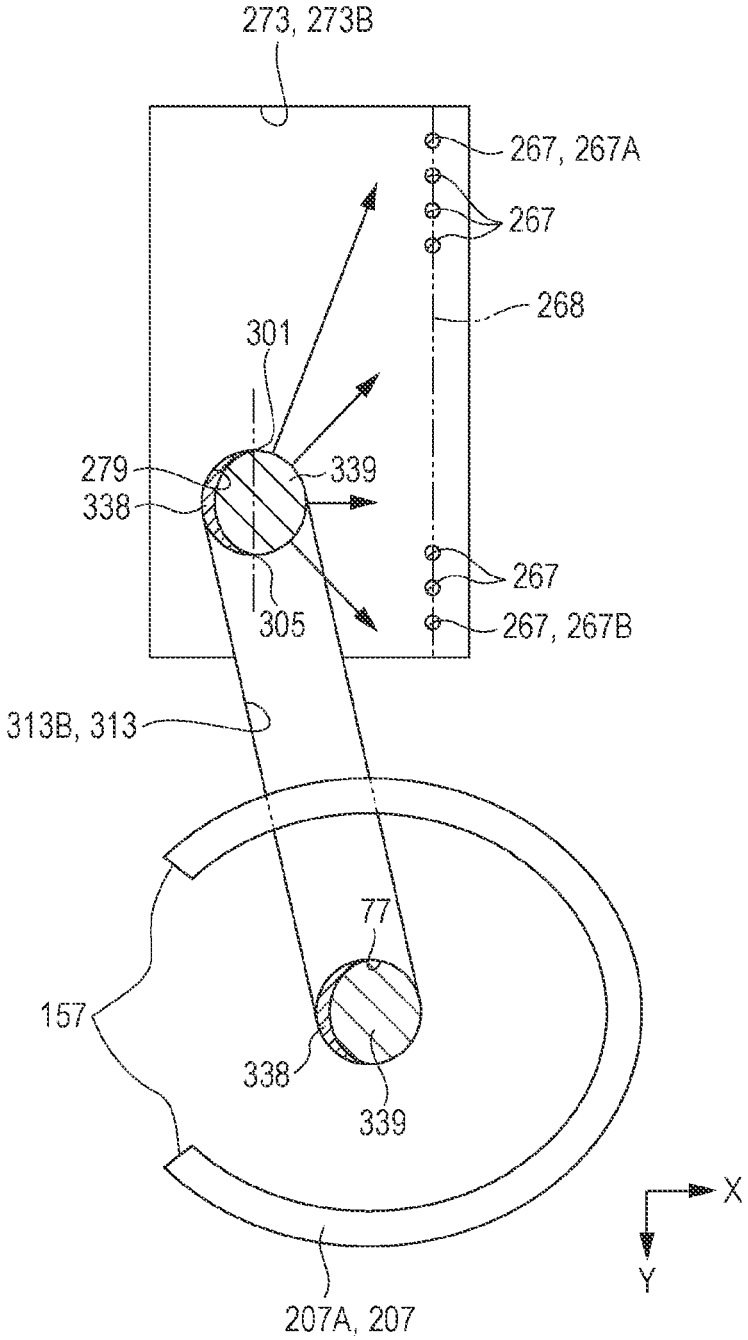
FIG. 33 is a planar diagram schematically illustrating the reservoir, a receiving port, and the regulating member in the present embodiment.

As shown in FIG. 32, the introduction flow path 313B which communicates with the concave section 209A reaches from a position which intersects with the first partition wall 341 of the regulating member 207A to the receiving port 279 of the reservoir 273B. For this reason, the introduction flow path 313B intersects with the regulating member 207A in planar view. As shown in FIG. 33, the first ink 338 flows in along a part which branches into the cutout section 157 of the regulating member 207A in the flow path 77 of the introduction pipe 71 due to the regulating member 207A of the concave section 209A in the same manner as the regulating member 93 of the cartridge 5A described above. The second ink 339 flows in a part which branches into a contour section of the regulating member 207A, and inflow of the first ink 338 is obstructed. In this manner, also in the concave section 209A, the layer of the first ink 338 which flows in a non-annular form along a portion of the inner wall of the flow path 77, and the layer of the second ink 339 which overlaps with the layer of first ink 338 coexist. This state is maintained from the flow path 77 to the receiving port 279 of the reservoir 273B via the introduction flow path 313B.

Ink which reaches the receiving port 279 spreads out inside the reservoir 273B from the receiving port 279. As described above, also inside the reservoir 273B, the concentration difference between the first ink 338 and the second ink 339 is easy to maintain. However, since the layer of the first ink 338 has a non-annular form, at least the second ink 339 is supplied to the first portion 301 and the second portion 305 of the receiving port 279. In addition, it is considered easy to supply both of the first ink 338 and the second ink 339 to the first portion 301 and the second portion 305. For this reason, in a case where ink is supplied from the concave section 209A to the reservoir 273B, at least the second ink 339 is supplied to the first nozzle 267A and the second nozzle 267B. In addition, it is considered easy to supply both of the first ink 338 and the second ink 339 to the first nozzle 267A and the second nozzle 267B. Thereby, it is possible to suppress a state in which only ink with a large content of pigment is ejected from the nozzle 267 which is positioned in the end section of the nozzle row 268. As a result, the effect of uneven printing is suppressed to be low since the concentration of ink which is ejected from the plurality of nozzles 267 which configure the one nozzle row 268 becomes close among the plurality of nozzles 267.

Figure 34:
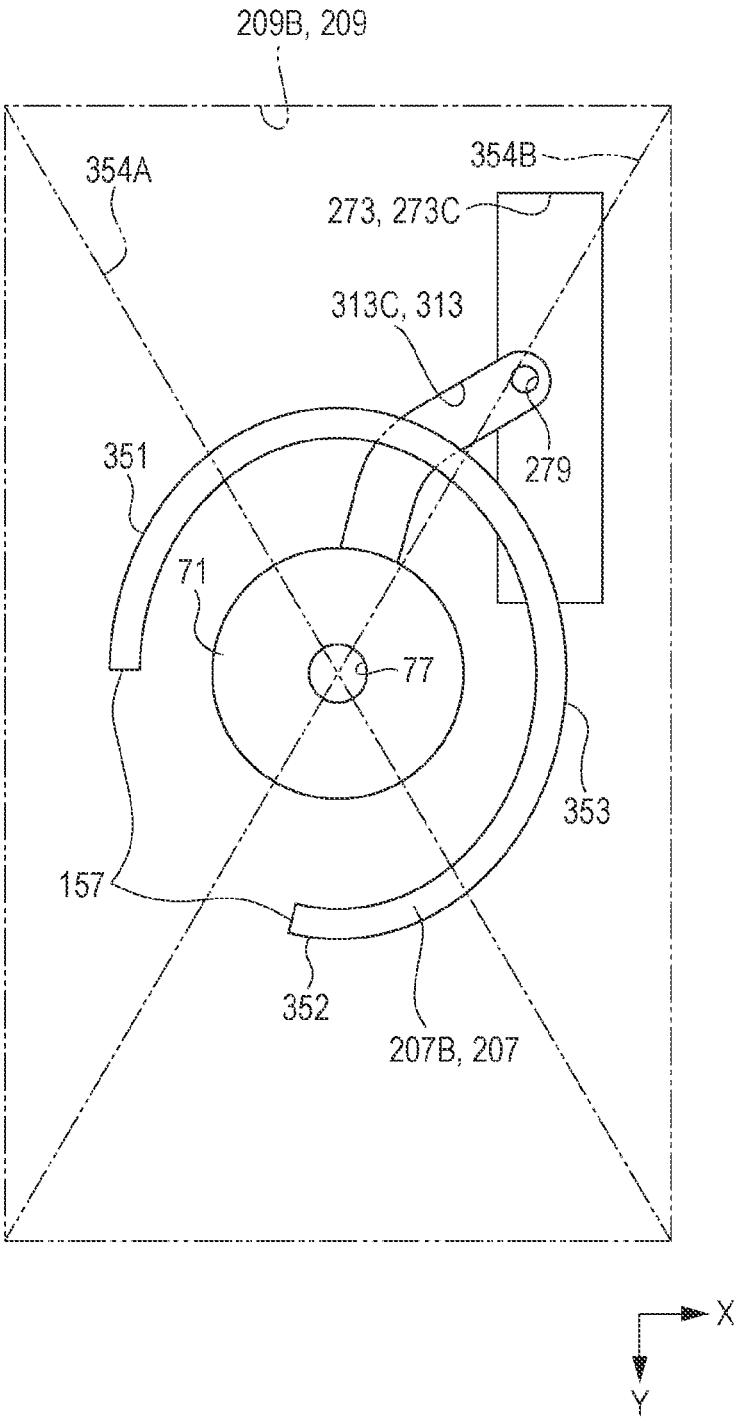
FIG. 34 is a planar diagram schematically illustrating the concave section and the reservoir in the present embodiment.
Figure 35:
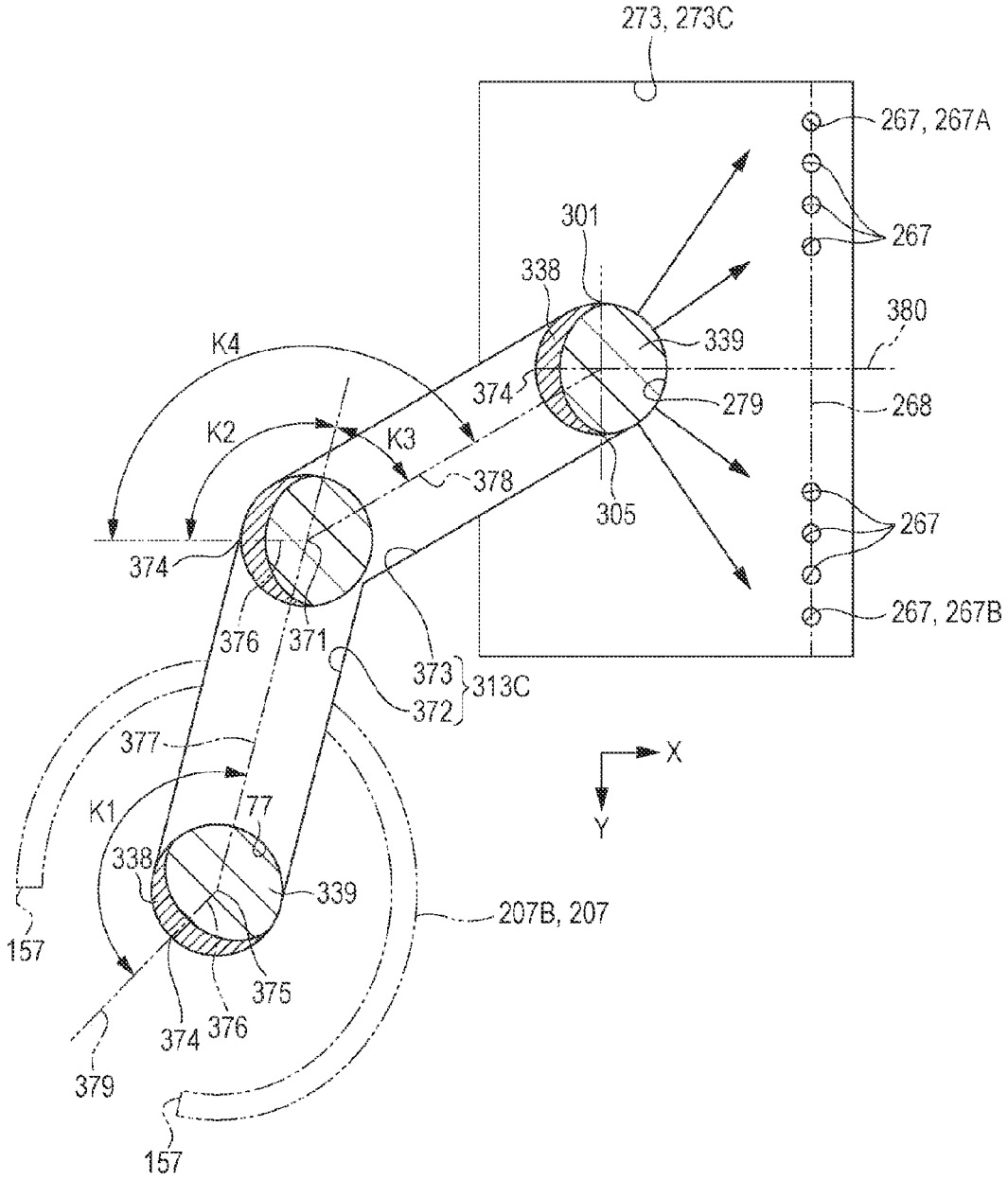
FIG. 35 is a planar diagram schematically illustrating the reservoir, the receiving port, and the regulating member in the present embodiment.

As shown in FIG. 34, the introduction flow path 313C which communicates with the concave section 209B reaches from a position which intersects with the third partition wall 353 of the regulating member 207B to the receiving port 279 of the reservoir 273C. For this reason, the introduction flow path 313C intersects with the regulating member 207B in planar view. As shown in FIG. 35, in the same manner as the concave section 209A, also in the concave section 209B, the first ink 338 flows in along a part which branches into the cutout section 157 of the regulating member 207B in the flow path 77 of the introduction pipe 71. The second ink 339 flows in a part which branches into a contour section of the regulating member 207B, and inflow of the first ink 338 is obstructed. In this manner, also in the concave section 209B, the layer of the first ink 338 which flows in a non-annular form along a section of the inner wall of the flow path 77, and the layer of the second ink 339 which overlaps with the layer of first ink 338 coexist. Here, the center of an arc which overlaps with the layer of the first ink 338 is set as a position 374 of the layer of the first ink 338 in the inner circumference of the flow path 77. An angle K1 between a line segment 376 which links the position 374 of the layer and a center 375 of the inner circumference of the flow path 77, and an extension direction 377 of the first flow path section 372 is maintained across the first flow path section 372.

However, when ink passes through the bent section 371 from the first flow path section 372 toward the second flow path section 373, the angle K1 between the line segment 376 and the extension direction 377 is changed to an angle K2. The angle K1 between the line segment 376 and the extension direction 377 is from the first flow path section 372 toward the second flow path section 373 and rotates the introduction flow path 313C in an orientation of being bent at the bent section 371. Here, the angle at which the introduction flow path 313C is bent at the bent section 371 from the first flow path section 372 toward the second flow path section 373 is set as an angle K3. When ink passes through the bent section 371, the angle K1 is changed to the angle K2 by rotating by the angle K3.

After the ink passes through the bent section 371, the angle between the line segment 376 and the extension direction 378 of the second flow path section 373 in the second flow path section 373 is set as an angle K4. The angle K4 is substantially equal to an angle in which the angle K2 and the angle K3 are added together. That is, the angle K4 is substantially equal to the angle K1. From another viewpoint, when the extension direction 377 is set as advancing direction of the first flow path section 372 and the extension direction 378 is set as an advancing direction of the second flow path section 373, the position 374 of the layer with respect to the advancing direction is maintained across the introduction flow path 313C.

Ink which reaches the receiving port 279 spreads out inside the reservoir 273C from the receiving port 279. As described above, also inside the reservoir 273C, the concentration difference between the first ink 338 and the second ink 339 is easy to maintain. However, since the layer of the first ink 338 has a non-annular form, at least the second ink 339 is supplied to the first portion 301 and the second portion 305 of the receiving port 279. In addition, it is considered easy to supply both of the first ink 338 and the second ink 339 to the first portion 301 and the second portion 305. For this reason, in a case where ink is supplied from the concave section 209B to the reservoir 273C, at least the second ink 339 is supplied to the first nozzle 267A and the second nozzle 267B. In addition, it is considered easy to supply both of the first ink 338 and the second ink 339 to the first nozzle 267A and the second nozzle 267B. Thereby, it is possible to suppress a state in which only ink with a large content of pigment is ejected from the nozzle 267 which is positioned in the end section of the nozzle row 268. As a result, the effect of uneven printing is suppressed to be low since the concentration of ink which is ejected from the plurality of nozzles 267 which configure the one nozzle row 268 becomes close among the plurality of nozzles 267.

Here, a direction (the extension direction 377) in which the first flow path section 372 extends from the center of the flow path 77 of the introduction pipe 71 is set as a first direction. In addition, a direction (the extension direction 378) in which the second flow path section 373 extends from the center of the receiving port 279 of the reservoir 273C is set as a second direction. In addition, the extension direction of the line segment 376 in the first flow path section 372 is set as a third direction 379. In addition, a direction (X axis direction) which is orthogonal to the extension direction of the nozzle row 268 is set as a fourth direction 380. Then, the angle between the first direction and the third direction 379, and the angle between the second direction and the fourth direction 380 are equal to one another. That is, it is possible to easily make the concentration of ink which is ejected from the plurality of nozzles 267 which configure the one nozzle row 268 even among the plurality of nozzles 267 by setting the orientation of the regulating member 207B such that the angle between the first direction and the third direction 379, and the angle between the second direction and the fourth direction 380 are equal to one another. That is, a case where there are a plurality of bent sections 371 in the introduction flow path 313 also conforms. Here, in the aspect shown in FIG. 35, the angle between the first direction and the third direction 379 is equivalent to the angle K1. The angle between the second direction and the fourth direction 380 is equivalent to the angle K4.

Figure 36:
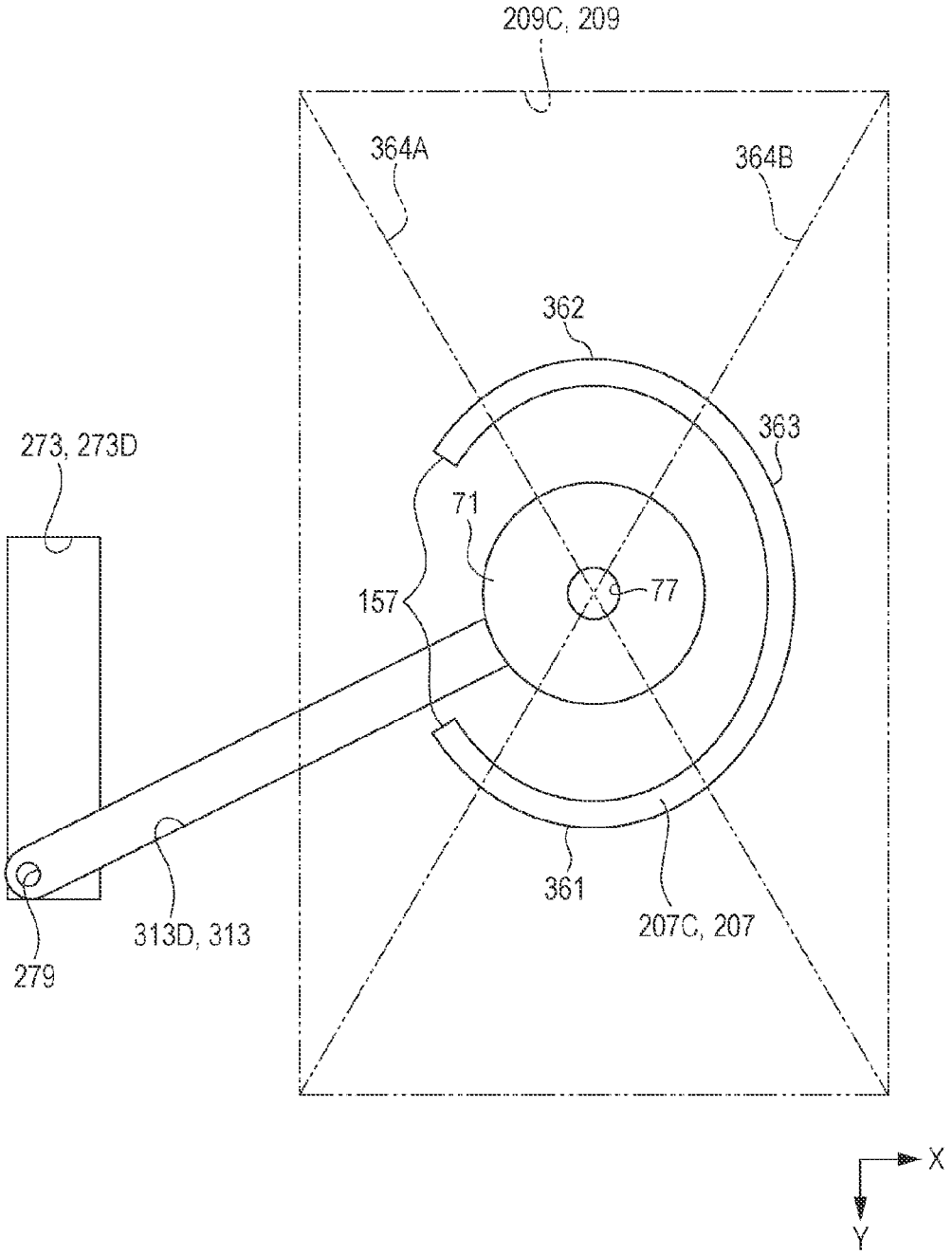
FIG. 36 is a planar diagram schematically illustrating the concave section and the reservoir in the present embodiment.
Figure 37:
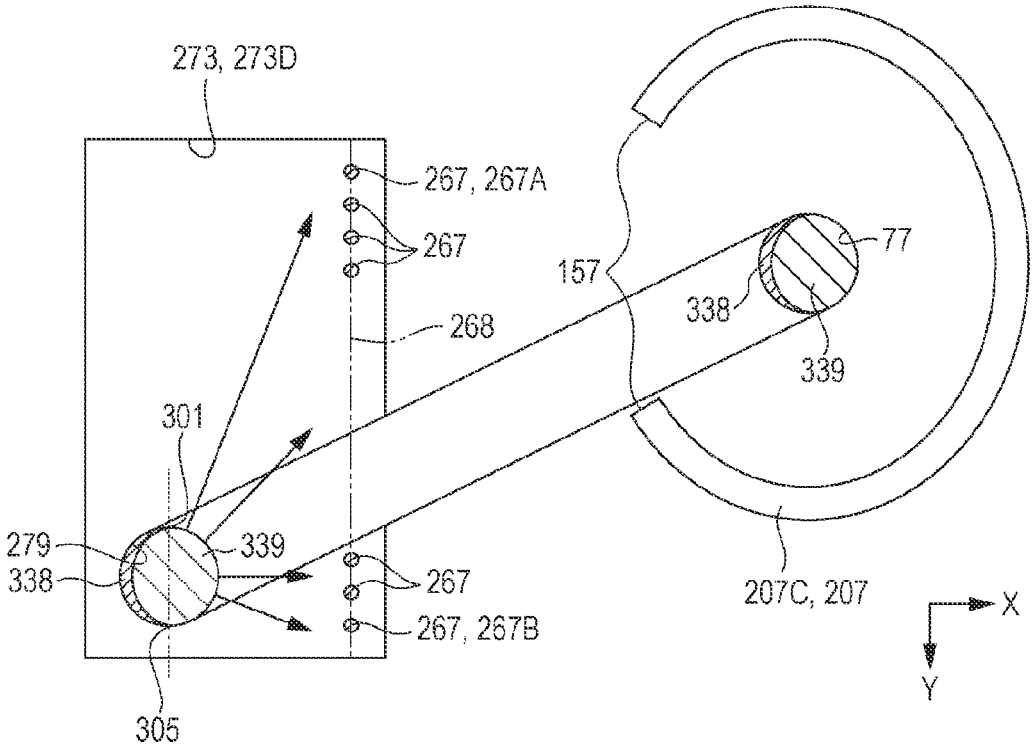
FIG. 37 is a planar diagram schematically illustrating the reservoir, the receiving port, and the regulating member in the present embodiment.

As shown in FIG. 36, the introduction flow path 313D reaches the reservoir 273D by communicating with the region of the cutout section 157 which is formed in the regulating member 207C. For this reason, the introduction flow path 313D intersects with the regulating member 207C in planar view. As shown in FIG. 37, in the same manner as the concave section 209A, also in the concave section 209C, the first ink 338 flows in along a part which branches into the cutout section 157 of the regulating member 207C in the flow path 77 of the introduction pipe 71. The second ink 339 flows in a part which branches into a contour section of the regulating member 207C, and inflow of the first ink 338 is obstructed. In this manner, also in the concave section 209C, the layer of the first ink 338 which flows in a non-annular form along a portion of the inner wall of the flow path 77, and the layer of the second ink 339 which overlaps with the layer of first ink 338 coexist. This state is maintained from the flow path 77 to the receiving port 279 of the reservoir 273D via the introduction flow path 313D.

Ink which reaches the receiving port 279 spreads out inside the reservoir 273D from the receiving port 279. As described above, also inside the reservoir 273D, the concentration difference between the first ink 338 and the second ink 339 is easy to maintain. However, since the layer of the first ink 338 has a non-annular form, at least the second ink 339 is supplied to the first portion 301 and the second portion 305 of the receiving port 279. In addition, it is considered easy to supply both of the first ink 338 and the second ink 339 to the first portion 301 and the second portion 305. For this reason, in a case where ink is supplied from the concave section 209C to the reservoir 273D, at least the second ink 339 is supplied to the first nozzle 267A and the second nozzle 267B. In addition, it is considered easy to supply both of the first ink 338 and the second ink 339 to the first nozzle 267A and the second nozzle 267B. Thereby, it is possible to suppress a state in which only ink with a large content of pigment is ejected from the nozzle 267 which is positioned in the end section of the nozzle row 268. As a result, the effect of uneven printing is suppressed to be low since the concentration of ink which is ejected from the plurality of nozzles 267 which configure the one nozzle row 268 becomes close among the plurality of nozzles 267.

Modification Aspect 1

Figure 38:
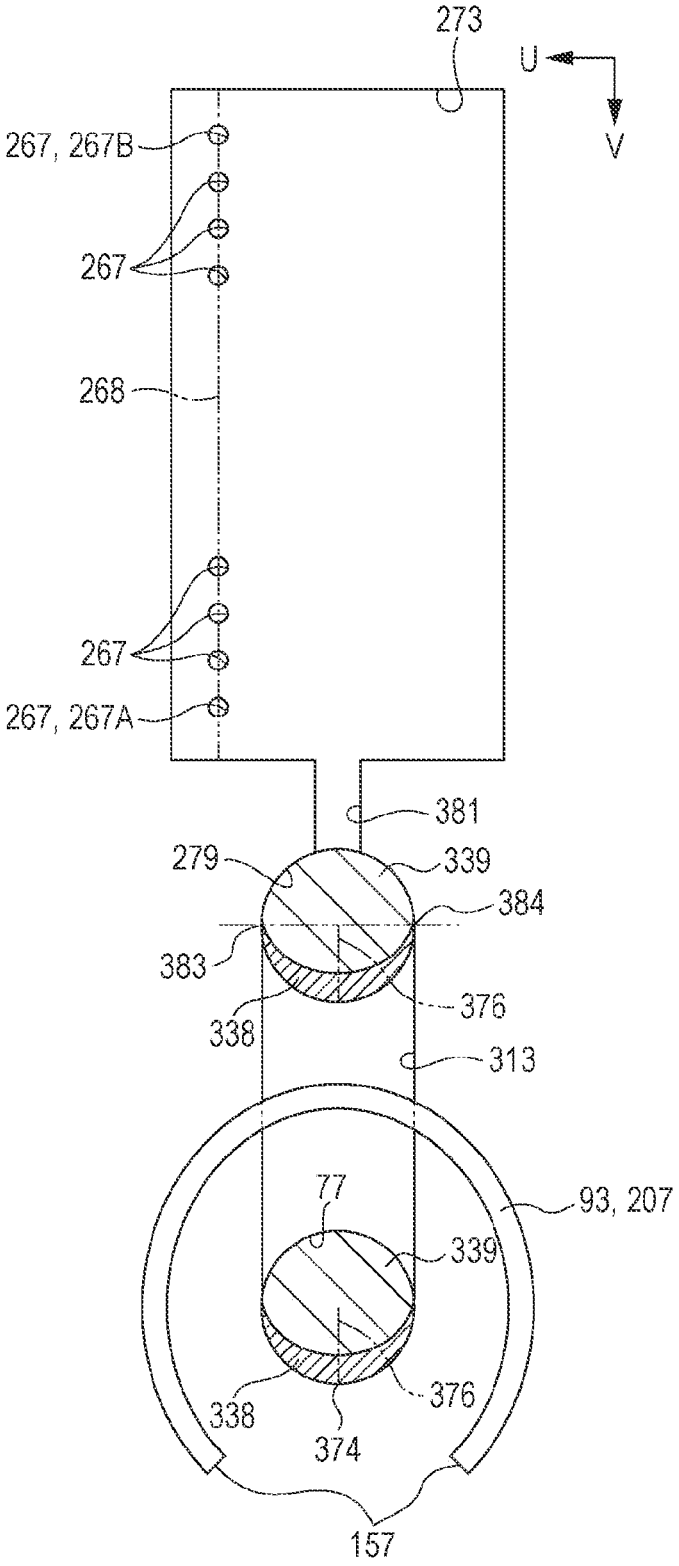
FIG. 38 is a planar diagram schematically illustrating the concave section and the reservoir in Modification Aspect 1.

In the aspect of the printing head 66 described above, when the printing head 66 is in the −Z axis direction in planar view, the receiving port 279 is positioned inside a region which overlaps with the reservoir 273. However, the position of the receiving port 279 is not limited thereto. It is possible to adopt a configuration in which the receiving port 279 is positioned outside the region which overlaps with the reservoir 273. A configuration in which the receiving port 279 is positioned outside the region which overlaps with the reservoir 273 is described below as Modification Aspect 1. In this case, as shown in FIG. 38, a flow path 381 which passes from the receiving port 279 to the reservoir 273 is included between the receiving port 279 and the reservoir 273. Ink which is supplied to the reservoir 273 from the introduction flow path 313 is supplied to the reservoir 273 via the flow path 381 from the receiving port 279.

In the configuration of Modification Aspect 1, a first portion 383 of the receiving port 279 is a contact point close to the first nozzle 267A out of contact points between the receiving port 279 and the V axis which extends in the extension direction of the nozzle row 268. Meanwhile, a second portion 384 of the receiving port 279 is a contact point far from the first nozzle 267A out of contact points between the receiving port 279 and the V axis. In addition, in Modification Aspect 1, the first portion 383 is closer to the first nozzle 267A than the second nozzle 267B.

In Modification Aspect 1, the orientations of the regulating member 93 and the regulating member 207 are set such that the line segment 376 in the receiving port 279 and the extension direction (V axis) of the nozzle row 268 are substantially parallel. Thereby, at least the second ink 339 is supplied to both the first portion 383 and the second portion 384. In addition, it is considered easy to supply both of the first ink 338 and the second ink 339 to the first portion 383 and the second portion 384. Ink which is supplied to the first portion 383 spreads out toward the first nozzle 267A side inside the reservoir 273. Meanwhile, ink which is supplied to the second portion 384 spreads out toward the second nozzle 267B side inside the reservoir 273. For this reason, at least the second ink 339 is supplied to both the first nozzle 267A and the second nozzle 267B. In addition, it is considered easy to supply the first ink 338 and the second ink 339 to the first nozzle 267A and the second nozzle 267B. Thereby, it is possible to suppress a state in which only ink with a large content of pigment is ejected from the nozzle 267 which is positioned in the end section of the nozzle row 268. As a result, the effect of uneven printing is suppressed to be low since the concentration of ink which is ejected from the plurality of nozzles 267 which configure the one nozzle row 268 becomes close among the plurality of nozzles 267. In this manner, the same effects to Aspect 1 are also obtained in Modification Aspect 1.

Here, in the aspect shown in FIG. 38, the orientations of the regulating member 93 and the regulating member 207 are set such that the line segment 376 in the flow path 77 of the introduction pipe 71 and the extension direction (V axis) of the nozzle row 268 are substantially parallel. That is, in the aspect shown in FIG. 38, the regulating member 93 and the regulating member 207 are arranged in a state in which the cutout section 157 of the regulating member 93 and the regulating member 207 faces the V axis direction. Refer to Aspect 1 described above for the orientation of the regulating member 93 and the regulating member 207 in a case where the introduction flow path 313 is bent.

Modification Aspect 2

In Aspect 1 and Modification Aspect 1, one cutout section 157 is formed in each of the regulating member 93 and the regulating member 207. However, the number of cutout sections 157 is not limited to one. It is possible to adopt a configuration in which two or more cutout sections 157 are formed in each of the regulating member 93 and the regulating member 207. An aspect in which two cutout sections 157 are formed in each of the regulating member 93 and the regulating member 207 is described in Modification Aspect 2. Here, in Modification Aspect 2, the same reference numerals as in Aspect 1 are given and detailed description is omitted for configurations which are the same as in Aspect 1.

Figure 39:
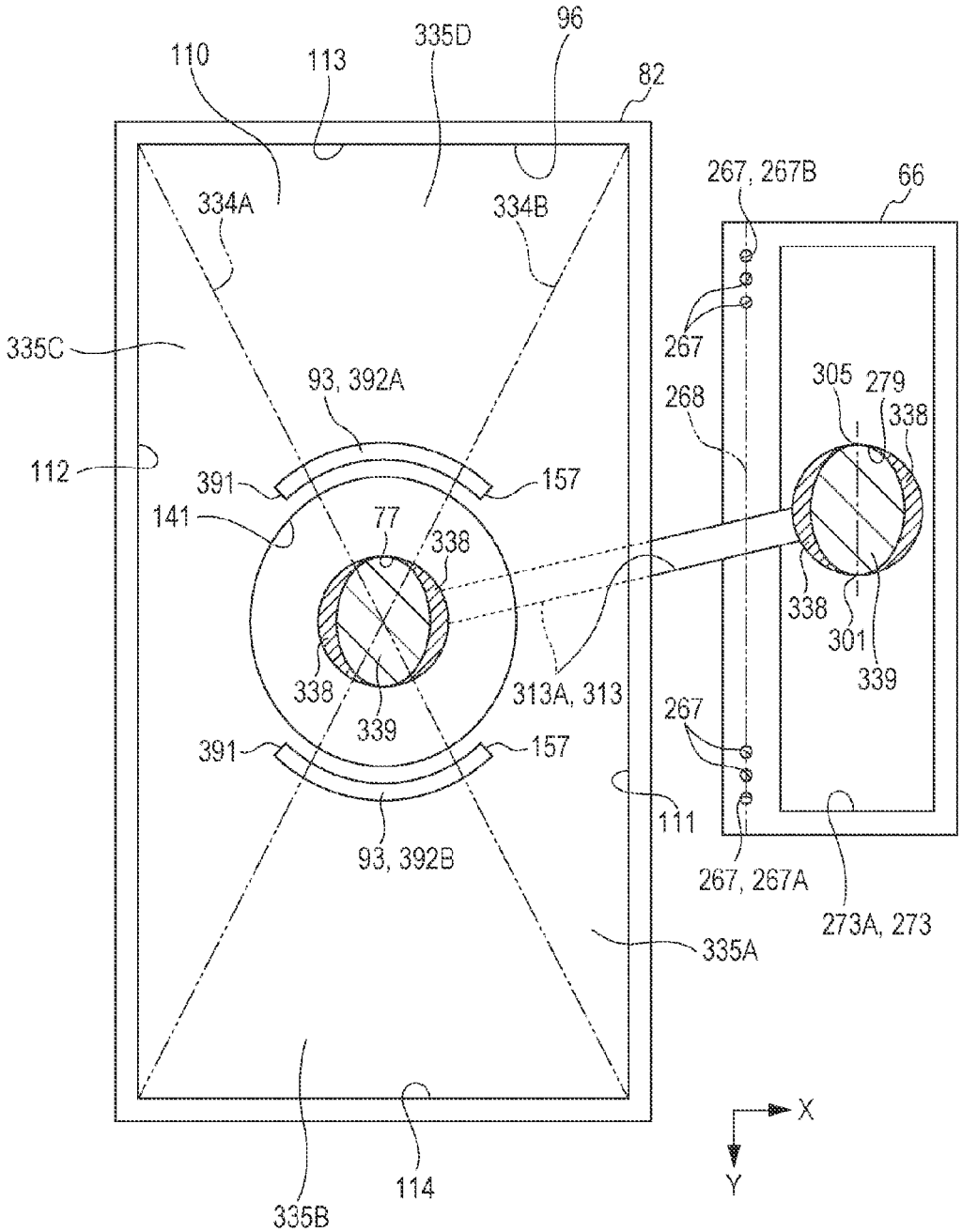
FIG. 39 is a planar diagram schematically illustrating the concave section and the reservoir in Modification Aspect 2.

As shown in FIG. 39, in the cartridge 5A in Modification Aspect 2, the cutout section 157 and a cutout section 391 are formed in the regulating member 93. For this reason, in Modification Aspect 2, the regulating member 93 is divided into a regulating member 392A and a regulating member 392B. The cutout section 157 and the cutout section 391 are formed at positions which interpose the supply hole 141 and are branched from one another. The cutout section 157 and the cutout section 391 are formed at positions which are point symmetrical to one another with respect to an intersection point of the diagonal line 334A and the diagonal line 334B.

The first ink 338 flows in along a part which branches into the cutout section 157 of the regulating member 93, and the first ink 338 flows in along a part which branches into the cutout section 391 of the regulating member 93 in the flow path 77 of the introduction pipe 71. The second ink 339 flows in a part which branches into a contour section of the regulating member 93, and inflow of the first ink 338 is obstructed. In this manner, the two layers of the first ink 338 which flows in a non-annular form along a portion of the inner wall of the flow path 77, and the layer of the second ink 339 which is interposed by the two layers of first ink 338 coexist. This state is maintained from the flow path 77 to the receiving port 279 of the reservoir 273A via the introduction flow path 313A.

Ink which reaches the receiving port 279 spreads out inside the reservoir 273A from the receiving port 279. Also inside the reservoir 273A, the concentration difference between the first ink 338 and the second ink 339 is easy to maintain. However, since the two layers of the first ink 338 have non-annular forms, at least the second ink 339 is supplied to the first portion 301 and the second portion 305 out of the receiving port 279. In addition, it is considered easy to supply both of the first ink 338 and the second ink 339 to the first portion 301 and the second portion 305. For this reason, in a case where ink is supplied from the concave section 96 to the reservoir 273A, at least the second ink 339 is supplied to the first nozzle 267A and the second nozzle 267B. In addition, it is considered easy to supply both of the first ink 338 and the second ink 339 to the first nozzle 267A and the second nozzle 267B. Thereby, it is possible to suppress a state in which only ink with a large content of pigment is ejected from the nozzle 267 which is positioned in the end section of the nozzle row 268. As a result, the effect of uneven printing is suppressed to be low since the concentration of ink which is ejected from the plurality of nozzles 267 which configure the one nozzle row 268 becomes close among the plurality of nozzles 267.

Concerning the cartridge 5B of Modification Aspect 2, refer to the cartridge 5A of Modification Aspect 2. That is, the cutout section 157 and the cutout section 391 are formed in the regulating member 207. Then, also in the regulating member 207, the cutout section 157 and the cutout section 391 are formed at positions which interpose the supply hole 141 and are branched from one another. The cutout section 157 and the cutout section 391 are formed at positions which are point symmetrical to one another with respect to an intersection point of the diagonal line 334A and the diagonal line 334B. Due to this configuration, also in the cartridge 5B of Modification Aspect 2, it is easy to eject ink with a large content of pigment and ink with a small content of pigment from the nozzle 267 which is positioned in the end section of the nozzle row 268. As a result, the effect of uneven printing is suppressed to be low since the concentration of ink which is ejected from the plurality of nozzles 267 which configure the one nozzle row 268 becomes close among the plurality of nozzles 267. In this manner, the same effects to Aspect 1 and Modification Aspect 1 are also obtained in Modification Aspect 2.

Figure 40:
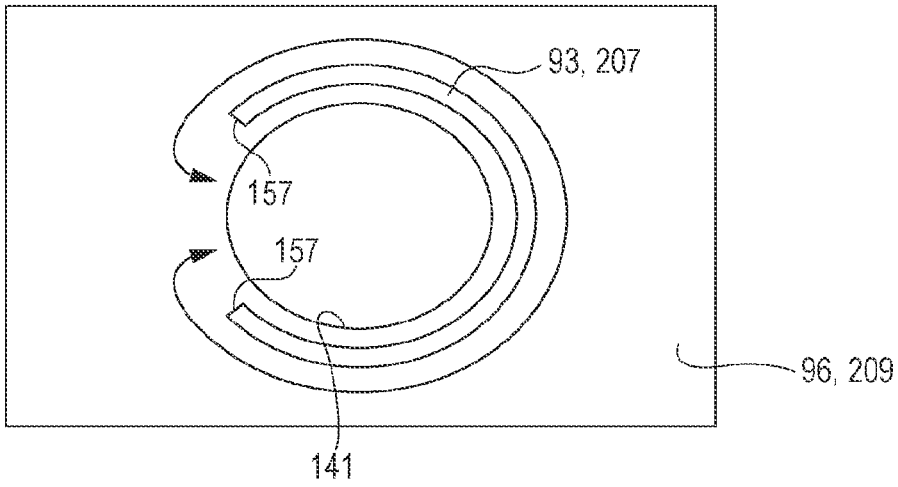
FIG. 40 is a planar diagram schematically illustrating the concave section and the reservoir in Application Aspect 1.

Furthermore, in Modification Aspect 2, it is possible to reduce the amount of ink not being used which remains inside the cartridge 5. In Aspect 1, there is one cutout section 157 which is formed in the regulating member 93 and the regulating member 207. For this reason, as shown in FIG. 40, in a region outside the regulating member 93 and the regulating member 207, ink which is positioned at the opposite side to the cutout section 157 reaches the supply hole 141 from the cutout section 157 around the outside (the arrow in the drawing) of the regulating member 93 and the regulating member 207. In contrast to this, in Modification Aspect 2, as shown in FIG. 39, the cutout sections 391 are formed at positions which interpose the supply hole 141 and are branched to the cutout sections 157. For this reason, in a region outside the regulating member 93 and the regulating member 207, it is possible for ink which is positioned at the opposite side to the cutout section 157 to reach the supply hole 141 from the cutout section 391. That is, in Modification Aspect 2, in a region outside the regulating member 93 and the regulating member 207, it is possible to shorten a distance for ink which is positioned at the opposite side to the cutout section 157 to reach the supply hole 141. For this reason, it is possible to reduce the amount of ink which remains inside the cartridge 5.

Modification Aspect 3

In each of Aspect 1, Modification Aspect 1, and Modification Aspect 2, the regulating member 93 is configured by separate members of the first case 82 and the second case 83. In addition, the regulating member 207 is also configured by separate members of the third case 201 and the fourth case 202. However, the configuration of the regulating member 93 and the regulating member 207 is not limited thereto. An aspect of another configuration of the regulating member 93 and the regulating member 207 is described in Modification Aspect 3. It is also possible to adopt a configuration in which the first case 82 and the second case 83 are integrally formed as the configuration of the regulating member 93 of Modification Aspect 3. In addition, it is also possible to adopt a configuration in which the third case 201 and the fourth case 202 are integrally formed as the configuration of the regulating member 207 of Modification Aspect 3. The same effects to Aspect 1, Modification Aspect 1, and Modification Aspect 2 are also obtained in Modification Aspect 3. Here, the regulating member 93 and the regulating member 207 in Modification Aspect 3 correspond to a first plate-like protruding section.

Modification Aspect 4

Figure 41:
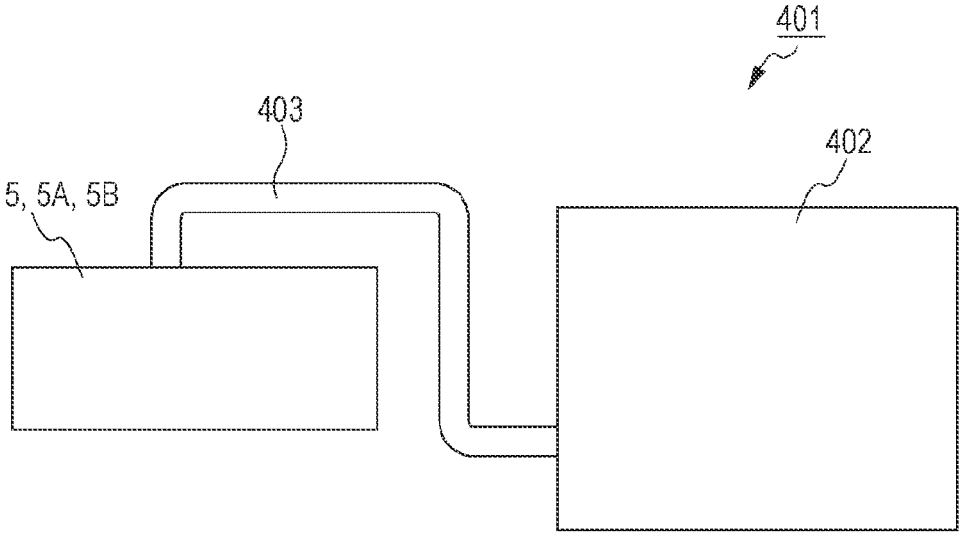
FIG. 41 is a diagram explaining the configuration of a liquid supply unit in Application Aspect 4.

The liquid supply unit for supplying liquid to the liquid ejecting apparatus is not limited to the cartridge 5 which is an aspect of a liquid container. Another aspect of the liquid supply unit is described in Modification Aspect 4. As shown in FIG. 41, a liquid supply unit 401 in Modification Aspect 4 has the cartridge 5 of Aspect 1 and Modification Aspect 1 to Modification Aspect 3, a tank 402, and a supply pipe 403. The tank 402 contains ink for supplying to the cartridge 5 of Aspect 1 and Modification Aspect 1 to Modification Aspect 3. The supply pipe 403 leads liquid from the tank 402 to the cartridge 5. The supply pipe 403 has flexibility. The same effects to Aspect 1 and Modification Aspect 1 to Modification Aspect 3 are also obtained in Modification Aspect 4.

In addition, in Modification Aspect 4, the tank 402 is included independently from the carriage unit 25 with respect to the mounting of the cartridge 5 in the carriage unit 25 (FIG. 3). That is, in Modification Aspect 4, the tank 402 is mounted in the carriage unit 25. For this reason, it is possible to increase the amount of ink which it is possible to supply to the liquid ejecting apparatus while reducing a load which is applied to the carriage unit 25. Furthermore, it is possible to shorten or eliminate a stop time of the liquid ejecting apparatus due to ink running out if a configuration is set in which new ink is refillable into the tank 402.

Modification Aspect 5

In the cartridge 5 in each of Aspect 1 and Modification Aspect 1 to Modification Aspect 4 described above, a configuration is adopted in which ink is held in the holding member 84, the holding member 91, the holding member 204, or the holding member 205. However, the configuration of the cartridge 5 is not limited thereto. For example, it is also possible to adopt a configuration (Modification Aspect 5) in which the holding member 84, the holding member 91, the holding member 204, or the holding member 205 are not included as the configuration of the cartridge 5.

Modification Aspect 6

Figure 42:
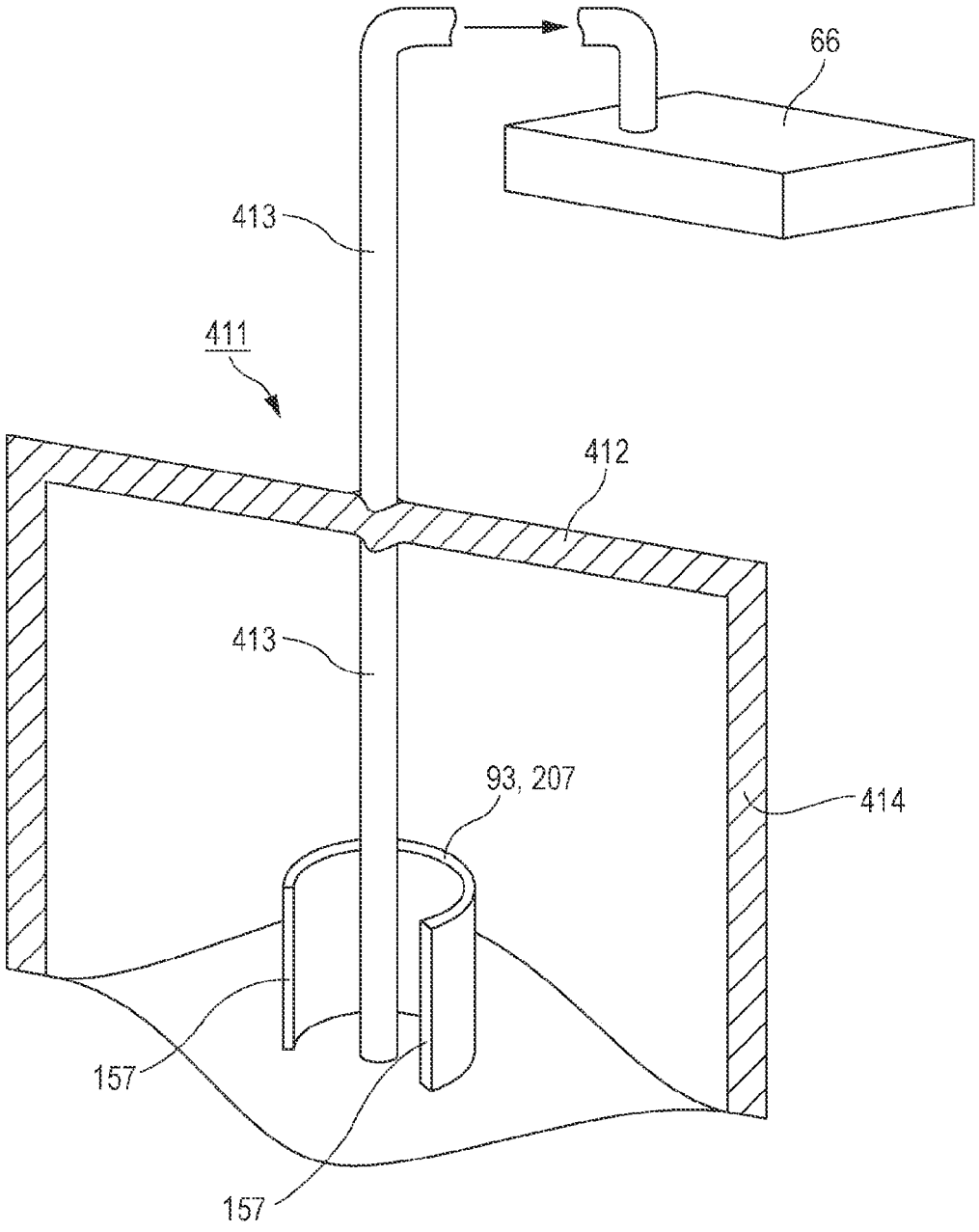
FIG. 42 is a diagram explaining the configuration of a pack in Application Aspect 6.

The liquid container is not limited to the aspect of the cartridge 5, and it is also possible to adopt, for example, an aspect of a pack which is formed in a bag form using a sheet member which has flexibility. An example of the aspect of a pack is described in Modification Aspect 6. As shown in FIG. 42, a pack 411 in Modification Aspect 6 has an ink bag 412, an outlet pipe 413, and the regulating member 93 (regulating member 207). The ink bag 412 is formed in a bag form by joining a joining section 414 to the sheet member. Ink is contained inside the ink bag 412.

The outlet pipe 413 protrudes outside from the inside the ink bag 412. Ink inside the ink bag 412 passes through the outlet pipe 413 and is led outside of the ink bag 412. The outlet pipe 413 communicates with the printing head 66. Ink which is inside the ink bag 412 is supplied to the printing head 66 via the outlet pipe 413. The regulating member 93 is accommodate inside the ink bag 412 and is fixed to the bottom section of the ink bag 412. An end section of the outlet pipe 413 inside the ink bag 412 is inserted inside the regulating member 93. Here, in FIG. 42, a configuration inside the ink bag 412 where the ink bag 412 is transparent is indicated in order for the configuration to be easy to understand.

In the configuration described above, in the pack 411, the first ink 338 flows in along a part which branches into the cutout section 157 of the regulating member 93 in the outlet pipe 413 inside the ink bag 412. In addition, the second ink 339 flows in a part which branches into a contour section of the regulating member 93 in the outlet pipe 413, and inflow of the first ink 338 is obstructed. In this manner, also in Aspect 1, the layer of the first ink 338 which flows in a non-annular form along a portion of the inner wall of the outlet pipe 413, and the layer of the second ink 339 which overlaps with the layer of first ink 338 coexist. In the same manner as Aspect 1, this state is maintained from the outlet pipe 413 to the receiving port 279 of the reservoir 273 of the printing head 66. Consequently, also in Modification Aspect 6 in the same manner as Modification Aspect 1, it is easy to eject ink with a large content of pigment and ink with a small content of pigment from the nozzle 267 which is positioned in the end section of the nozzle row 268. As a result, the effect of uneven printing is suppressed to be low since the concentration of ink which is ejected from the plurality of nozzles 267 which configure the one nozzle row 268 becomes close among the plurality of nozzles 267. Here, in Modification Aspect 6, it is also possible to adopt a configuration in which the regulating member 93 or the regulating member 207 is substituted by the regulating member 93 or the regulating member 207 in Modification Aspect 2.

The invention is not limited to an ink jet printer and an ink cartridge therefor, and it is also possible to apply the invention to an arbitrary printing apparatus (liquid discharge apparatus) which ejects (discharges) another liquid other than ink and to a cartridge therefor. For example, it is possible to apply the invention to various printing apparatuses and cartridges therefor described below.

(1) An image recording apparatus such as a facsimile apparatus.

(2) A color material ejecting printing apparatus which is used in production of a color filter for an image display apparatus such as a liquid crystal display.

(3) A printing apparatus which ejects an electrode material which is used in electrode formation for an organic EL (Electro Luminescence) display, a surface light-emitting display (a Field Emission Display (FED)), or the like.

(4) A printing apparatus which ejects liquid which includes biological organic substances which are used in bio-chip production.

(5) A sample printing apparatus which is used as a precision pipette.

(6) A lubricant printing apparatus.

(7) A resin liquid printing apparatus.

(8) A printing apparatus which ejects lubricant with pinpoint accuracy in a precision machine such as a watch or a camera.

(9) A printing apparatus which ejects a transparent resin liquid such as an ultraviolet curable resin liquid on a substrate in order to form a micro-spherical lens (an optical lens) which is used in an optical communication element or the like.

(10) A printing apparatus which ejects acidic or alkaline etching liquid in order to carry out etching on a substrate or the like.

(11) A printing apparatus which is includes a liquid ejecting head (liquid discharge head) which discharges liquid droplets of another arbitrary small amount.

Here, "liquid droplet" includes good, granular shape, tear shape, and yarn pulled out in a tail states of liquid which is discharged from the printing apparatus. Here, it is sufficient if "liquid" is a material that it is possible for a printing apparatus to eject. For example, it is sufficient if "liquid" is a material in a state when a substance is in a liquid phase, and a liquid state material having high or low viscosity, a sol, a gel, and other materials in a liquid state such as an inorganic solvent, an organic solvent, a solution, a liquid state resin, and a liquid metal (a molten metal) are also included in "liquid". In addition, the state of the substance is not limited only to liquid, and a substance where particles of a functional material made from a solid substance such as a pigment or metallic particles are dissolved, dispersed, or mixed in a solvent are included in "liquid". It is also possible to express "liquid" described above as "liquid body". As a representative aspect of liquid and a liquid body aspects are given such as ink, liquid crystal, and the like which are described in the embodiment described above. Here, ink contains various types of liquid-form compositions such as a typical water-based ink, oil-based ink, gel ink, and hot melt ink.

What is claimed is:

1. A liquid ejecting apparatus comprising:

a head unit having a liquid introduction pipe, a liquid introduction flow path connected to the liquid introduction pipe at one end and that includes a liquid inlet at another end, a reservoir that receives liquid from the liquid inlet, and at least one nozzle row including a plurality of nozzles arranged in a plane defined by an X-direction and a Y-direction perpendicular to the X-direction and further arranged in a row in the Y-direction, the liquid introduced from the liquid introduction pipe being supplied to the at least one nozzle row via the liquid introduction flow path and the reservoir, in that order;

a liquid supply unit having a liquid holding section that hold a liquid containing pigment, a liquid supply opening configured to receive the liquid introduction pipe to supply the liquid from the holding section to the head unit, and a flow path regulating member arranged so as to surround the liquid supply opening, the flow path regulating member having a wall and a cut-out section, wherein the liquid that flows into the liquid supply opening includes a first liquid with a high pigment content and a second liquid with a lower pigment content than that of the first liquid, the wall of the flow path regulating member prevents the first liquid from flowing into the liquid supply opening, and the cut-out section allows the first liquid to flow into the liquid supply opening, and a layer of the first liquid has a non-annular form at the liquid inlet.

2. The liquid ejecting apparatus according to claim 1, wherein:

the liquid inlet has an outer periphery that includes one end section and another end section in the Y direction, and the wall and the cut-out section of the flow path regulating member are arranged so that the second liquid is supplied to the one end section of the liquid inlet.

3. The liquid ejecting apparatus according to claim 2, wherein the flow path regulating member is configured to supply the second liquid, from one of the first liquid and the second liquid, to the one end section and the another end section of the liquid introduction flow path.

4. The liquid ejecting apparatus according to claim 1, wherein:

the liquid inlet has an outer periphery that includes one end section and another end section in X-direction, and the wall and the cut-out section of the flow path regulating member are arranged so that the second liquid is supplied to the one end section of the liquid inlet.

5. The liquid ejecting apparatus according to claim 4, wherein the flow path regulating member is configured to supply the second liquid, from one of the first liquid and the second liquid, to the one end section and the another end section of the liquid introduction flow path.

6. The liquid ejecting apparatus according to claim 1, wherein the liquid introduction flow path includes a first flow path section which extends in a first direction from the liquid introduction pipe, and a second flow path section which extends in a second direction from the reservoir, and in a state where a linking direction between a center of the liquid supply opening and the center of the cut-out section is defined as a third direction, an angle between the first direction and the third direction and an angle between the second direction and the X-direction being equal to one another.

7. The liquid ejecting apparatus according to claim 1, wherein the liquid supply unit further includes a casing having a first surface provided with the liquid supply opening, a second surface intersecting with the first surface, and a third surface intersecting with the first surface and opposes the second surface, and the wall of the flow path regulating mechanism includes a first partition wall section which is positioned between the liquid supply opening and the second surface.

8. The liquid ejecting apparatus according to claim 7, wherein the flow path regulating mechanism further includes a second partition wall section positioned between the liquid supply opening and the third surface.

9. The liquid ejecting apparatus according to claim 8, wherein the casing further includes a fourth surface intersecting with the first surface, the second surface, and the third surface, and a fifth surface intersecting with the first surface, the second surface, and the third surface, and opposes the fourth surface, the wall of the flow path regulating mechanism further includes a third partition wall section positioned between the liquid supply opening and the fourth surface, and the first partition wall section and the second partition wall section are linked by the third partition wall section.

10. The liquid ejecting apparatus according to claim 1, wherein the liquid supply unit further includes a liquid holding member provided in the liquid holding section, and the flow path regulating member is provided in the liquid holding member.

11. The liquid ejecting apparatus according to claim 10, the liquid holding member includes a first liquid holding member and a second liquid holding member, the first liquid holding member is provided between the liquid supply opening and the second liquid holding member, the flow path regulating member comprised of a plate-like member having the cut out section, and the plate-like member is inserted into the first liquid holding member.

* * * * *